US009064656B2

(12) United States Patent
Obata et al.

(10) Patent No.: US 9,064,656 B2
(45) Date of Patent: Jun. 23, 2015

(54) SAFETY SWITCH

(75) Inventors: Norifumi Obata, Osaka (JP); Etsurou Komori, Osaka (JP); Takeo Yasui, Osaka (JP)

(73) Assignee: IDEC CORPORATION, Osaka (JP)

( * ) Notice: Subject to any disclaimer, the term of this patent is extended or adjusted under 35 U.S.C. 154(b) by 452 days.

(21) Appl. No.: 13/497,030

(22) PCT Filed: Jun. 16, 2010

(86) PCT No.: PCT/JP2010/003989

§ 371 (c)(1),
(2), (4) Date: Mar. 19, 2012

(87) PCT Pub. No.: WO2011/033705

PCT Pub. Date: Mar. 24, 2011

(65) Prior Publication Data

US 2012/0175228 A1 Jul. 12, 2012

(30) Foreign Application Priority Data

Sep. 18, 2009 (JP) ..... 2009-216698

(51) Int. Cl.

| | |
|---|---|
| ***H01H 9/20*** | (2006.01) |
| ***H01H 27/00*** | (2006.01) |
| *H01H 3/42* | (2006.01) |
| *H01H 9/28* | (2006.01) |
| *H01H 13/60* | (2006.01) |

(52) U.S. Cl.

CPC ..... *H01H 27/002* (2013.01); *H01H 3/42* (2013.01); *H01H 9/286* (2013.01); *H01H 13/60* (2013.01)

(58) Field of Classification Search

CPC ..... H01H 27/42; H01H 9/286; H01H 13/60; H01H 9/20; H01H 9/285

USPC ..... 200/0.01–50.06, 50.11–50.13, 50.16, 200/43.04, 43.07, 43.09, 43.11

See application file for complete search history.

(56) References Cited

U.S. PATENT DOCUMENTS

| | | | | |
|---|---|---|---|---|
| 4,524,251 | A * | 6/1985 | Schulz | 200/43.07 |
| 5,516,993 | A * | 5/1996 | Wecke et al. | 200/17 R |
| 5,587,569 | A * | 12/1996 | Mohtasham | 200/17 R |
| 5,703,339 | A * | 12/1997 | Rapp et al. | 200/17 R |
| 5,868,243 | A | 2/1999 | Bachle | |
| 6,118,087 | A * | 9/2000 | Fukui | 200/43.04 |
| 6,307,167 | B1 * | 10/2001 | Kajio et al. | 200/43.11 |

(Continued)

FOREIGN PATENT DOCUMENTS

| | | |
|---|---|---|
| JP | 11-502669 | 3/1999 |
| JP | 2003-031084 | 1/2003 |

(Continued)

*Primary Examiner* — Edwin A. Leon
*Assistant Examiner* — Ahmed Saeed
(74) *Attorney, Agent, or Firm* — Jordan and Hamburg LLP

(57) ABSTRACT

A safety switch is improved by the feature of staying in an open position in the event of breakage of a working rod or breakage or dropout of an operation portion and having a simple structure facilitating size reduction. Even if a rotary shaft is released from a supported state in an operation portion because an operating force of an operation or the number of operations of extracting an actuator from the operation portion exceeds a breakage tolerance, a working rod is permitted to move in an urging direction of a coil spring and is assuredly moved to the operation portion. Therefore, a switch can be assuredly set to an open position and, hence, the safety switch can achieve the safety improvement.

27 Claims, 31 Drawing Sheets

(56) References Cited

U.S. PATENT DOCUMENTS

| | | | | |
|---|---|---|---|---|
| 7,605,335 | B2 * | 10/2009 | Hiltl et al. | 200/43.04 |
| 7,667,149 | B2 * | 2/2010 | Komori et al. | 200/43.04 |
| 7,928,330 | B2 * | 4/2011 | Poyner et al. | 200/43.07 |
| 8,228,146 | B2 * | 7/2012 | Bachle et al. | 335/179 |
| 8,289,112 | B1 * | 10/2012 | Bachle et al. | 335/179 |
| 2008/0121499 | A1 | 5/2008 | Komori et al. | |

FOREIGN PATENT DOCUMENTS

| | | |
|---|---|---|
| JP | 2003-297192 | 10/2003 |
| JP | 2006-252778 | 9/2006 |
| JP | 2007-323985 | 12/2007 |
| JP | 2009-016214 | 1/2009 |
| WO | WO-2009/066756 | 5/2009 |

* cited by examiner

SAFETY SWITCH

BACKGROUND OF THE INVENTION

The present invention relates to a safety switch mounted on, for example, a wall surface around a protective door of an industrial machine or the like and operative to interrupt power supply to the industrial machine or the like when the protective door is opened.

Conventionally, the protective door or the like of the industrial machine is provided with the safety switch for the purpose of eliminating the risk of accident where a worker inadvertently gets caught in the machine and injured. The safety switch is designed to disable the machine when the protective door is not completely closed.

The safety switch of this type is electrically connected to the industrial machine such as robots and includes a switch body and an actuator. The switch body is fixed to the wall surface around the protective door while the actuator is fixed to the protective door. The actuator is fixed to such a position as to be opposed to an actuator inlet port of the switch body and to be inserted in a head case at an upper part of the switch body when the protective door is closed (see, for example, Japanese Examined Patent Publication No. 1999-502669 (Page 9, Page 10, FIG. 3, FIG. 6) and Japanese Unexamined Patent Publication No. 2003-31084 ([0035] to [0038] FIG. 4)).

A built-in switch under the head case (operation portion) of the switch body is switched on by the actuator inserted in the head case, so that the electric power is supplied to the industrial machine and the machine is actuated. When the actuator is extracted from the head case by opening the door, on the other hand, the built-in switch is switched off so that the power supply to the machine is interrupted.

The operation portion is centrally provided with a driving cam for moving a working rod of a switch portion located below the operation portion to thereby switch on and off the switch. The driving cam is rotatably supported with a rotary shaft thereof pivoted on an inside surface of a case member of the operation portion. The working rod is urged by a coil spring toward the operation portion or in a direction of movement to switch off the built-in switch.

In a state where the actuator is not inserted in the operation portion, the working rod is pressed down by the driving cam toward the switch portion and against the urging force of the coil spring. Hence, the built-in switch is set to an open position, disabling the power supply to the industrial machine. On the other hand, when the dedicated actuator is inserted in the operation portion, a connecting peg of the actuator presses the driving cam into rotation. Accordingly, the working rod is moved toward the driving cam by the urging force of the coil spring, switching the built-in switch to a closed position so that the electric power is supplied to the industrial machine.

Some of the above-described safety switches have a structure wherein the operation portion and the switch portion are detachably connected to each other. In the case where the operation portion and switch portion are adapted for detachable connection, a fear exists that an excessive impact on the safety switch may cause detachment of the operation portion from the switch portion. For example, in a state where the actuator is not inserted in the operation portion, or namely the working rod is pressed by the driving cam toward the switch portion and sets the switch of the switch portion to the open position, if the operation portion of the safety switch is detached from the switch portion, the working rod is released from the push toward the switch portion by the driving cam. Hence, the working rod is moved toward the operation portion by the urging force of the coil spring. Thus, the switch of the switch portion is switched on by the working rod moved toward the operation portion so that the electric power is supplied to the industrial machine although the actuator is not inserted in the operation portion. The safety switches of the Japanese Examined Patent Publication No. 1999-502669 (Page 9, Page 10, FIG. 3, FIG. 6) and Japanese Unexamined Patent Publication No. 2003-31084 ([0035] to [0038] FIG. 4) take the following measures as provisions against the occurrence of abnormality where the operation portion and the switch portion are detached from each other, whereby the detection of detachment of the operation portion from the switch portion is provided or malfunction caused by the detachment of the operation portion from the switch portion is obviated.

The safety switch disclosed in Japanese Examined Patent Publication No. 1999-502669 (Page 9, Page 10, FIG. 3, FIG. 6) includes a rotatable feeler member. The feeler member includes an engageable end which is removably engageable with the working rod. If the operation portion is detached from the switch portion, the feeler member is released from locking by the operation portion and is rotated by the urging force of the spring, bringing the engageable end thereof into engagement with the working rod and moving the working rod toward the switch portion. According to this arrangement, even if the operation portion is detached from the switch portion, the feeler member locked by the operation portion is released and rotated by the urging force of the spring, bringing the engageable end thereof into engagement with the working rod for moving the working rod toward the switch portion. Hence, the switch of the switch portion is maintained in the open position, disabling the power supply to the industrial machine or the like.

The safety switch disclosed in Japanese Unexamined Patent Publication No. 2003-31084 ([0035] to [0038] FIG. 4) includes a switch as displacement detection means which is switched off in a case where the operation portion is detached from the switch portion and released from the push toward the switch portion by the driving cam so that the working rod is excessively displaced toward the operation portion by the urging force of a spring. The switch as the displacement detection means is connected to an auxiliary power source and alarm separately provided outside of the safety switch such that the displacement detection means is capable of detecting that this switch is switched off because of the operation portion detached from the switch portion. According to the detection result, the safety switch can annunciate failure warning by switching off a power switch or actuating the alarm.

SUMMARY OF THE INVENTION

In the above-described safety switches, each time the operation of inserting the actuator from outside into the operation portion or the operation of extracting the actuator from the operation portion is repeated, the driving cam disposed in the operation portion is rotated while an outer periphery of the driving cam makes sliding contact with the working rod. Each time the outer periphery of the driving cam makes sliding contact with the working rod in this manner, a frictional force orthogonal to a longitudinal direction of the working rod arises between the outer periphery of the driving cam and the working rod. The frictional force repeatedly applied to the working rod and driving cam accumulates fatigue in the working rod and driving cam so that the working rod and/or driving cam may suffer wear-out failure. Furthermore, external load may cause break off failure of the working rod or breakage of the driving cam.

The breakage of the working rod or the driving cam eliminates the sliding contact between the working rod and the driving cam. Hence, the working rod pressed by the driving cam toward the switch portion is moved toward the driving cam by the urging force of the coil spring. Therefore, the built-in switch is switched on although the actuator is not inserted in the operation portion. In the event of such an abnormality, the safety switch of Japanese Examined Patent Publication No. 1999-502669 (Page 9, Page 10, FIG. 3, FIG. 6) has the following problem. The feeler member is not rotated unless the operation portion is detached from the switch portion. Therefore, the engageable end of the feeler member is not engaged with the working rod so that the working rod is moved toward the operation portion, enabling the power supply to the industrial machine or the like despite the abnormality of the safety switch. What is more, the structure employing the feeler member for moving the working rod toward the switch portion is complicated and hard to be downsized.

On the other hand, the safety switch of Japanese Unexamined Patent Publication No. 2003-31084 ([0035] to [0038] FIG. 4) can detect the occurrence of some abnormality therein because the switch as the displacement detection means is switched off when the working rod is excessively displaced toward the operation portion because of the abnormality. However, the switch for detecting the excessive displacement of the working rod must be provided independently from the switch for power supply to the industrial machine or the like. This makes it difficult to downsize the safety switch equipped with the switch as the displacement detection means.

In view of the above problems, the invention has an object to provide a safety switch that achieves safety improvement by setting the switch to the open position in the event of breakage of the working rod or breakage or dropout of the operation portion and that features a simple structure facilitating size reduction.

According to an aspect of the invention for achieving the above object, a safety switch comprises: an operation portion provided with an operable member operating according to an operation of inserting an actuator from outside and an operation of extracting the actuator; a switch portion provided with a first switch including a movable contact and a stationary contact; urging means for urging the movable contact away from the stationary contact; and a working rod that is interlocked with the operation of the operable member to be moved against an urging force of the urging means when the operable member is operated by the insertion operation, thus moving the movable contact into contact with the stationary contact and that is interlocked with the operation of the operable member to be moved by the urging force of the urging means when the operable member is operated by the extraction operation, thus separating the movable contact from the stationary contact by moving the movable contact in the opposite direction from the movement during the insertion operation, the safety switch further comprising a permission structure that permits, when broken, at least the movement of the working rod in an urging direction of the urging means.

According to the invention of this arrangement, the movable contact of the first switch in the switch portion is urged away from the stationary contact by the urging means, while the working rod is moved against the urging force of the urging means by the operable member operated by the operation of inserting the actuator in the operation portion. Thus, the working rod can move the movable contact into contact with the stationary contact for switching the first switch to the closed position. On the other hand, the operable member is operated by the operation of extracting the actuator from the operation portion, thereby allowing the working rod to be moved by the urging force of the urging means. Thus, the working rod separates the movable contact from the stationary contact by moving the movable contact in the opposite direction from the movement during the insertion operation, switching the first switch to the open position. The invention further comprises the permission structure that permits, when broken, at least the movement of the working rod in the urging direction of the urging means.

Even in the event of breakage of the working rod or breakage of the operation portion, the permission structure simultaneously breaks down with such failure thereby permitting the working rod to be moved in the urging direction of the urging means because the permission structure for permitting the movement of the working rod in the urging direction of the urging means is provided at a suitable place. The working rod is assuredly moved by the urging force of the urging means, ensuring that the movable contact can be moved away from the stationary contact, reliably setting the first switch to the open position. Thus, the safety switch can achieve safety improvement. Furthermore, it is unnecessary to provide the additional switch for detecting the movement of the working rod when the working rod is permitted to move in the urging direction of the urging means. Accordingly, the safety switch may have the simple structure facilitating the size reduction.

In this case, the permission structure may preferably have an arrangement wherein when the operating force of the extraction operation exceeds a breakage tolerance, the permission structure is broken to permit at least the movement of the working rod in the urging direction of the urging means.

By the way, there is a fear that the working rod may break off or the operation portion may be broken when the operating force of the operation of extracting the actuator from the operation portion exceeds a design strength as the breakage tolerance for the safety switch.

According to the above-described structure, however, the permission structure is provided that is broken to permit at least the movement of the working rod in the urging direction of the urging means when the operating force of the operation of extracting the actuator exceeds the breakage tolerance. If the movement of the working rod in the urging direction of the urging means is permitted by the breakage of the permission structure and hence the working rod is moved, the movable contact of the first switch is moved away from the stationary contact. Even if some external load associated with the operating force of the operation of extracting the actuator is exerted on the working rod to damage it, or even if some external load associated with the operating force of the operation of extracting the actuator is exerted on the operation portion to damage it, the permission structure for permitting the movement of the working rod in the urging direction of the urging means is broken by the operating force of the operation of extracting the actuator that exceeds the breakage tolerance. Hence, the working rod is moved by the urging force of the urging means, assuredly moving the movable contact away from the stationary contact so that the first switch is set to the open position.

In another aspect of the invention, the safety switch may have an arrangement wherein the operable member is a driving cam rotatable in both directions according to the insertion operation and the extraction operation, and wherein the working rod is interlocked with the rotation of the driving cam to be moved against the urging force of the urging means when the driving cam is rotated by the insertion operation, thus moving the movable contact into contact with the stationary contact, or to be moved by the urging force of the urging means when the driving cam is rotated by the extraction operation, thus separating the movable contact from the stationary contact by moving the movable contact in the opposite direction from the movement during the insertion operation.

According to this arrangement, the working rod is moved against the urging force of the urging means by the rotation of the driving cam operated by the operation of inserting the actuator in the operation portion, thereby moving the movable contact into contact with the stationary contact. Thus, the first switch is switched to the closed position. Further, the working rod is moved by the urging force of the urging means in conjunction with the rotation of the driving cam operated by the operation of extracting the actuator from the operation portion, thereby separating the movable contact from the stationary contact by moving the movable contact in the opposite direction from the movement during the operation of inserting the actuator in the operation portion. Thus, the first switch is switched to the open position.

Even in the event of the breakage of the working rod or the breakage or dropout of the operation portion, the permission structure for permitting the movement of the working rod in the urging direction of the urging means is broken simultaneously with such failure, thereby permitting the working rod to move in the urging direction of the urging means. The working rod is assuredly moved by the urging force of the urging means, so that the movable contact can be moved away from the stationary contact, assuredly setting the first switch to the open position. Thus, the safety switch can achieve the safety improvement.

In other aspects of the invention, the safety switch may have an arrangement wherein the permission structure is implemented in a support portion for supporting the driving cam, wherein the permission structure is implemented in a rotary shaft of the driving cam or wherein the switch portion is formed connectable with the operation portion and the permission structure is implemented in a connecting portion between the operation portion and the switch portion.

According to these arrangements, if the operating force of the operation or the number of operations of extracting the actuator from the operation portion exceeds the breakage tolerance, if some external load is exerted on the working rod to damage it, or if some external load is exerted on the operation portion to damage it, the permission structure implemented in the support portion for the driving cam, the rotary shaft of the driving cam, or the connecting portion between the operation portion and the switch portion is simultaneously broken. Accordingly, the driving cam is displaced from a normal design position relative to the switch portion in order to permit the movement of the working rod in the urging direction of the urging means. This permits the working rod to be assuredly moved by the urging force of the urging means so that the movable contact can be moved away from the stationary contact, reliably setting the first switch to the open position.

In another aspect of the invention, the safety switch may have an arrangement wherein the operation portion is further provided with lock means that includes a locking member for inhibiting the rotation of the driving cam, and that inhibits the extraction operation by inhibiting the rotation of the driving cam by operating the locking member when the actuator is inserted in the operation portion.

According to this arrangement, the operation of extracting the actuator from the operation portion can be prevented by the lock means inhibiting the rotation of the driving cam. At this time, even if an operation of forcibly extracting the actuator from the operation portion is performed so that the operating force of the operation or the number of operations of extracting the actuator from the operation portion exceeds the breakage tolerance to cause the breakage of the working rod or the breakage or dropout of the operation portion, the working rod is reliably moved by the urging force of the urging means because the permission structure is simultaneously broken to permit the movement of the working rod in the urging direction of the urging means. This ensures that the movable contact can be moved away from the stationary contact, assuredly setting the first switch to the open position.

In another aspect of the invention, the safety switch may further comprise a second switch switched between a closed position and an open position according to the lock means switching the driving cam between a rotation inhibition position and a rotation permission position.

According to this arrangement, even if the operation of forcibly extracting the actuator from the operation portion is performed with the rotation of the driving cam inhibited by the lock mechanism, the breakdown of the permission structure for permitting the movement of the working rod in the urging direction of the urging means provides permission for the working rod to be moved by the urging force of the urging means. Hence, the movable contact can be moved away from the stationary contact, setting the first switch to the open position. However, the second switch is not changed in the open/closed position because the driving cam locked at the rotation inhibition position by the lock means is not shifted to the rotation permission position. Therefore, the occurrence of some abnormality in the safety switch can be reliably detected by determining that only the first switch is changed in the open/closed position while the second switch stays unchanged in the open/closed position.

In another aspect of the invention, the permission structure may be implemented in the driving cam.

According to this arrangement, even if the operation of forcibly extracting the actuator from the operation portion is performed with the rotation of the driving cam inhibited by the lock mechanism, the first switch can be reliably switched to the open position. Namely, the operating force of the operation of extracting the actuator from the operation portion exceeds the breakage tolerance to destroy the driving cam. Hence, the driving cam and the working rod are released from the interlocking relation, so that the working rod is permitted to move in the urging direction of the urging means. The working rod is assuredly moved by the urging force of the urging means so that the movable contact can be moved away from the stationary contact, reliably setting the first switch to the open position.

In another aspect of the invention, the permission structure may be implemented in the locking member.

According to this arrangement, even if the operation of forcibly extracting the actuator from the operation portion is performed with the rotation of the driving cam inhibited by the lock mechanism, the first switch can be assuredly switched to the open position. Namely, the operating force of the operation of extracting the actuator from the operation portion exceeds the breakage tolerance to destroy the locking member of the lock means. Hence, the driving cam is released from the rotation inhibition by the lock means and is rotated whereby the movement of the working rod in the urging direction of the urging means is permitted. The working rod is assuredly moved by the urging force of the urging means so that the movable contact can be moved away from the stationary contact, reliably setting the first switch to the open position.

In another aspect of the invention, the safety switch may have an arrangement wherein the operation portion is further provided with an auxiliary rod including an engageable portion and connected to the working rod and wherein the auxiliary rod engages with the actuator at the engageable portion thereof when the rotation of the driving cam is inhibited by the lock means.

According to this arrangement, when the operation of forcibly extracting the actuator from the operation portion is performed with the rotation of the driving cam inhibited by the lock means so that the operating force of the operation or the number of operations of extracting the actuator from the operation portion exceeds the breakage tolerance to cause the breakage of the working rod or the breakage or dropout of the operation portion, the permission structure for permitting the movement of the working rod in the urging direction of the urging means is broken simultaneously. If, at this time, the rotation of the driving cam is inhibited by the lock means, the force of extracting the actuator is transmitted to the working rod via the auxiliary rod because the engageable portion of the auxiliary rod connected to the working rod is engaged with the actuator. Even if the both contacts are fused, therefore, the working rod is assuredly moved by the urging force of the urging means combined with the force of extracting the actuator. This ensures that the movable contact can be moved away from the stationary contact, reliably setting the first switch to the open position.

In another aspect of the invention, the safety switch may further comprise connecting means for connecting the working rod to the driving cam in a manner to interlock the working rod with the rotation of the driving cam, and may have an arrangement wherein the driving cam is formed with a guide portion having a cam curve shape and including a large diameter portion and a small diameter portion, and wherein, as moved along the guide portion from the large diameter portion to the small diameter portion during the rotation of the driving cam operated by the extraction operation, the connecting means works along with the urging force of the urging means to move the working rod for switching the first switch to the open position.

According to this arrangement, the working rod is connected to the driving cam by the connecting means and hence, the first switch of the switch portion can be reliably switched between the open and closed positions by reciprocating the working rod by means of the driving cam rotated in either direction in conjunction with the operation of inserting the actuator or the operation of extracting the actuator. While the driving cam is rotated by the operation of extracting the actuator from the operation portion, a pull-out force of extracting the working rod from the switch portion is imparted by the connecting means moved along the guide portion from the large diameter portion to the small diameter portion. This pull-out force is added to the urging force of the urging means. The combined force assuredly moves the working rod. Even if the both contacts are fused, for example, the movable contact can be assuredly moved away from the stationary contact, setting the first switch to the open position.

In another aspect of the invention, the permission structure may be implemented in the connecting means.

According to this arrangement, if the operating force of the operation or the number of operations of extracting the actuator from the operation portion exceeds the breakage tolerance, if some external load is exerted on the working rod to cause the breakage thereof or if some external load is exerted on the operation portion to cause the breakage thereof, the permission structure implemented in the connecting means is broken simultaneously. Therefore, the connection between the driving cam and the working rod is lost and hence, the working rod is released from the interlocked relation with the driving cam and is permitted to move in the urging direction of the urging means. Hence, the working rod is assuredly moved by the urging force of the urging means, ensuring that the movable contact can be moved away from the stationary contact, reliably setting the first switch to the open position.

In another aspect of the invention, the safety switch may further comprise an auxiliary cam rotatable in both directions according to the insertion operation and the extraction operation, and may have an arrangement wherein in the event of an abnormality where the driving cam does not rotate at the time of the extraction operation, the auxiliary cam rotates in conjunction with the extraction operation and destroys the connecting means as driven by a rotative force derived from the extraction operation.

According to this arrangement, when some abnormality where the driving cam does not rotate at the time of the extraction operation occurs because the operating force of the operation or the number of operations of extracting the actuator from the operation portion exceeds the breakage tolerance, because some external load is exerted on the working rod to cause the breakage thereof or because some external load is exerted on the operation portion to cause the breakage or dropout thereof, the auxiliary cam rotates in conjunction with the extraction operation and destroys the connecting means as driven by the rotative force derived from the extraction operation. The connection between the driving cam and the working rod is lost and hence, the working rod is permitted to move in the urging direction of the urging means. Therefore, the working rod is assuredly moved by the urging force of the urging means, ensuring that the movable contact can be moved away from the stationary contact, reliably setting the first switch to the open position.

In another aspect of the invention, the permission structure may include means that inhibits, when broken, the movable contact from being brought into contact with the stationary contact by the working rod moved by the operable member operated by the insertion operation.

According to this arrangement, when the permission structure for permitting the movement of the working rod in the urging direction of the urging means is broken, the movable contact is inhibited from being brought into contact with the stationary contact by the working rod moved by the operable member operated by the operation of inserting the actuator. Therefore, the first switch is assuredly prevented from being switched to the closed position when the operation of inserting the actuator is performed in spite of the occurrence of some abnormality in the safety switch.

In another aspect of the invention, the permission structure may be broken to permit at least the movement of the working rod in the urging direction of the urging means when the number of extraction operations exceeds a breakage tolerance.

In another aspect of the invention, a safety switch comprises: an operation portion provided with a driving cam that is rotatable in both directions according to an operation of inserting an actuator from outside and an operation of extracting the actuator and that is formed with a guide portion having a cam curve shape and including a large diameter portion and a small diameter portion; a switch portion provided with a first switch including a movable contact and a stationary contact; a working rod reciprocating between the operation portion and the switch portion in conjunction with the rotation of the driving cam; and connecting means for connecting the working rod to the driving cam in a manner to interlock the working rod with the rotation of the driving cam, the working rod operating in conjunction with the connecting means moved along the guide portion from the small diameter portion to the large diameter portion during the rotation of the driving cam operated by the insertion operation, thus moving the movable contact into contact with the stationary contact, the working rod operating in conjunction with the connecting means moved along the guide portion from the large diameter portion to the small diameter portion during the rotation of the driving cam operated by the extraction operation, thus separating the movable contact from the stationary contact by moving the movable contact in the opposite direction from the movement during the insertion operation, the safety switch further comprising a permission structure that permits, when broken, at least the movement of the working rod in the direction of the movement thereof during the extraction operation.

In another aspect of the invention, a safety switch comprises: an operation portion provided with a driving cam that is rotatable in both directions according to an operation of inserting an actuator from outside and an operation of extracting the actuator and that is formed with a guide portion having a cam curve shape and including a large diameter portion and a small diameter portion; a switch portion provided with a first switch including a movable contact and a stationary contact; a working rod reciprocating between the operation portion and the switch portion in conjunction with the rotation of the driving cam; and connecting means for connecting the working rod to the driving cam in a manner to interlock the working rod with the rotation of the driving cam, the working rod operating in conjunction with the connecting means moved along the guide portion from the small diameter portion to the large diameter portion during the rotation of the driving cam operated by the insertion operation, thus moving the movable contact into contact with the stationary contact, the working rod operating in conjunction with the connecting means moved along the guide portion from the large diameter portion to the small diameter portion during the rotation of the driving cam operated by the extraction operation, thus separating the movable contact from the stationary contact by moving the movable contact in the opposite direction from the movement during the insertion operation, the safety switch further comprising a permission structure that permits, when broken, at least the movement of the working rod in the direction of the movement thereof during the extraction operation (Claim 17).

According to the invention of this arrangement, the working rod is interlocked with the connecting means moved along the guide portion from the small diameter portion to the large diameter portion as driven by the driving cam rotated by the operation of inserting the actuator in the operation portion. Namely, the working rod is pushed down into the switch portion while moving the movable contact into contact with the stationary contact, thereby switching the first switch to the closed position. Further, the working rod is interlocked with the connecting means moved along the guide portion from the large diameter portion to the small diameter portion as driven by the driving cam rotated by the operation of extracting the actuator from the operation portion. Namely, the working rod is moved in a direction to be extracted from the switch portion while separating the movable contact from the stationary contact by moving the movable contact in the opposite direction from the movement during the operation of inserting the actuator into the operation portion. Thus, the first switch is switched to the open position. The safety switch further comprises the permission structure that permits, when broken, at least the movement of the working rod in the direction of the movement thereof during the extraction operation.

Even in the event of the breakage of the working rod or the breakage or dropout of the operation portion, the permission structure is activated to permit the working rod to be moved in the direction of movement during the extraction operation, namely in the direction to be extracted from the switch portion. Hence, the working rod connected to the driving cam is reliably moved by the force of extracting the actuator from the operation portion so that the movable contact can be moved away from the stationary contact, assuredly setting the first switch to the open position. Thus, the safety switch can achieve the safety improvement. Furthermore, the safety switch may have the simple structure facilitating the size reduction thereof because it is unnecessary to provide an additional switch for detecting the movement of the working rod when the working rod is permitted to move in the direction to be extracted from the switch portion.

According to the invention, even in the event of the breakage of the working rod or the breakage of the operation portion, the movement of the working rod in the urging direction of the urging means is permitted by the breakage of the permission structure for permitting the working rod to be moved in the urging direction of the urging means. Hence, the working rod is assuredly moved by the urging force of the urging means so that the movable contact can be moved away from the stationary contact, reliably setting the first switch to the open position. The safety switch can achieve the safety improvement. Furthermore, the safety switch may have the simple structure facilitating the size reduction thereof because it is unnecessary to provide the additional switch for detecting the movement of the working rod when the working rod is permitted to move in the urging direction of the urging means.

According to another aspect of the invention, the safety switch is provided with the permission structure that is broken to permit at least the movement of the working rod in the urging direction of the urging means when the operating force of the operation of extracting the actuator exceeds the breakage tolerance. If the working rod is permitted to move in the urging direction of the urging means and thence is moved, the movable contact of the first switch is moved away from the stationary contact. Even if the operating force of the extraction operation exceeds the breakage tolerance to cause the breakage of the working rod or the operation portion, the permission structure is simultaneously broken to permit the working rod to be moved by the urging force of the urging means. The movable contact can be assuredly moved away from the stationary contact, setting the first switch to the open position.

According to yet another aspect of the invention, even in the event of the breakage of the working rod or the breakage or dropout of the operation portion, the permission structure for permitting the movement of the working rod in the urging direction of the urging means is broken simultaneously with such failure, thereby permitting the working rod to move in the urging direction of the urging means. The working rod is assuredly moved by the urging force of the urging means so that the movable contact can be moved away from the stationary contact, reliably setting the first switch to the open position. The safety switch can achieve the safety improvement.

According to other aspects of the invention, if the operating force of the operation or the number of operations of extracting the actuator from the operation portion exceeds the breakage tolerance or such, the permission structure implemented in the support portion for the driving cam, the rotary shaft of the driving cam or the connecting portion between the operation portion and the switch portion is broken. Accordingly, the driving cam is displaced from the normal design position relative to the switch portion in order to permit the movement of the working rod in the urging direction of the urging means. This permits the working rod to be assuredly moved by the urging force of the urging mean so that the movable contact can be moved away from the stationary contact, reliably setting the first switch to the open position.

According to another aspect of the invention, the operation of extracting the actuator from the operation portion can be prevented by the lock means inhibiting the rotation of the driving cam. At this time, even if the operation of forcibly extracting the actuator is performed so that the operating force of the operation or the number of operations of extracting the actuator from the operation portion exceeds the breakage tolerance to cause the breakage of the working rod or the breakage or dropout of the operation portion, the working rod is reliably moved by the urging force of the urging means because the permission structure is simultaneously broken to permit the movement of the working rod in the urging direction of the urging means. This ensures that the movable contact can be moved away from the stationary contact, reliably setting the first switch to the open position.

According to yet another aspect of the invention, even if the operation of forcibly extracting the actuator is performed when the rotation of the driving cam is inhibited by the lock mechanism, the breakdown of the permission structure for permitting the movement of the working rod in the urging direction of the urging means provides permission for the working rod to be moved by the urging force of the urging means. Hence, the movable contact can be moved away from the stationary contact, setting the first switch to the open position. However, the second switch is not changed in the open/closed position because the driving cam locked at the rotation inhibition position by the lock means is not shifted to the rotation permission position. Therefore, the occurrence of some abnormality in the safety switch can be reliably detected by determining that only the first switch is changed in the open/closed position while the second switch stays unchanged in the open/closed position.

According to another aspect of the invention, even if the operation of forcibly extracting the actuator is performed with the rotation of the driving cam inhibited by the lock mechanism, the first switch can be reliably switched to the open position. Namely, the operating force of the operation of extracting the actuator from the operation portion exceeds the breakage tolerance to destroy the driving cam. Hence, the driving cam and the working rod are released from the interlocking relation so that the working rod is permitted to move in the urging direction of the urging means. The working rod is assuredly moved by the urging force of the urging means and hence, the movable contact can be moved away from the stationary contact, reliably setting the first switch to the open position.

According to another aspect of the invention, even if the operation of forcibly extracting the actuator from the operation portion is performed with the rotation of the driving cam inhibited by the lock mechanism, the first switch can be assuredly switched to the open position. Namely, the operating force of the operation of extracting the actuator from the operation portion exceeds the breakage tolerance to destroy the locking member of the lock means. Hence, the driving cam is released from the rotation inhibition by the lock means and is rotated whereby the working rod is permitted to move in the urging direction of the urging means. The working rod is assuredly moved by the urging force of the urging means so that the movable contact can be moved away from the stationary contact, reliably setting the first switch to the open position.

According to another aspect of the invention, when the operation of forcibly extracting the actuator from the operation portion is performed with the rotation of the driving cam inhibited by the lock means so that the operating force of the operation or the number of operations of extracting the actuator exceeds the breakage tolerance to cause the breakage of the working rod or the breakage or dropout of the operation portion, the permission structure for permitting the movement of the working rod in the urging direction of the urging means is broken simultaneously. However, the force of extracting the actuator is transmitted to the working rod via the auxiliary rod because the rotation of the driving cam is inhibited by the lock means while the engageable portion of the auxiliary rod connected to the working rod is engaged with the actuator. Even if the both contacts are fused, therefore, the working rod is assuredly moved by the urging force of the urging means combined with the force of extracting the actuator. This ensures that the movable contact can be moved away from the stationary contact, reliably setting the first switch to the open position.

According to yet another aspect of the invention, the working rod is connected to the driving cam by the connecting means and hence, the first switch of the switch portion can be reliably switched between the open and closed positions by reciprocating the working rod by means of the driving cam rotated in either direction in conjunction with the operation of inserting the actuator or the operation of extracting the actuator. While the driving cam is rotated by the operation of extracting the actuator from the operation portion, the pull-out force of extracting the working rod from the switch portion is imparted by the connecting means moved along the guide portion from the large diameter portion to the small diameter portion. This pull-out force is added to the urging force of the urging means. The combined force assuredly moves the working rod. Even if the both contacts are fused, for example, the movable contact can be assuredly moved away from the stationary contact, setting the first switch to the open position.

According to another aspect of the invention, when the operating force of the operation or the number of operations of extracting the actuator from the operation portion exceeds the breakage tolerance, when some external load is exerted on the working rod to cause the breakage thereof or when some external load is exerted on the operation portion to cause the breakage thereof, the permission structure implemented in the connecting means is broken simultaneously. Therefore, the connection between the driving cam and the working rod is lost and hence, the working rod is released from the interlocked relation with the driving cam and is permitted to move in the urging direction of the urging means. The working rod is assuredly moved by the urging force of the urging means, ensuring that the movable contact can be moved away from the stationary contact, reliably setting the first switch to the open position.

According to yet another aspect of the invention, when some abnormality where the driving cam does not rotate at the time of the extraction operation occurs because the operating force of the operation or the number of operations of extracting the actuator from the operation portion exceeds the breakage tolerance, because some external load is exerted on the working rod to cause the breakage thereof or because some external load is exerted on the operation portion to cause the breakage or dropout thereof, the auxiliary cam rotates in conjunction with the extraction operation and destroys the connecting means as driven by the rotative force derived from the extraction operation. The connection between the driving cam and the working rod is lost and hence, the working rod is permitted to move in the urging direction of the urging means. The working rod is assuredly moved by the urging force of the urging means, ensuring that the movable contact can be moved away from the stationary contact, reliably setting the first switch to the open position.

According to another aspect of the invention, when the permission structure for permitting the movement of the working rod in the urging direction of the urging means is broken, the movable contact is inhibited from being brought into contact with the stationary contact by the working rod moved by the operable member operated by the operation of inserting the actuator. This ensures that the first switch is prevented from being switched to the closed position when the operation of inserting the actuator is performed in spite of the occurrence of some abnormality in the safety switch.

According to yet another aspect of the invention, if the number of operations of extracting the actuator from the operation portion exceeds a design durability as the breakage tolerance for the safety switch so that the repeatedly exerted frictional force causes the bending or breaking failure of the working rod, or the breakage of the operable member such as the driving cam of the operation portion, the movement of the working rod in the urging direction of the urging means is permitted by the breakage of the permission structure. Hence, the working rod is moved so that the movable contact of the first switch is moved away from the stationary contact, reliably setting the first switch to the open position.

According to another aspect of the invention, even in the event of the breakage of the working rod or the breakage or dropout of the operation portion, the permission structure is simultaneously broken for permitting the working rod to be moved in the direction of the movement during the extraction operation, namely in the direction in which the working rod is extracted from the switch portion. Accordingly, the working rod connected to the driving cam is assuredly moved by the force of extracting the actuator from the operation portion so that the movable contact can be moved away from the stationary contact, reliably setting the first switch to the open position. Hence, the safety switch can achieve the safety improvement. Furthermore, the safety switch may have the simple structure facilitating the size reduction thereof because it is unnecessary to provide the additional switch for detecting the movement of the working rod when the working rod is permitted to move in the urging direction of the urging means.

BEST MODES FOR CARRYING OUT THE INVENTION

First Embodiment

A first embodiment of the invention is described with reference to FIG. 1 to FIG. 4. FIG. 1 to FIG. 4 are sectional views of a switch body 1 as seen from the front, each showing the switch body in a different state. A safety switch according to the invention is electrically connected to an industrial machine, as an external apparatus, such as a robot via a cable and includes the switch body 1 and an actuator 3.

The switch body 1 includes an operation portion 5 and a switch portion 7 and is fixed to a wall surface around a protective door of the industrial machine (not shown). On the other hand, the actuator 3 is fixed to the protective door and is located at a position opposite to one of actuator inlet ports 9*a*, 9*b* formed in an upper side and a lateral side of the operation portion 5. The actuator 3 is inserted into the actuator inlet port 9*a*, 9*b* of the operation portion 5 by closing the protective door or an operation of inserting the actuator 3. The actuator 3 includes a U-shaped base 3*a* and a connecting peg 3*b* formed integrally with the base 3*a* and bridging opposite sides of a portion distal to the base 3*a*.

Figure 1:
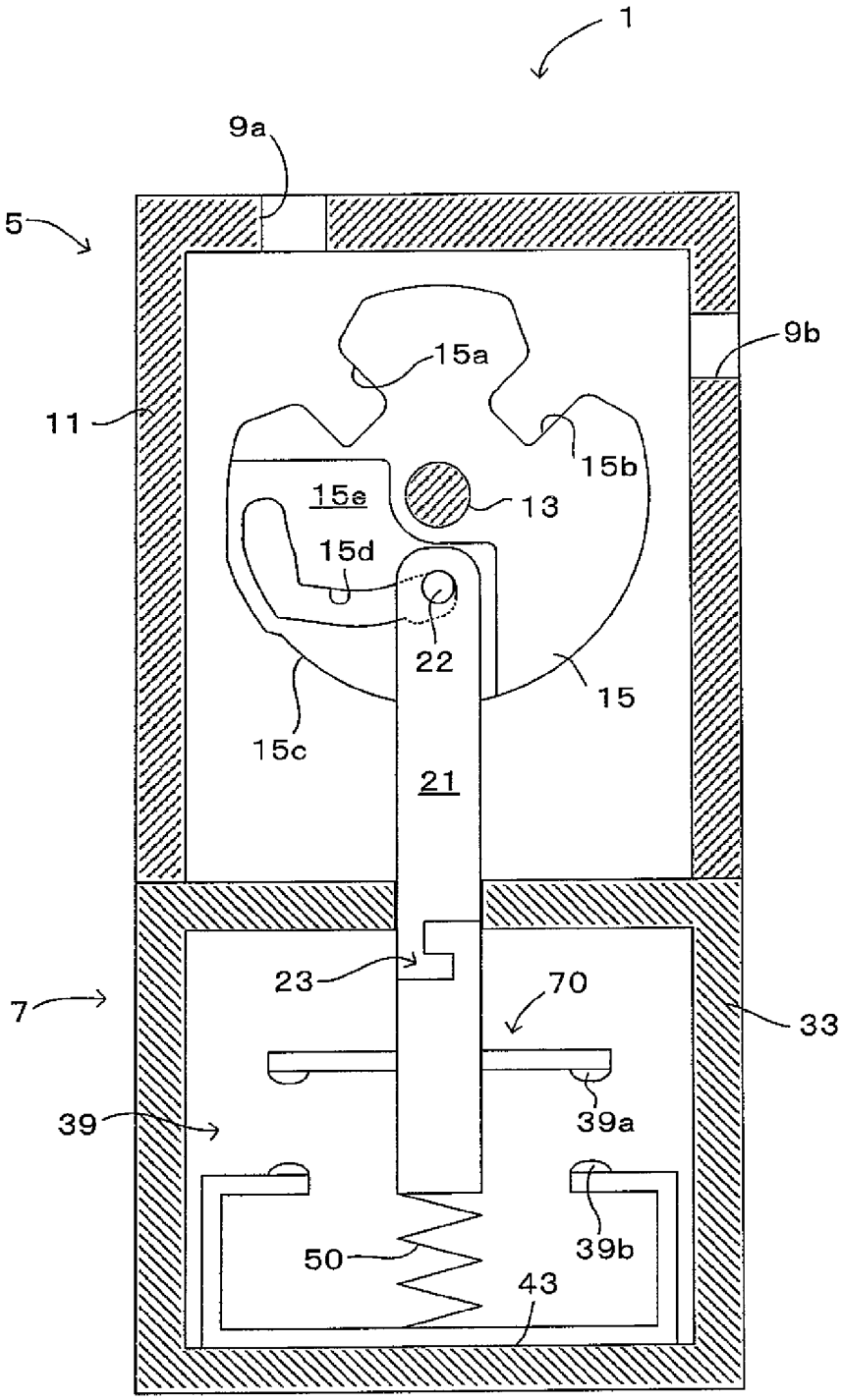
FIG. 1 is a sectional view showing a switch body according to a first embodiment of the invention.
Figure 2:
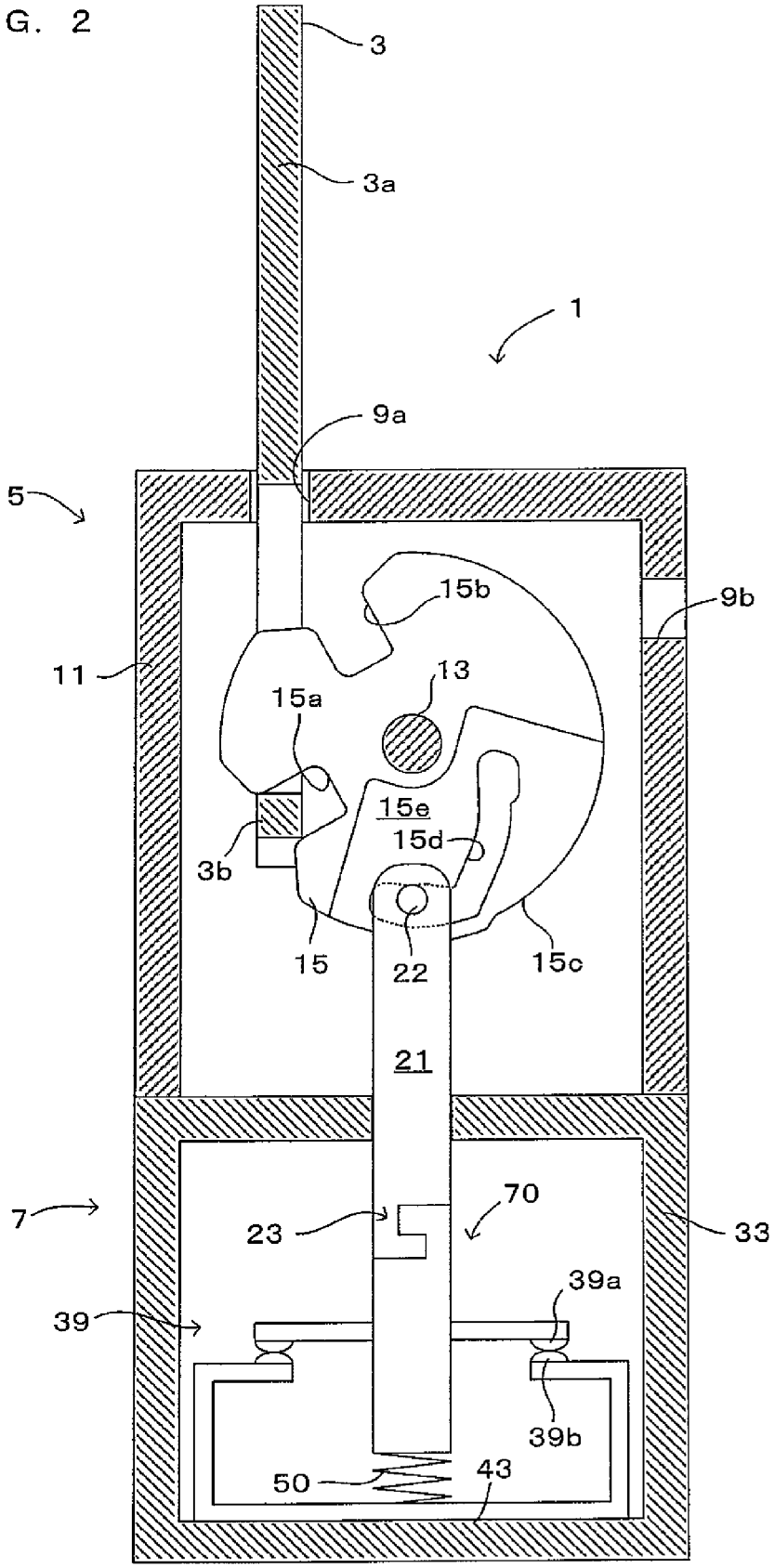
FIG. 2 is a sectional view showing the switch body according to the first embodiment of the invention.

As shown in FIG. 1 and FIG. 2, the operation portion 5 disposed at an upper part of the switch body 1 includes a case member 11, and a driving cam 15 having a rotary shaft 13 supported on an inside surface of the case member 11 so as to be rotatable in both directions according to an operation of inserting the actuator 3 in the operation portion 5 and an operation of extracting the actuator from the operation portion 5. An upper part of the driving cam 15 is formed with engaging portions 15*a*, 15*b* in an outer periphery thereof. The engaging portions 15*a*, 15*b* are located at positions accessible from the actuator inlet ports 9*a*, 8*b* such as to permit fitting insertion of the connecting peg 3*b* of the actuator 3. A lower part of the driving cam 15 is formed with a cam curve portion 15*c* on an outer periphery thereof. The lower part of the driving cam is laterally formed with a guide slot 15*d* (equivalent to a "guide portion" of the invention), which has a cam curve shape and includes a large diameter portion and a small diameter portion. The driving cam 15 is formed with a cutaway 15*e* on an area where the guide slot 15*d* is formed, the cutaway extending from the outer periphery of the driving cam 15 toward the rotary shaft 13. A distal end of a working rod 21 (described hereinlater) is inserted in the cutaway 15*e*. It is noted that the driving cam 15 shown in the sectional view of FIG. 1 includes a partial sectional view showing a cross-section of the cutaway 15*e* and all the sectional views of the driving cam 15 that are referred to in the following description similarly include the partial cross-section of the cutaway, respectively, the description of which is dispensed with.

Disposed in the switch portion 7 below the operation portion 5 is the working rod 21, a distal end portion of which retractably projects into the operation portion 5. A cam pin 22 (equivalent to "connecting means" of the invention) is orthogonally fixed to the distal end of the working rod. The cam pin 22 has each of the opposite ends thereof inserted through the guide slot 15*d* of the driving cam 15 so as to bring the working rod 21 into reciprocal movement in conjunction with the rotation of the driving cam 15. The cam pin 22 is moved along the guide slot 15*d* in conjunction with the rotation of the driving cam 15 thereby reciprocally moving the working rod 21 into or out of the operation portion 5 so that a first switch 39 of a built-in switching device 70 in the switch portion 7 is switched between open and closed positions.

The working rod 21 is formed with connecting engagement portions 23 which are adapted to engageably divide the working rod 21 into an upper part (the operation portion 5) and a lower part (the switch portion 7). Therefore, the switch body 1 can be easily assembled by taking the steps of discretely fabricating the operation portion 5 having the upper part of the divided working rod 21 connected to the driving cam 15 and the switch portion 7 provided with the lower part of the divided working rod 21, and assembling the operation portion 5 with the switch portion 7 by connecting the working rod parts 21 into one piece by way of engagement between the connecting engagement portions 23 of the working rod 21. If the switch portion 7 suffers a damage requiring the replacement thereof, the switch body 1 can be easily restored by merely replacing only the switch portion 7.

Next, the switch portion 7 is described. As shown in FIG. 1, a case member 33 formed connectable with the case member 11 is combined with the case member 11 to form the whole body of the switch body 1 having a rectangular cuboid shape. The switch portion 7 is disposed below the operation portion 5. The switch portion 7 includes the switching device 70 incorporating the first switch 39, and the above-described working rod 21. The case member 11 of the operation portion 5 is assembled to the case member 33 by way of, for example, a screw inserted through a through-hole in a peripheral wall of the case member 11 in a direction of insertion of the actuator 3 through the actuator inlet port 9*a* and threadably engaged with a female screw hole in the case member 33. Alternatively, the case member 11 of the operation portion 5 may be locked to the case member 33 by way of a locking structure consisting of a locking claw and a locked portion.

By the way, the switching device 70 includes the first switch 39 switched on and off in conjunction with the reciprocal movement of the working rod 21. The first switch 39 includes a movable contact 39*a* and a stationary contact 39*b*. The movable contact 39*a* is downwardly fixed to the working rod 21 in a manner to be integrally movable with the working rod 21. The stationary contact 39*b* is upwardly fixed to a frame member 43 disposed in the switching device 70. The first switch 39 is for enabling or disabling power supply to the industrial machine. The electric power is supplied to the industrial machine by setting the first switch 39 to the closed position.

As shown in FIG. 1, a coil spring 50 is installed between a lower end of the working rod 21 and the frame member 43 whereby the working rod 21 is urged upward or toward the operation portion 5. By urging the working rod 21 upward, the coil spring 50 urges the movable contact 39*a* of the first switch 39 in a direction in which the movable contact moves away from the stationary contact 39*b* (open direction). Thus, the coil spring 50 according to the embodiment functions as "urging means" of the invention.

The cable (not shown) electrically connected to the industrial machine is attached to the case member 33 so that the cable and the first switch 39 are electrically interconnected in the switching device 70. The power supply to the industrial machine is enabled or disabled by an electric signal induced by switching on or off the first switch 39.

In the state of FIG. 1 where the actuator 3 is not inserted in the operation portion 5, the cam pin 22 has been moved along the guide slot 15*d* from the large diameter portion to the small diameter portion while the working rod 21 is moved to the operation portion 5 by the urging force of the coil spring 50. As the working rod 21 is moved to the operation portion 5, the movable contact 39*a* is also moved away from the stationary contact 39*b*. The movable contact 39*a* and the stationary contact 39*b* of the first switch 39 are spaced apart so that the first switch 39 is set to the open position, disabling the power supply to the industrial machine. Thus the industrial machine is deactivated.

Next, an operation of the switch body 1 having the above-described structure is described with reference to FIG. 1 and FIG. 2. In a case where the actuator 3 is not inserted in the operation portion 5 of the switch body 1, as shown in FIG. 1, the working rod 21 is moved to the operation portion 5 by the urging force of the coil spring 50 so that the first switch 39 is set to the open position. Hence, the power supply to the industrial machine is disabled so that the industrial machine is deactivated.

Subsequently when the operation of inserting the actuator 3 by closing the protective door is performed to insert the actuator 3 through the actuator inlet port 9*a*, for example, in the operation portion 5 in an initial state shown in FIG. 1, the connecting peg 3*b* of the actuator 3 is engaged with the engaging portion 15*a* of the driving cam 15, as shown in FIG. 2. As the actuator 3 is inserted further, the driving cam 15 is rotated counter-clockwise. In conjunction with the rotation of the driving cam 15, the cam pin 22 is moved downward along the guide slot 15*d* against the urging force of the coil spring 50.

The downward movement of the cam pin 22 pushes down the working rod 21 into the switch portion 7 against the urging force of the coil spring 50. As the working rod 21 is moved further down, the movable contact 39*a* is moved into contact with the stationary contact 39*b*, switching the first switch 39 from the open position to the closed position. Thus, the first switch 39 is set to the closed position so that the electric power is supplied to the industrial machine such as the robot connected in series with the first switch 39. Hence, the industrial machine is actuated.

When, on the other hand, the inserted actuator 3 shown in FIG. 1 is extracted by the operation of extracting the actuator 3 by opening the protective door, for example, the driving cam 15 is rotated in a direction of extraction of the actuator 3 till the connecting peg 3*b* of the actuator 3 is disengaged from the engaging portion 15*a* of the driving cam 15. In conjunction with the rotation of the driving cam 15, the cam pin 22 is moved upward along the guide slot 15*d* from the large diameter portion to the small diameter portion. The upward movement of the cam pin 22 moves the working rod 21 in a direction to extract the working rod from the switch portion 7.

The urging force of the coil spring 50 is combined with a pull-out force which derives from the rotation of the driving cam 15 and works to extract the working rod 21 from the switch portion 7. The combined force moves the working rod 21 in the opposite direction from the movement of the working rod 21 during the operation of inserting the actuator 3. Namely, the working rod 21 is extracted from the switch portion 7 and moved to the operation portion 5. Hence, the movable contact 39*a* is moved away from the stationary contact 39*b* to set the first switch 39 to the open position so that the industrial machine is deactivated.

By the way, the switch body 1 shown in FIG. 1 and FIG. 2 has potential risk of suffering break off failure of the working rod 21 and breakage or dropout of the operation portion 5 when an operating force of the operation of extracting the actuator 3 from the operation portion 5 exceeds a design strength as a breakage tolerance for the switch body 1. Furthermore, there is a fear of damage on the switch body 1 caused by some external force exerted by some packing box (being carried) colliding against the switch body 1 or by impact of the actuator 3 with the operation portion 5 during an unsuccessful operation of closing the protective door, the actuator 3 failing to be smoothly inserted in the operation portion 5 through the actuator inlet port 9*a*, 9*b*.

There is also a fear that if the number of operations of extracting the actuator 3 from the operation portion 5 exceeds a design durability as the breakage tolerance for the switch body 1, a repeatedly exerted frictional force may cause bending failure or break off failure of the working rod 21, breakage of the driving cam 15 of the operation portion 5, or wear-out failure of a connecting portion between the working rod 21 and the driving cam 15 or of the rotary shaft 13.

In this connection, the switch body 1 according to the embodiment is provided with a permission structure which breaks down for permitting at least the movement of the working rod 21 in the urging direction of the coil spring 50 when at least the operating force of the operation or the number of operations of extracting the actuator 3 exceeds the breakage tolerance for the switch body 1. If the working rod 21 is permitted to move in the urging direction of the coil spring 50 and thence is moved to the operation portion 5, the movable contact 39*a* of the first switch 39 is moved away from the stationary contact 39*b*, as described above. Accordingly, even if some external load is exerted on the working rod 21 to cause the breakage thereof or if some external load is exerted on the operation portion 5 to cause the breakage or dropout thereof, the movable contact 39*a* is assuredly moved away from the stationary contact 39*b* by the urging force of the coil spring 50, setting the first switch 39 to the open position. Now referring to FIG. 3 and FIG. 4, description is made on specific permission structures that permit the working rod 21 to be moved in the urging direction of the coil spring 50.

(1) First Exemplary Operation

Figure 3:
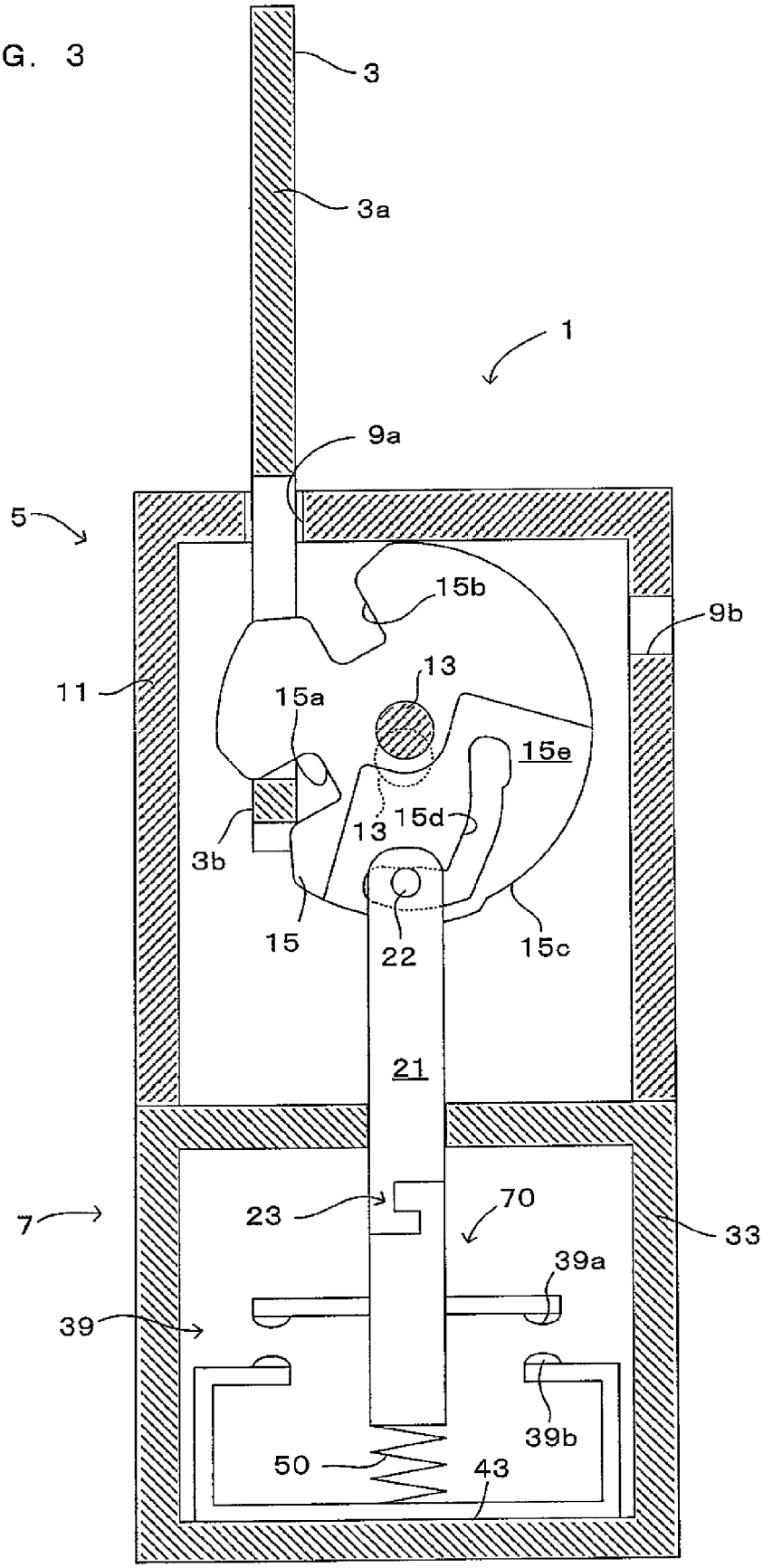
FIG. 3 is a sectional view showing the switch body according to the first embodiment of the invention.

FIG. 3 shows an example where the above-described permission structure for permitting the movement of the working rod 21 in the urging direction of the coil spring 50 is implemented in the rotary shaft 13 and a support portion (not shown) for supporting the rotary shaft 13 installed on the inside surface of the case member 11. As shown in FIG. 3, the permission structure is designed such that when at least the operating force of the operation or the number of operations of extracting the actuator 3 exceeds the breakage tolerance for the switch body 1, the rotary shaft 13 is released from the state supported by the support portion and the driving cam 15 is moved upward in the operation portion 5 whereby the working rod 21 is permitted to move in the urging direction of the coil spring 50. Specifically, an easy-to-break feature is imparted as follows for the sake of permitting the movement of the working rod 21. A portion engaged with the support portion for supporting the rotary shaft 13 on the inside surface of the peripheral wall of the case member 11 is made prone to breakage by reducing the thickness at a side closer to the actuator inlet port 9*a*. Alternatively, the rotary shaft 13 is made prone to breakage by partially forming a notch or partially reducing the diameter thereof. Thus, the working rod 21 is moved to the operation portion 5 by the urging force of the coil spring 50 and hence, the movable contact 39*a* is assuredly moved away from the stationary contact 39*b*, setting the first switch 39 to the open position. It is noted that the rotary shaft 13 indicated by the dotted line in FIG. 3 represents a normal design position of the rotary shaft 13 normally supported by the support portion.

While the permission structure for permitting the movement of the working rod 21 in the urging direction of the coil spring 50 is illustrated by way of examples where the portion engaged with the support portion for supporting the rotary shaft 13 is reduced in thickness and where the rotary shaft 13 is partially formed with the notch or partially reduced in diameter, the permission structure for permitting the working rod 21 to be moved in the urged direction is not limited to these examples. For example, the permission structure may be a structure wherein the rotary shaft 13 is simply supported by the support portion. In short, the permission structure may have any arrangement that assuredly permits the movement of the working rod 21 in the urging direction of the coil spring 50 when at least the operating force of the operation or the number of operations of extracting the actuator 3 exceeds the breakage tolerance for the switch body 1.

(2) Second Exemplary Operation

Figure 4:
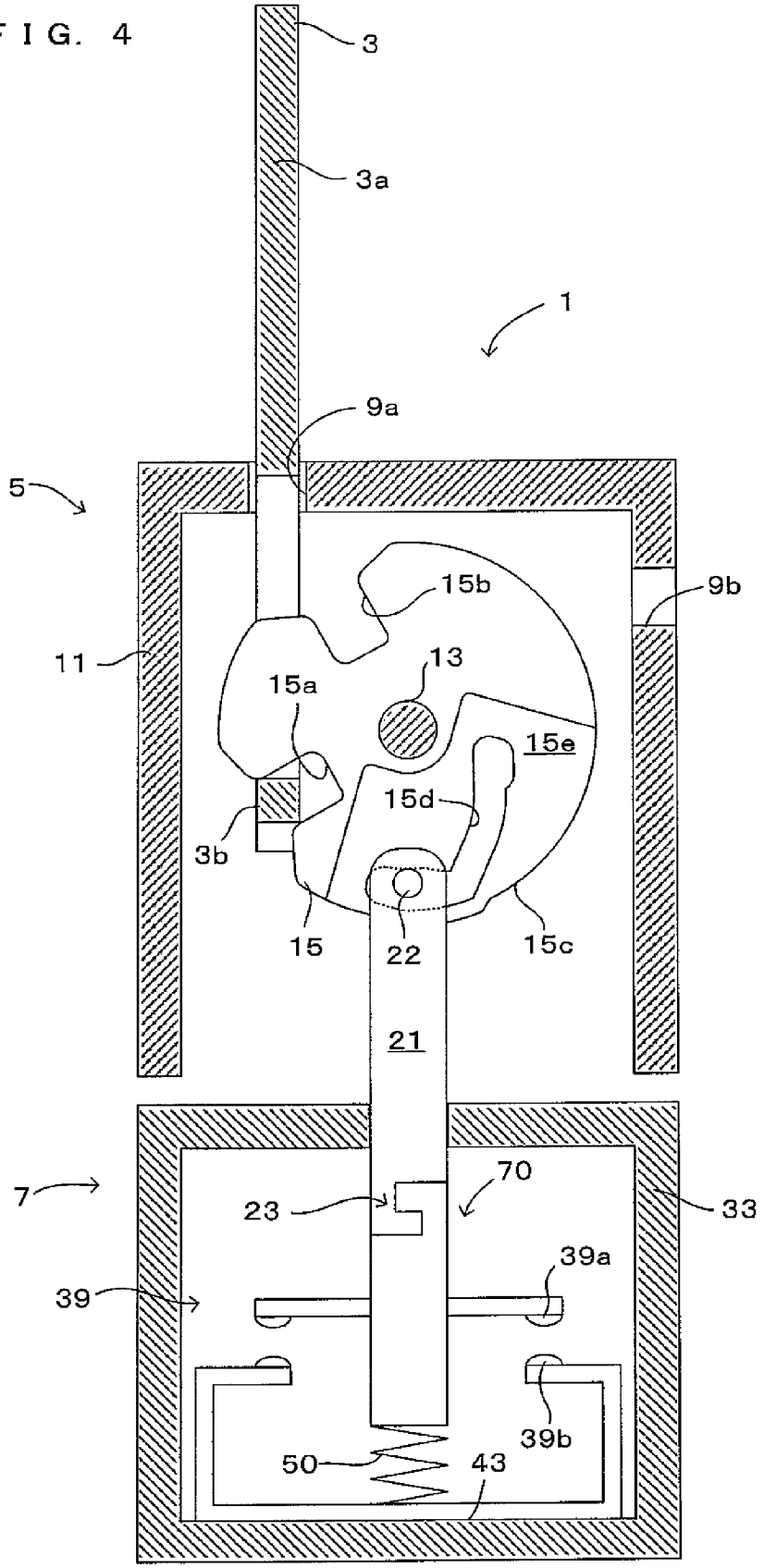
FIG. 4 is a sectional view showing the switch body according to the first embodiment of the invention.

FIG. 4 shows an example where the above-described permission structure for permitting the movement of the working rod 21 in the urging direction of the coil spring 50 is implemented in a connecting portion between the operation portion 5 and the switch portion 7. As shown in FIG. 4, the permission structure is designed such that when at least the operating force of the operation or the number of operations of extracting the actuator 3 exceeds the breakage tolerance for the switch body 1, the operation portion 5 and the switch portion 7 are released from the connecting relation and separated from each other so that the working rod 21 is permitted to move in the urging direction of the coil spring 50. Specifically, the permission structure is preferably arranged such that the case member 11 and the case member 33 are connected together by means of the locking structure consisting of the locking claw and the locked portion and that the configurations and strengths of the locking claw and the locked portion are so defined as to permit the locking structure to be broken by the operating force of the operation of extracting the actuator 3 that exceeds the breakage tolerance. Thus, the working rod 21 is moved to the operation portion 5 by the urging force of the coil spring 50 so that the movable contact 39*a* is assuredly moved away from the stationary contact 39*b*, setting the first switch 39 to the open position.

While the permission structure for permitting the movement of the working rod 21 in the urging direction of the coil spring 50 is illustrated by way of example of the locking structure including the locking claw and the locked portion, the permission structure for permitting the movement of the working rod 21 in the urged is not limited to this example. For example, the permission structure may be a structure wherein the case member 11 and the case member 33 are simply connected together. In short, the permission structure may have any arrangement that assuredly permits the movement of the working rod 21 in the urging direction of the coil spring 50 when at least the operating force of the operation or the number of operations of extracting the actuator 3 exceeds the breakage tolerance for the switch body 1.

According to this embodiment as described above, the movement of the working rod 12 in the urging direction of the coil spring 50 is permitted even if the operating force of the operation or the number of operations of extracting the actuator 3 from the operation portion 5 exceeds the breakage tolerance, causing the breakage of the working rod 21 or the breakage or drop-out of the operation portion 5. Hence, the working rod 21 is assuredly moved toward the operation portion 5 by the urging force of the coil spring 50, ensuring that the movable contact 39*a* can be moved away from the stationary contact 39*b*, reliably setting the first switch 39 to the open position. Thus, the safety switch can achieve safety improvement. Furthermore, the safety switch may have a simple structure facilitating the size reduction thereof because it is unnecessary to provide an additional switch for detecting the movement of the working rod 21 when the switch body 1 breaks down and the working rod is permitted to move in the urging direction of the coil spring 50.

When the operating force of the operation or the number of operations of extracting the actuator 3 from the operation portion 5 exceeds the breakage tolerance, the permission structure implemented in the support portion for rotatably supporting the driving cam 15 in the operation portion or in the connecting portion between the operation portion 5 and the switch portion 7 is activated to move the driving cam 15 away from the switch portion 7 in order to permit the movement of the working rod 21 in the urging direction of the coil spring 50. This ensures that the working rod 21 can be moved by the urging force of the coil spring 50 so that the movable contact 39*a* can be moved away from the stationary contact 39*b*, assuredly setting the first switch 39 to the open position.

Since the working rod 21 is designed to move as a unit with the movable contact 39*a*, the coil spring 50 alone can urgingly move the working rod 21 thereby assuredly moving the movable contact 39*a* away from the stationary contact 39*b*. Hence, the structure of the safety switch can be simplified.

Since the working rod 21 is connected to the driving cam 15 with the cam pin 22, the working rod 21 can be assuredly reciprocated by means of the driving cam 15 rotated in both directions according to the operations of inserting and extracting the actuator 3, thereby switching the first switch 39 of the switch portion 7 between the open and closed positions. When the driving cam 15 is rotated by the operation of extracting the actuator 3 from the operation portion 5, the cam pin 22 is moved along the guide slot 15*d* from the large diameter portion to the small diameter portion thereby exerting the pull-out force of extracting the working rod 21 from the switch portion 7. This force is added to the urging force of the coil spring 50 so as to ensure that the working rod 21 is moved to the operation portion 5. Even if the movable contact 39*a* and the stationary contact 39*b* are fused, for example, the first switch 39 can be reliably switched to the open position by forcibly separating the movable contact 39*a* from the stationary contact 39*b* and moving away the movable contact 39*a*. Thus, the safety switch can achieve reliability improvement.

In the case where the operating force of the operation or the number of operations of extracting the actuator 3 from the operation portion 5 exceeds the breakage tolerance, causing the breakage of the working rod 21 or the breakage or dropout of the operation portion 5, the driving cam 15 is moved substantially in the same direction as the moving direction of the working rod 21 to switch the first switch 39 to the open position if the driving cam is moved by and in the direction of the operation force of the operation of extracting the actuator 3. Namely, the driving cam is moved in the direction in which the working rod 21 is urged by the coil spring 50, as shown in FIG. 3 and FIG. 4. Therefore, even if the operating force of the operation or the number of operations of extracting the actuator 3 from the operation portion 5 exceeds the breakage tolerance when the safety switch is used normally for the operation of inserting the actuator 3 or the operation of extracting the actuator 3, the permission structure for permitting the movement of the working rod 21 in the urging direction of the coil spring 50, as shown in FIG. 3 and FIG. 4, is more reliably activated and hence, the safety switch can achieve even higher reliability.

Second Embodiment

A safety switch according to a second embodiment of the invention is described with reference to FIG. 5 to FIG. 8. The second embodiment differs from the first embodiment in that a flange 210*a* is formed at an upper portion of an working rod 210 and that a coil spring (equivalent to the "urging means" of the invention) 500 is interposed between the flange 210*a* and the case member 33 as mounted around the working rod 210, whereby the working rod 210 is urged upward or toward the operation portion 5. By urging the working rod 210 toward the operation portion 5, the coil spring 500 urges the movable contact 39*a* of the first switch 39 in the direction to move the movable contact away from the stationary contact 39*b* (open direction). Since the other components and the operations thereof are the same as in the first embodiment, the following description will principally detail the differences from the first embodiment referring to FIG. 1 to FIG. 4 as well. It is noted that like reference characters refer to the corresponding components of the first embodiment and the description thereof and of the operations thereof is dispensed with.

Figure 5:
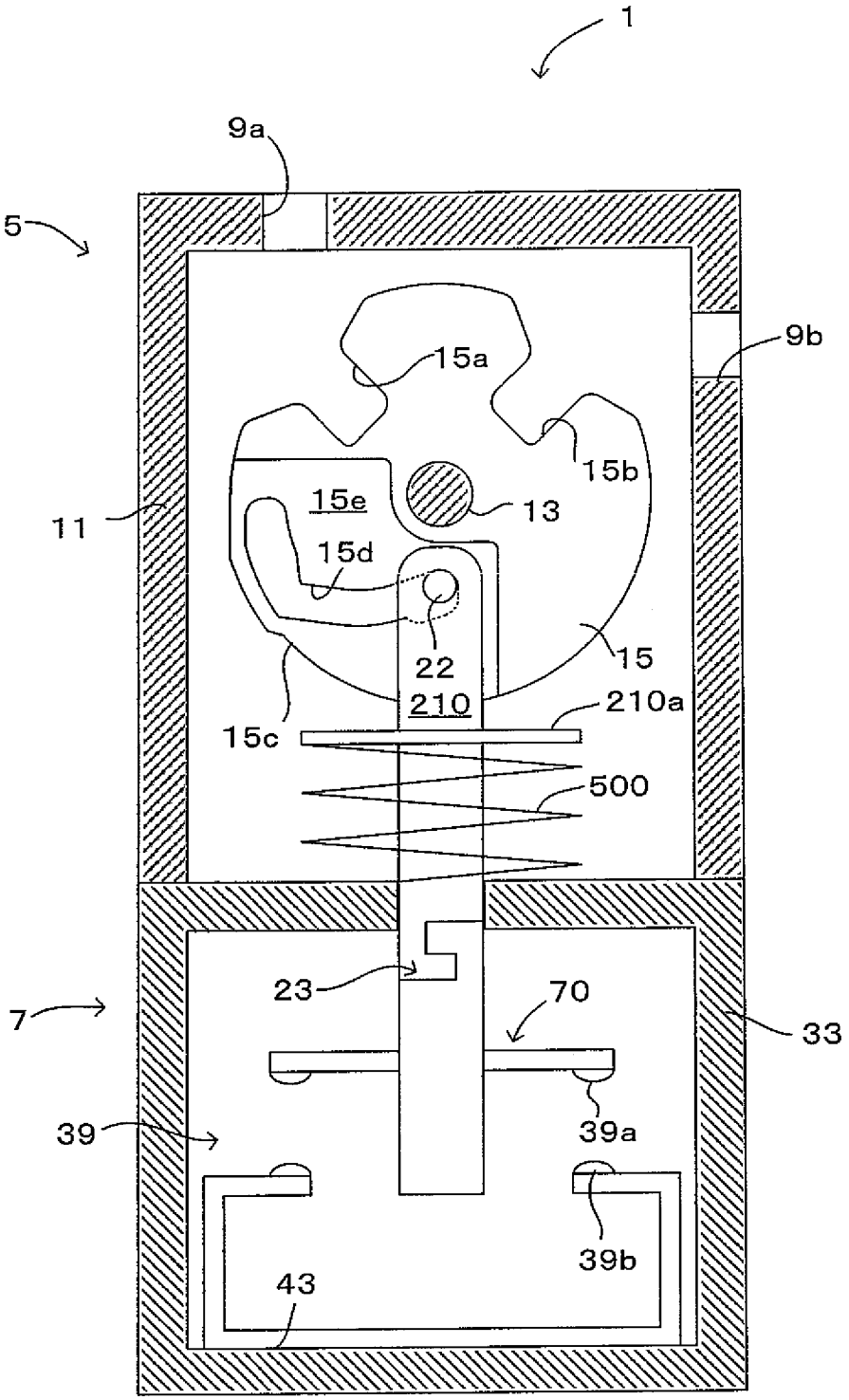
FIG. 5 is a sectional view showing a switch body according to a second embodiment of the invention.

FIG. 5 to FIG. 8 are sectional views of the switch body 1 as seen from the front, each showing the switch body in a different state. When the actuator 3 is not inserted in the operation portion 5 of the switch body 1, as shown in FIG. 5, the working rod 210 is moved to the operation portion 5 by the urging force of the coil spring 500. Hence, the first switch 39 is in the open position to disable the power supply to the industrial machine so that the industrial machine is deactivated.

Figure 6:
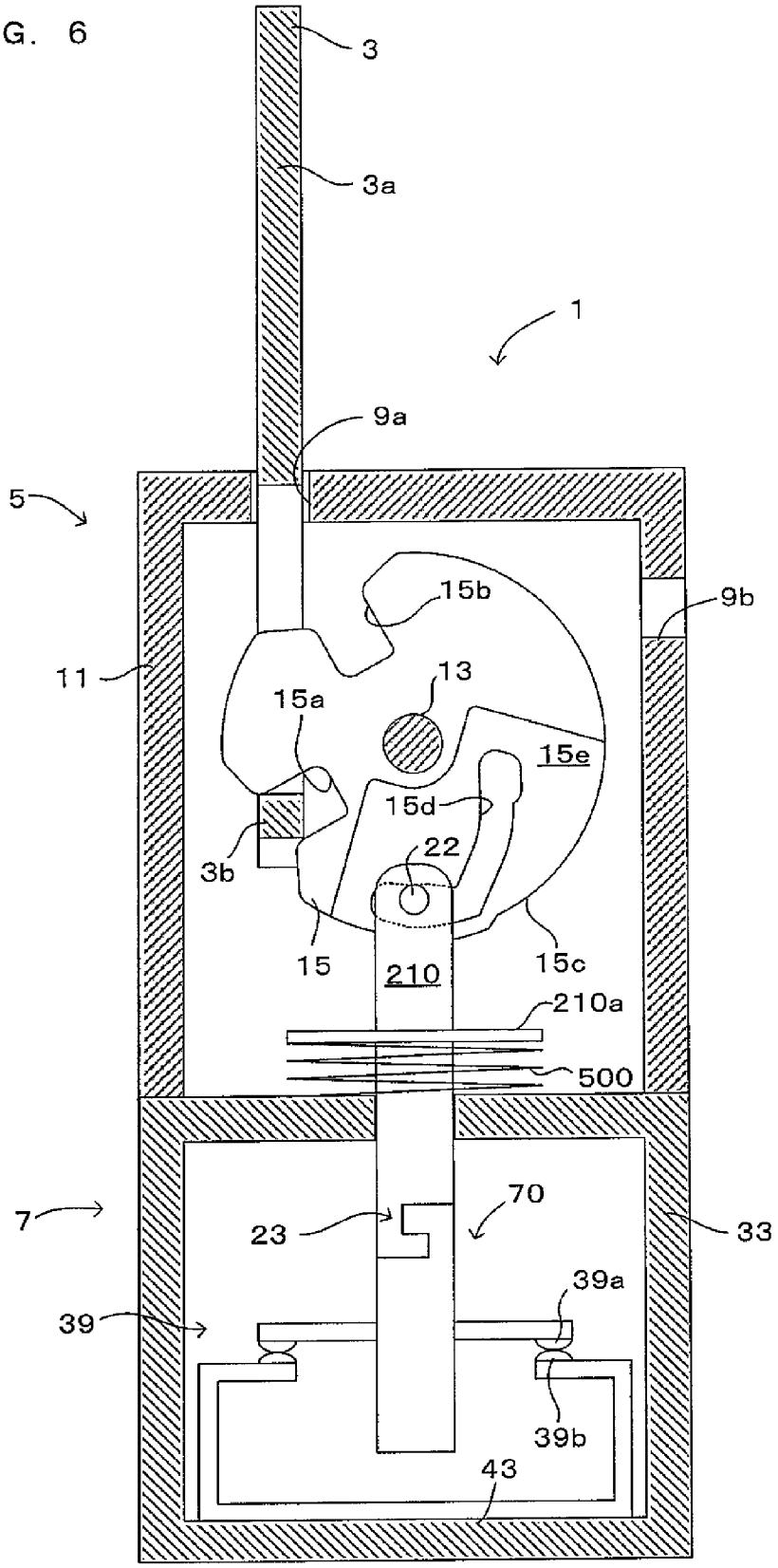
FIG. 6 is a sectional view showing the switch body according to the second embodiment of the invention.

Subsequently when the operation of inserting the actuator 3 by closing the protective door is performed to insert the actuator 3 through the actuator inlet port 9*a*, for example, in the operation portion 5 in the initial state shown in FIG. 5, the connecting peg 3*b* of the actuator 3 is engaged with the engaging portion 15*a* of the driving cam 15, as shown in FIG. 6. As the actuator 3 is inserted further, the driving cam 15 is rotated counter-clockwise. In conjunction with the rotation of the driving cam 15, the cam pin 22 is moved downward along the guide slot 15*d* against the urging force of the coil spring 500.

The downward movement of the cam pin 22 pushes down the working rod 210 into the switch portion 7 against the urging force of the coil spring 500. As the working rod 210 is moved further down, the movable contact 39*a* is moved into contact with the stationary contact 39*b*, switching the first switch 39 from the open position to the closed position. Thus, the first switch 39 is set to the closed position so that the electric power is supplied to the industrial machine such as the robot connected in series with the first switch 39. Hence, the industrial machine is actuated.

When, on the other hand, the inserted actuator 3 shown in FIG. 5 is extracted by the operation of extracting the actuator 3 by opening the protective door, for example, the driving cam 15 is rotated in the direction of extraction of the actuator 3 till the connecting peg 3*b* of the actuator 3 is disengaged from the engaging portion 15*a* of the driving cam 15. In conjunction with the rotation of the driving cam 15, the cam pin 22 is moved upward along the guide slot 15*d* from the large diameter portion to the small diameter portion. The upward movement of the cam pin 22 moves the working rod 21 in the direction to extract the working rod from the switch portion 7.

The urging force of the coil spring 500 is combined with the pull-out force which derives from the rotation of the driving cam 15 and works to extract the working rod 210 from the switch portion 7. The combined force moves the working rod 210 in the opposite direction from the movement of the working rod 210 during the operation of inserting the actuator 3. Namely, the working rod 210 is extracted from the switch portion 7 and moved to the operation portion 5. Hence, the movable contact 39*a* is moved away from the stationary contact 39*b*, setting the first switch 39 to the open position so that the industrial machine is deactivated.

Similarly to the first embodiment, this embodiment is provided with the permission structure for permitting at least the movement of the working rod 210 in the urging direction of the coil spring 500 when at least the operating force of the operation or the number of operations of extracting the actuator 3 exceeds the breakage tolerance for the switch body 1. As described above, if the working rod 210 is permitted to move in the urging direction of the coil spring 500 and thence is moved to the operation portion 5, the movable contact 39*a* of the first switch 39 is moved away from the stationary contact 39*b*. Accordingly, even if some external load is exerted on the working rod 210 to cause the breakage thereof or if some external load is exerted on the operation portion 5 to cause the breakage or dropout thereof, the movable contact 39*a* is assuredly moved away from the stationary contact 39*b* by the urging force of the coil spring 500, setting the first switch 39 to the open position. Now referring to FIG. 7 and FIG. 8, description is made on specific permission structures for permitting the movement of the working rod 210 in the urging direction of the coil spring 500.

(3) Third Exemplary Operation

Figure 7:
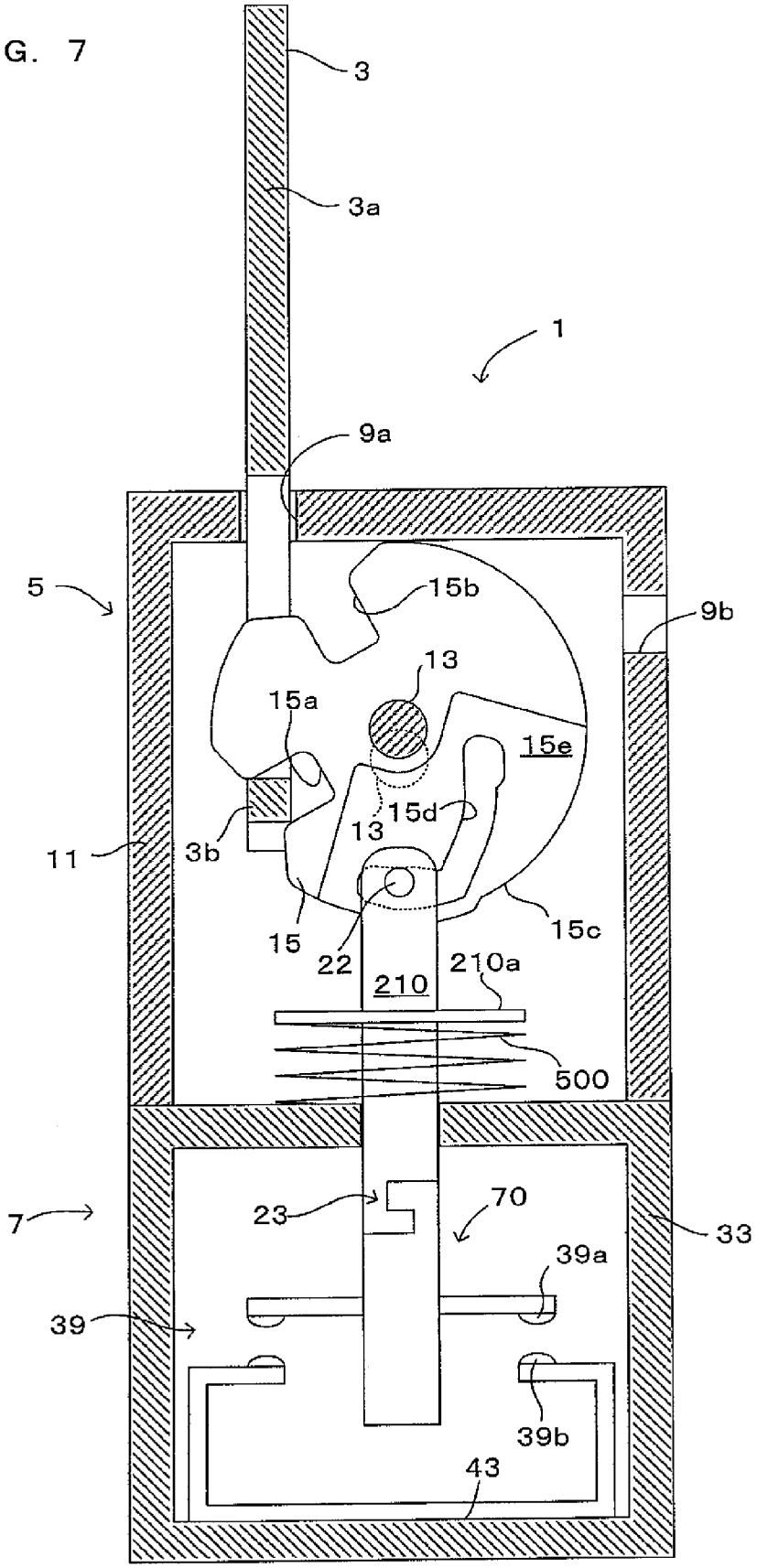
FIG. 7 is a sectional view showing the switch body according to the second embodiment of the invention.

FIG. 7 shows an example where the above-described permission structure for permitting the movement of the working rod 210 in the urging direction of the coil spring 500 is implemented in the rotary shaft 13 and the support portion (not shown) for supporting the rotary shaft 13 installed on the inside surface of the case member 11. As shown in FIG. 7, the permission structure is designed such that when at least the operating force of the operation or the number of operations of extracting the actuator 3 exceeds the breakage tolerance for the switch body 1, the rotary shaft 13 is released from the state supported by the support portion and the driving cam 15 is moved upward in the operation portion 5 so that the working rod 210 is permitted to move in the urging direction of the coil spring 500. It is preferred that a specific arrangement of the permission structure is the same as that described with reference to the first exemplary operation of the first embodiment. Thus, the working rod 210 is moved to the operation portion 5 by the urging force of the coil spring 500 so that the movable contact 39*a* is assuredly moved away from the stationary contact 39*b*, setting the first switch 39 to the open position. It is noted that the rotary shaft 13 indicated by the dotted line in FIG. 7 represents the normal design position of the rotary shaft 13 normally supported by the support portion.

(4) Fourth Exemplary Operation

Figure 8:
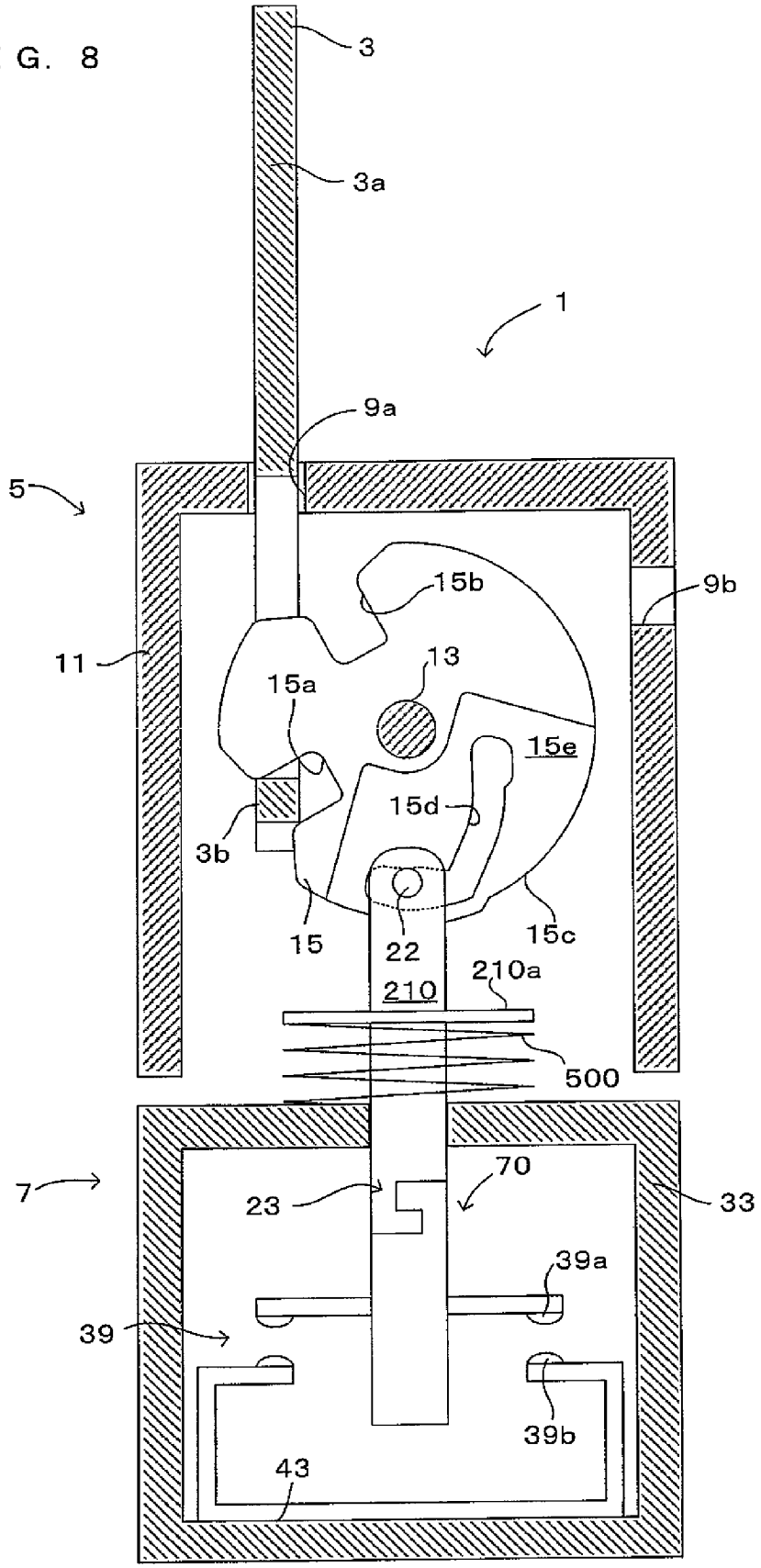
FIG. 8 is a sectional view showing the switch body according to the second embodiment of the invention.

FIG. 8 shows an example where the above-described permission structure for permitting the movement of the working rod 210 in the urging direction of the coil spring 500 is implemented in the connecting portion between the operation portion 5 and the switch portion 7. As shown in FIG. 8, the permission structure is designed such that when at least the operating force of the operation or the number of operations of extracting the actuator 3 exceeds the breakage tolerance for the switch body 1, the operation portion 5 and the switch portion 7 are released from the connecting relation and separated from each other so that the working rod 210 is permitted to move in the urging direction of the coil spring 500. It is preferred that the specific arrangement of the permission structure is the same as that described with reference to the second exemplary operation of the first embodiment. Thus, the working rod 210 is moved to the operation portion 5 by the urging force of the coil spring 500 so that the movable contact 39*a* is assuredly moved away from the stationary contact 39*b*, setting the first switch 39 to the open position.

As described above, this embodiment can offer the same effects as those of the first embodiment.

Third Embodiment

A safety switch according to a third embodiment of the invention is described with reference to FIG. 9 to FIG. 14. The third embodiment differs from the first embodiment in that the operation portion 5 is provided with a lock mechanism 60 (equivalent to "lock means" of the invention) that includes a locking member 61 adapted to be locked to a driving cam 150 for inhibiting the rotation thereof and that, with the actuator 3 inserted in the operation portion 5, inhibits the operation of extracting the actuator 3 by inhibiting the rotation of the driving cam 150 by locking the locking member 61 to the driving cam 150. The locking member 61 is formed in a U-shape and includes a base 62, and a locking peg 63 formed integrally with the base 3*a* and bridging opposite sides of a portion distal to the base 62. The locking member is adapted to oscillate about a bend 62*a* of the base as a pivotal point. As shown in FIG. 10, the driving cam 150 of the embodiment is formed with a lock portion 15*f*. With the actuator 3 inserted in the operation portion 5, the locking member 61 oscillates about the bend 62*a* as the pivotal point and toward the driving cam 150 thereby locking the locking peg 63 to the lock portion 15*f* for inhibiting the rotation of the driving cam 150. Since the other components and the operations thereof are the same as in the first embodiment, the following description will principally detail the differences from the first embodiment referring to FIG. 1 to FIG. 4, as well. It is noted that like reference characters refer to the corresponding components of the first embodiment and the description thereof and of the operations thereof is dispensed with.

Figure 9:
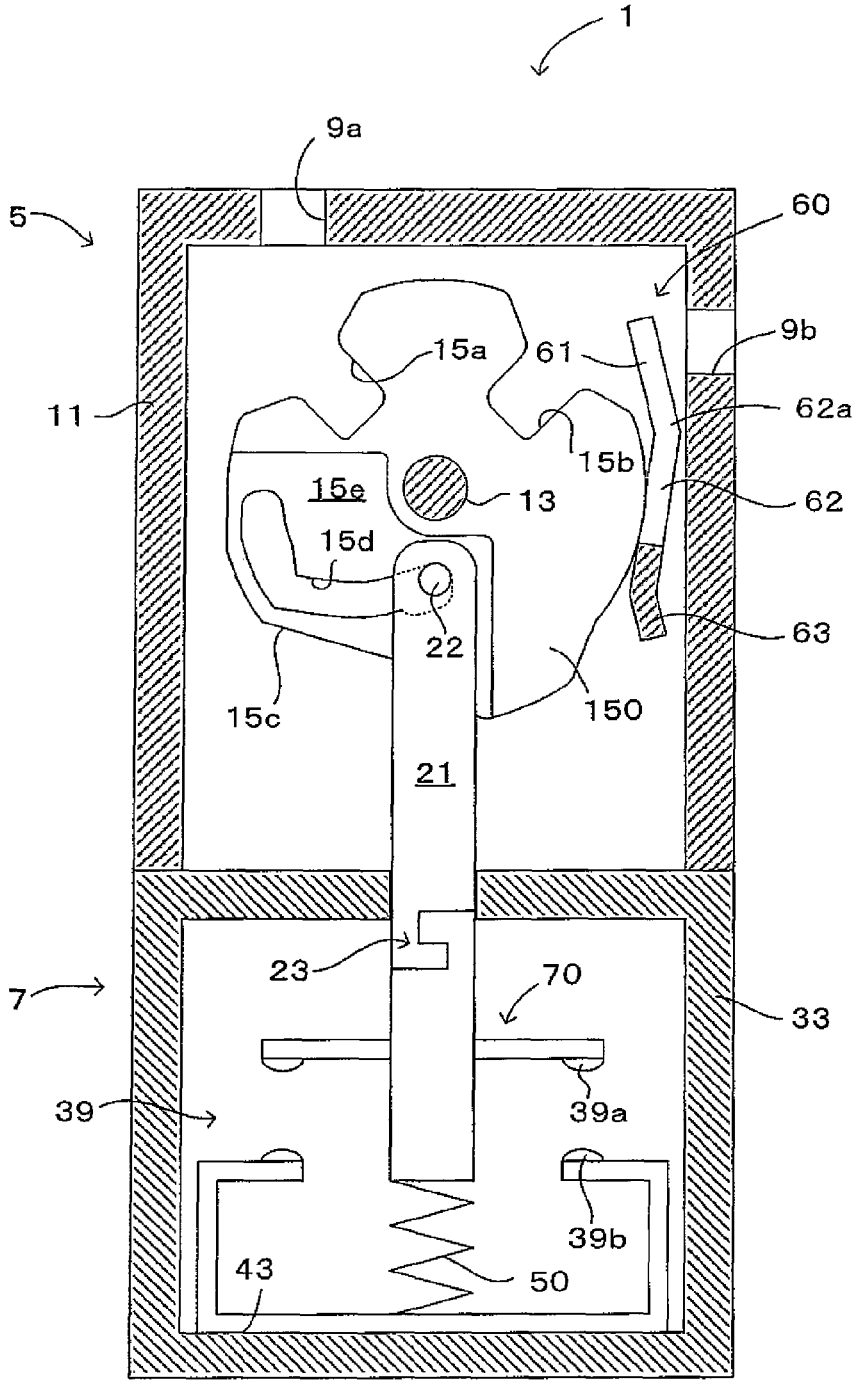
FIG. 9 is a sectional view showing a switch body according to a third embodiment of the invention.
Figure 10:
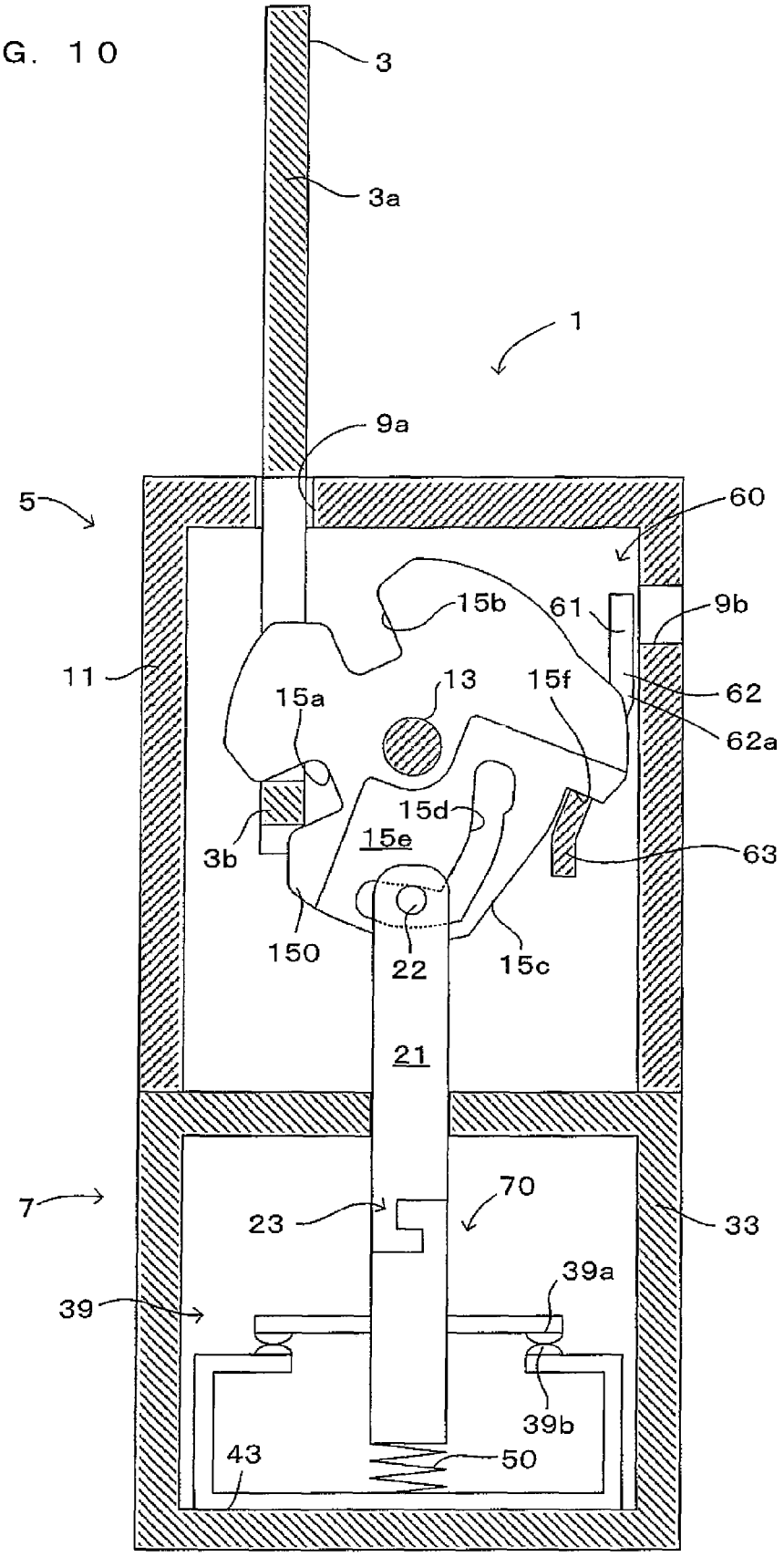
FIG. 10 is a sectional view showing the switch body according to the third embodiment of the invention.

FIG. 9 to FIG. 14 are sectional views of the switch body 1 as seen from the front, each showing the switch body in a different state. When the actuator 3 is not inserted in the operation portion 5 of the switch body 1, as shown in FIG. 9, the working rod 21 is moved to the operation portion 5 by the urging force of the coil spring 50. Hence, the first switch 39 is in the open position to disable the power supply to the industrial machine so that the industrial machine is deactivated. Further, the locking member 61 oscillates about the bend 62*a* as the pivotal point and to the case member 11.

Subsequently when the operation of inserting the actuator 3 by closing the protective door is performed to insert the actuator 3 through the actuator inlet port 9*a*, for example, in the operation portion 5 in the initial state shown in FIG. 9, the connecting peg 3*b* of the actuator 3 is engaged with the engaging portion 15*a* of the driving cam 150, as shown in FIG. 10. As the actuator 3 is inserted further, the driving cam 150 is rotated counter-clockwise. In conjunction with the rotation of the driving cam 150, the cam pin 22 is moved downward along the guide slot 15*d* against the urging force of the coil spring 50.

The downward movement of the cam pin 22 pushes down the working rod 21 into the switch portion 7 against the urging force of the coil spring 50. As the working rod 21 is moved further down, the movable contact 39*a* is moved into contact with the stationary contact 39*b*, switching the first switch 39 from the open position to the closed position. Thus, the first switch 39 is set to the closed position so that the electric power is supplied to the industrial machine such as the robot connected in series with the first switch 39. Hence, the industrial machine is actuated. With the actuator 3 inserted in the operation portion 5, the locking member 61 oscillates about the bend 62*a* as the pivotal point and to the driving cam 150, thereby locking the locking peg 63 to the lock portion 15*f* and inhibiting the rotation of the driving cam 150. Thus, the operation of extracting the actuator 3 from the operation portion 5 is inhibited.

On the other hand, when well-known unlocking means (not shown) employing a solenoid or the like is operated to oscillate the locking member 61 about the bend 62*a* as the pivotal point and to the case member 11 whereby the locking peg 63 is released from the locked relation with the lock portion 15*f*. When, in this state, the operation of extracting the actuator 3 is performed by opening the protective door or such, the inserted actuator 3 is extracted as shown in FIG. 9 while the driving cam 150 is rotated in the direction of extraction of the actuator 3 till the connecting peg 3*b* of the actuator 3 is disengaged from the engaging portion 15*a* of the driving cam 150. In conjunction with the rotation of the driving cam 150, the cam pin 22 is moved upward along the guide slot 15*d* from the large diameter portion to the small diameter portion so that the working rod 21 is extracted from the switch portion 7.

The urging force of the coil spring 50 is combined with the pull-out force which derives from the rotation of the driving cam 150 and works to extract the working rod 21 from the switch portion 7. The combined force moves the working rod 21 in the opposite direction from the movement of the working rod 21 during the operation of inserting the actuator 3. Namely, the working rod 21 is extracted from the switch portion 7 and moved to the operation portion 5. Hence, the movable contact 39*a* is moved away from the stationary contact 39*b*, setting the first switch 39 to the open position so that the industrial machine is deactivated.

Similarly to the first embodiment, this embodiment is provided with the permission structure for permitting at least the movement of the working rod 21 in the urging direction of the coil spring 50 when at least the operating force of the operation or the number of operations of extracting the actuator 3 exceeds the breakage tolerance for the switch body 1. As described above, if the working rod 21 is permitted to move in the urging direction of the coil spring 50 and thence is moved to the operation portion 5, the movable contact 39*a* of the first switch is moved away from the stationary contact 39*b*. Accordingly, even if some external load is exerted on the working rod 21 to cause the breakage thereof or some external load is exerted on the operation portion 5 to cause the breakage or dropout thereof, the movable contact 39*a* is assuredly moved away from the stationary contact 39*b* by the urging force of the coil spring 50, setting the first switch 39 to the open position. In addition to the above described examples where some external load causes the breakages or dropout, there is also a case where some external load is exerted on the working rod 21. During the operation of closing the protective door, the lock mechanism 60 operates concurrently with the insertion of the actuator 3 into the operation portion 5, inhibiting the extraction of the actuator 3 from the operation portion 5. At this time, a pull-out force derived from a rebounding force of the protective door closed too quickly is exerted on the actuator 3 and then on the driving cam and working rod. Now referring to FIG. 11 to FIG. 14, description is made on specific permission structures that permit the working rod 21 to move in the urging direction of the coil spring 50.

(5) Fifth Exemplary Operation

Figure 11:
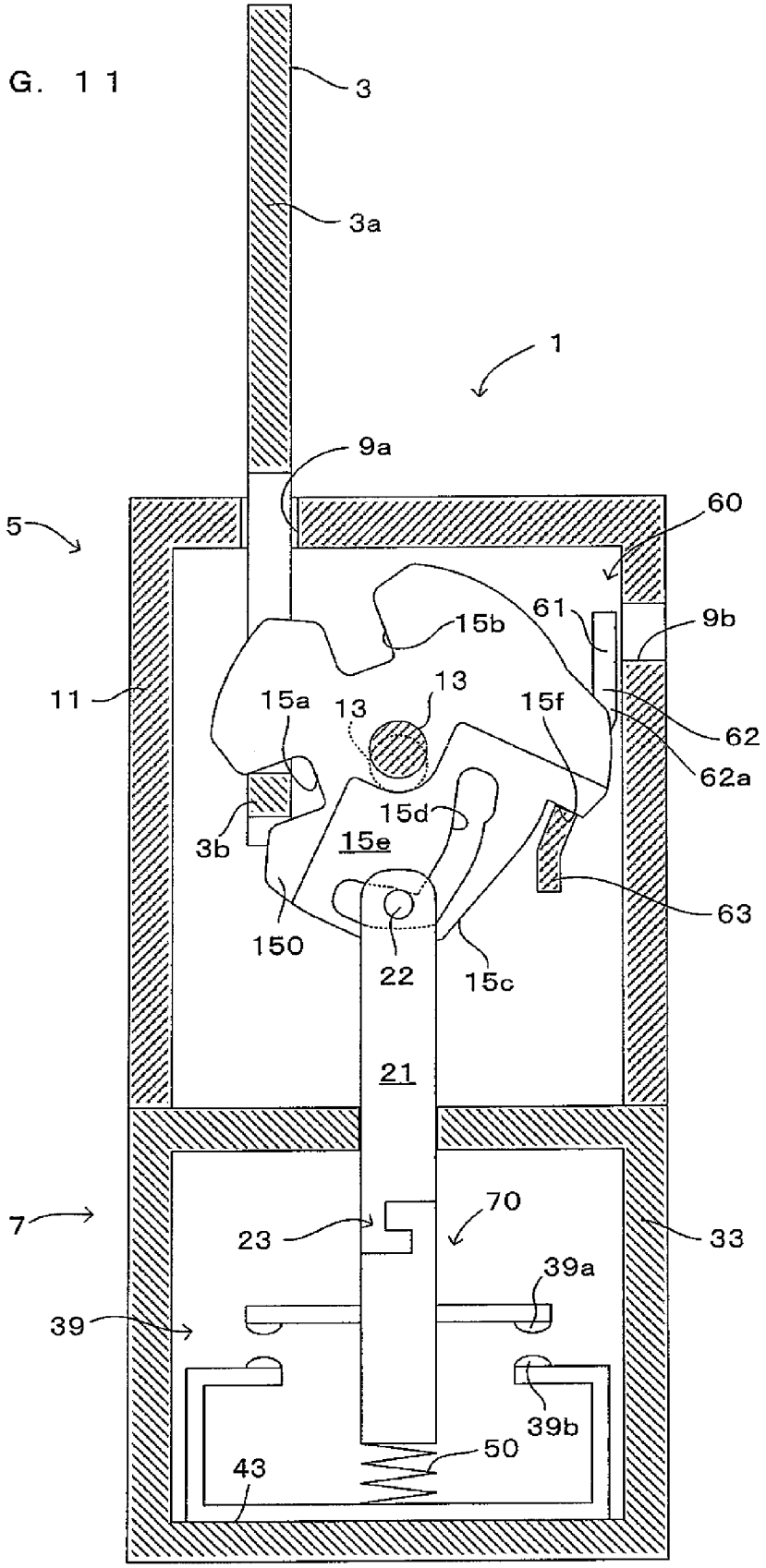
FIG. 11 is a sectional view showing the switch body according to the third embodiment of the invention.

FIG. 11 shows an example where the above-described permission structure for permitting the movement of the working rod 21 in the urging direction of the coil spring 50 is implemented in the rotary shaft 13 and the support portion (not shown) for supporting the rotary shaft 13 installed on the inside surface of the case member 11. As shown in FIG. 11, the permission structure is designed such that when an operation of forcibly extracting the actuator 3 from the operation portion 5 is performed with the lock mechanism 60 inhibiting the operation of extracting the actuator 3 so that the operating force of the extraction operation exceeds the breakage tolerance for the switch body 1, the rotary shaft 13 is released from the state supported by the support portion and the driving cam 150 is moved upward in the operation portion 5 so that the working rod 21 is permitted to move in the urging direction of the coil spring 50. It is referred that the specific arrangement of the permission structure is the same as that described with reference to the first exemplary operation of the first embodiment. Thus, the working rod 21 is moved to the operation portion 5 by the urging force of the coil spring 50 so that the movable contact 39*a* is assuredly moved away from the stationary contact 39*b*, setting the first switch 39 to the open position. It is noted that the rotary shaft 13 indicated by the dotted line in FIG. 11 represents the normal design position of the rotary shaft 13 normally supported by the support portion.

(6) Sixth Exemplary Operation

Figure 12:
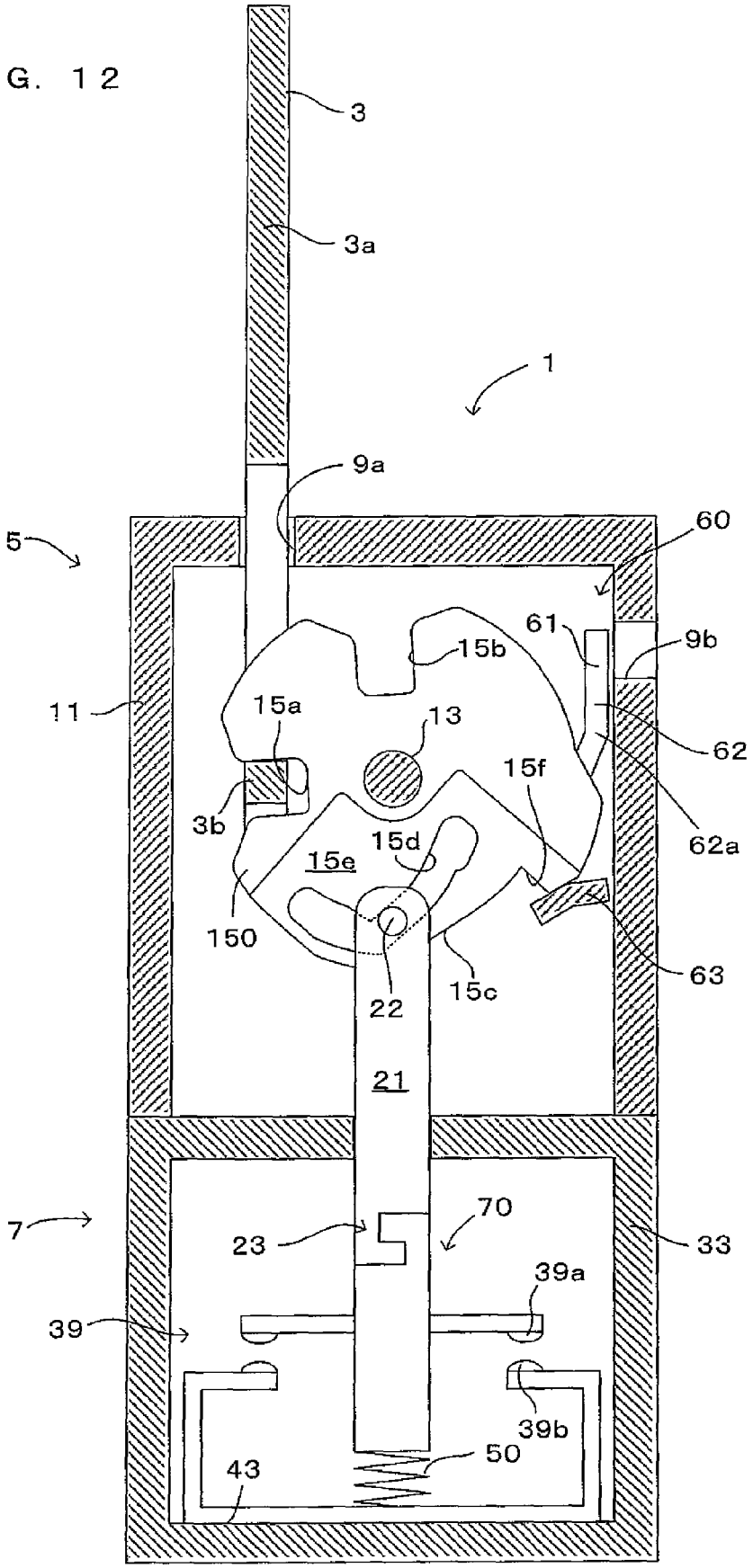
FIG. 12 is a sectional view showing the switch body according to the third embodiment of the invention.

FIG. 12 shows an example where the above-described permission structure for permitting the movement of the working rod 21 in the urging direction of the coil spring 50 is implemented in the lock mechanism 60 for inhibiting the rotation of the driving cam 150. As shown in FIG. 12, the permission structure is designed such that when the operation of forcibly extracting the actuator 3 from the operation portion 5 is performed with the lock mechanism 60 inhibiting the operation of extracting the actuator 3 so that the operating force of the extraction operation exceeds the breakage tolerance for the switch body 1, the locking member 61 breaks down to release the driving cam 150 from the rotation inhibition by the lock mechanism 60 and hence, the driving cam 150 is rotated clockwise. This permits the movement of the working rod 21 in the urging direction of the coil spring 50. Specifically, it is preferred that the locking member 61 is made prone to breakage by partially forming a notch or such, facilitating the permission of the movement of the working rod 21. Thus, the working rod 21 is moved to the operation portion 5 by the urging force of the coil spring 50 so that the movable contact 39*a* is assuredly moved away from the stationary contact 39*b*, setting the first switch 39 to the open position.

(7) Seventh Exemplary Operation

Figure 13:
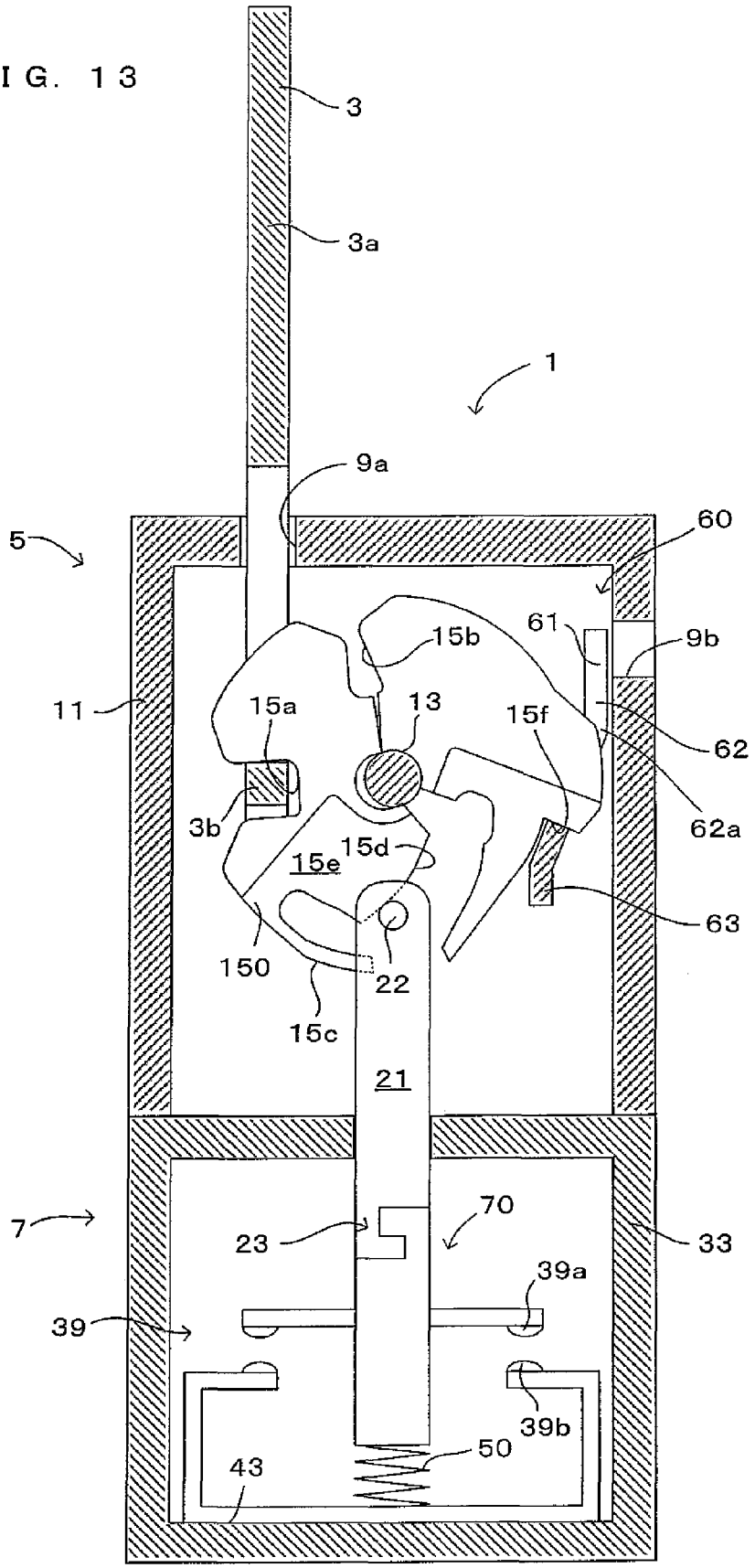
FIG. 13 is a sectional view showing the switch body according to the third embodiment of the invention.

FIG. 13 shows an example where the above-described permission structure for permitting the movement of the working rod 21 in the urging direction of the coil spring 50 is implemented in the driving cam 150. As shown in FIG. 13, the permission structure is designed such that when the operation of forcibly extracting the actuator 3 from the operation portion 5 is performed with the lock mechanism 60 inhibiting the operation of extracting the actuator 3 so that the operating force of the extraction operation exceeds the breakage tolerance for the switch body 1, the driving cam 150 breaks down to release the working rod 21 from the push toward the switch portion 7 by the driving cam 150 so that the working rod 21 is permitted to move in the urging direction of the coil spring 50. Specifically, it is preferred that the driving cam 150 is made prone to breakage by partially forming a notch or such, facilitating the permission of the movement of the working rod 21. Thus, the working rod 21 is moved to the operation portion 5 by the urging force of the coil spring 50 so that the movable contact 39*a* is assuredly moved away from the stationary contact 39*b*, setting the first switch 39 to the open position.

(8) Eighth Exemplary Operation

Figure 14:
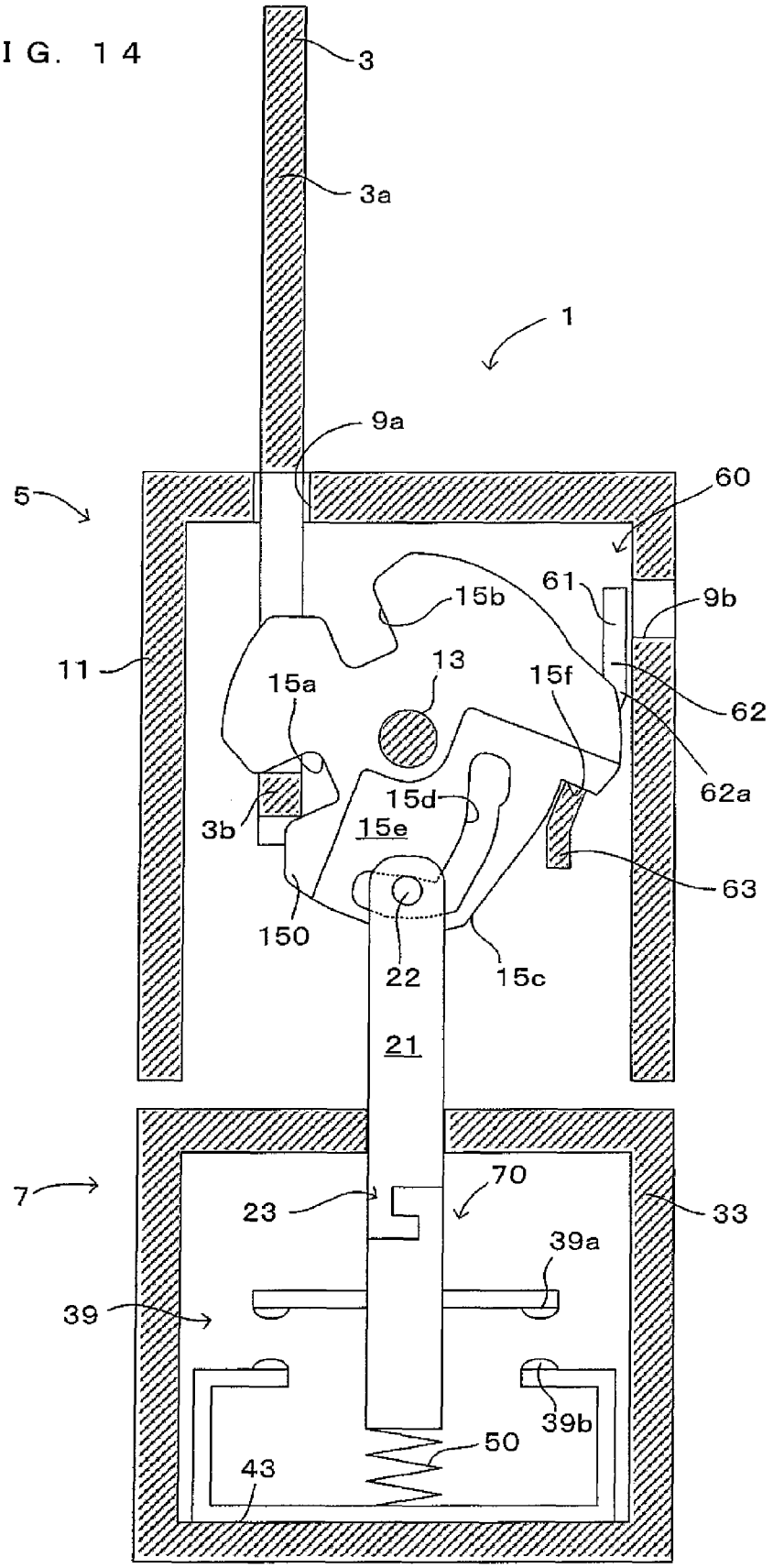
FIG. 14 is a sectional view showing the switch body according to the third embodiment of the invention.

FIG. 14 shows an example where the above-described permission structure for permitting the movement of the working rod 21 in the urging direction of the coil spring 50 is implemented in the connecting portion between the operation portion 5 and the switch portion 7. As shown in FIG. 14, the permission structure is designed such that when the operation of forcibly extracting the actuator 3 from the operation portion 5 is performed with the lock mechanism 60 inhibiting the operation of extracting the actuator 3 so that the operating force of the extraction operation exceeds the breakage tolerance for the switch body 1, the operation portion 5 and the switch portion 7 are released from the connecting relation and separated from each other so that the working rod 21 is permitted to move in the urging direction of the coil spring 50. It is preferred that the specific arrangement of the permission structure is the same as that described with reference to the second exemplary operation of the first embodiment. Thus, the working rod 21 is moved to the operation portion 5 by the urging force of the coil spring 50 so that the movable contact 39*a* is assuredly moved away from the stationary contact 39*b*, setting the first switch 39 to the open position.

As described above, this embodiment can offer the same effects as those of the first embodiment and besides, the following effect. That is, the operation of extracting the actuator 3 from the operation portion 5 can be prevented by the lock mechanism 60 inhibiting the rotation of the driving cam 150. At this time, if the operation portion 5 breaks down or drops out because the operation of forcibly extracting the actuator 3 is performed so that the operating force of the operation of extracting the actuator 3 from the operation portion 5 exceeds the breakage tolerance for the switch body 1, the working rod 21 is permitted to move in the urging direction of the coil spring 50. Hence, the working rod 21 is assuredly moved to the operation portion 5 by the urging force of the coil spring 50. Accordingly, the movable contact 39*a* can be moved away from the stationary contact 39*b*, reliably setting the first switch 39 to the open position.

Fourth Embodiment

A safety switch according to a fourth embodiment of the invention is described with reference to FIG. 15 to FIG. 21. The fourth embodiment differs from the third embodiment in that the safety switch further comprises a second switch 40 switched between the open and closed positions according to a lock mechanism 460 (equivalent to the "lock means" of the invention) switching a driving cam 415 between a rotation inhibition position and a rotation permission position. According to the embodiment, the lock mechanism 460 is disposed in a case member 433 and to the right side of an operation portion 405. The lock mechanism 460 is adapted to inhibit the rotation of the driving cam 415 by locking a locking member 461 thereof to a lock portion 415*f* formed at the driving cam 415, the locking member retractably projecting its distal end 462 into the operation portion 405. The structure of the lock mechanism 460 will be described in detail hereinlater. Since the other components and the operations thereof are the same as in the third embodiment, the following description will principally detail the differences from the third embodiment referring to FIG. 9 to FIG. 14, as well. It is noted that like reference characters refer to the corresponding components of the third embodiment and a specific description thereof and of the operations thereof is dispensed with.

FIG. 15 to FIG. 21 are sectional views of a switch body 400 as seen from the front, each showing the switch body in a different state. Similarly to the above-described safety switches, the safety switch according to the embodiment is electrically connected to the industrial machine as the external apparatus such as the robot via the cable and includes the switch body 400 and an actuator 3.

The switch body 400 includes the operation portion 405 and a switch portion 407 and is fixed to the wall surface around the protective door of the industrial machine (not shown). On the other hand, the actuator 3 is fixed to the protective door and is located at the position opposite to an actuator inlet port 409 formed in the upper side of the operation portion 405. The actuator 3 is inserted into the actuator inlet port 409 of the operation portion 405 by closing the protective door or the operation of inserting the actuator 3. The actuator 3 includes the U-shaped base 3*a* and the connecting peg 3*b* formed integrally with the base 3*a* and bridging opposite sides of the portion distal to the base 3*a*.

Figure 15:
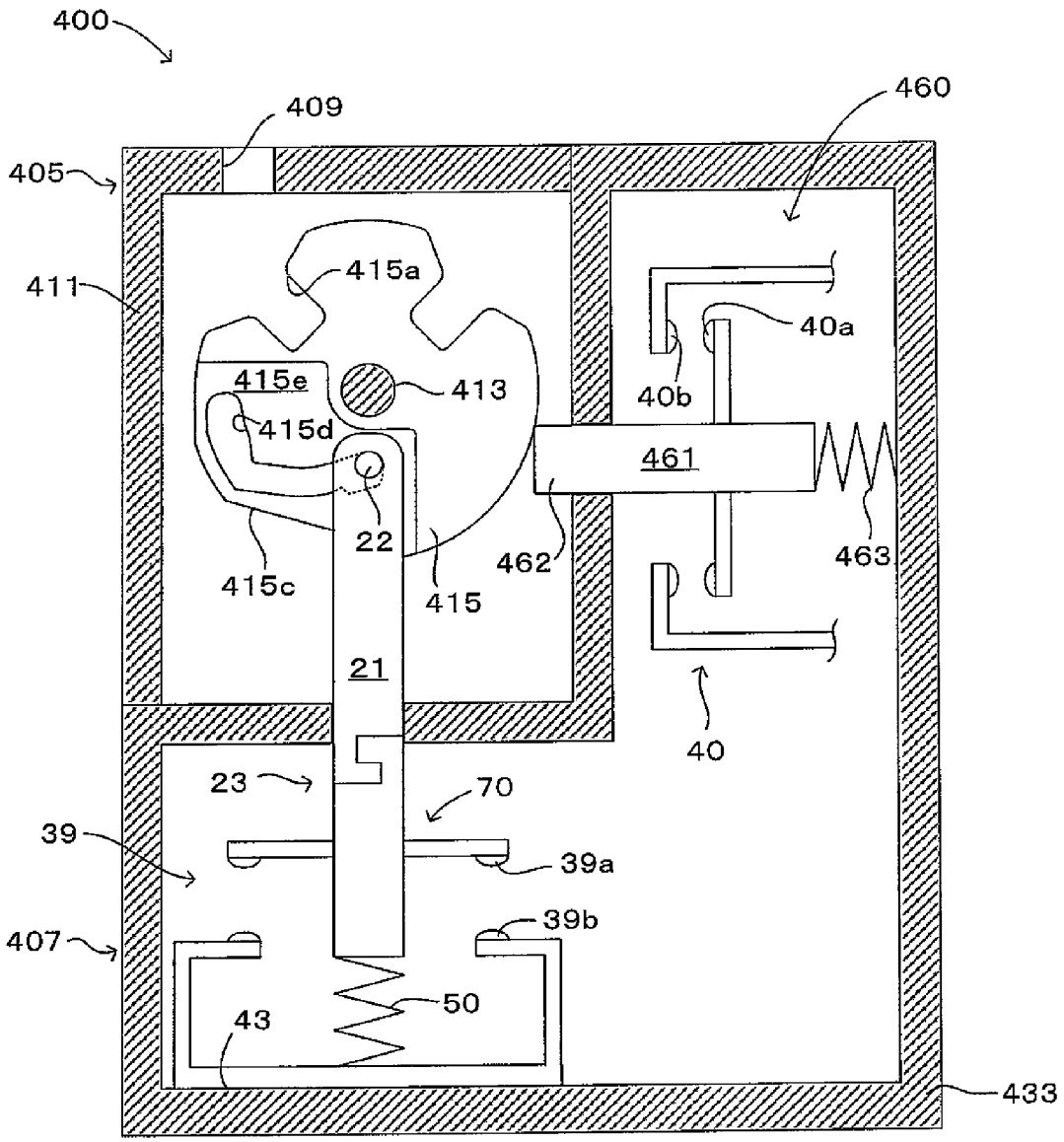
FIG. 15 is a sectional view showing a switch body according to a fourth embodiment of the invention.
Figure 16:
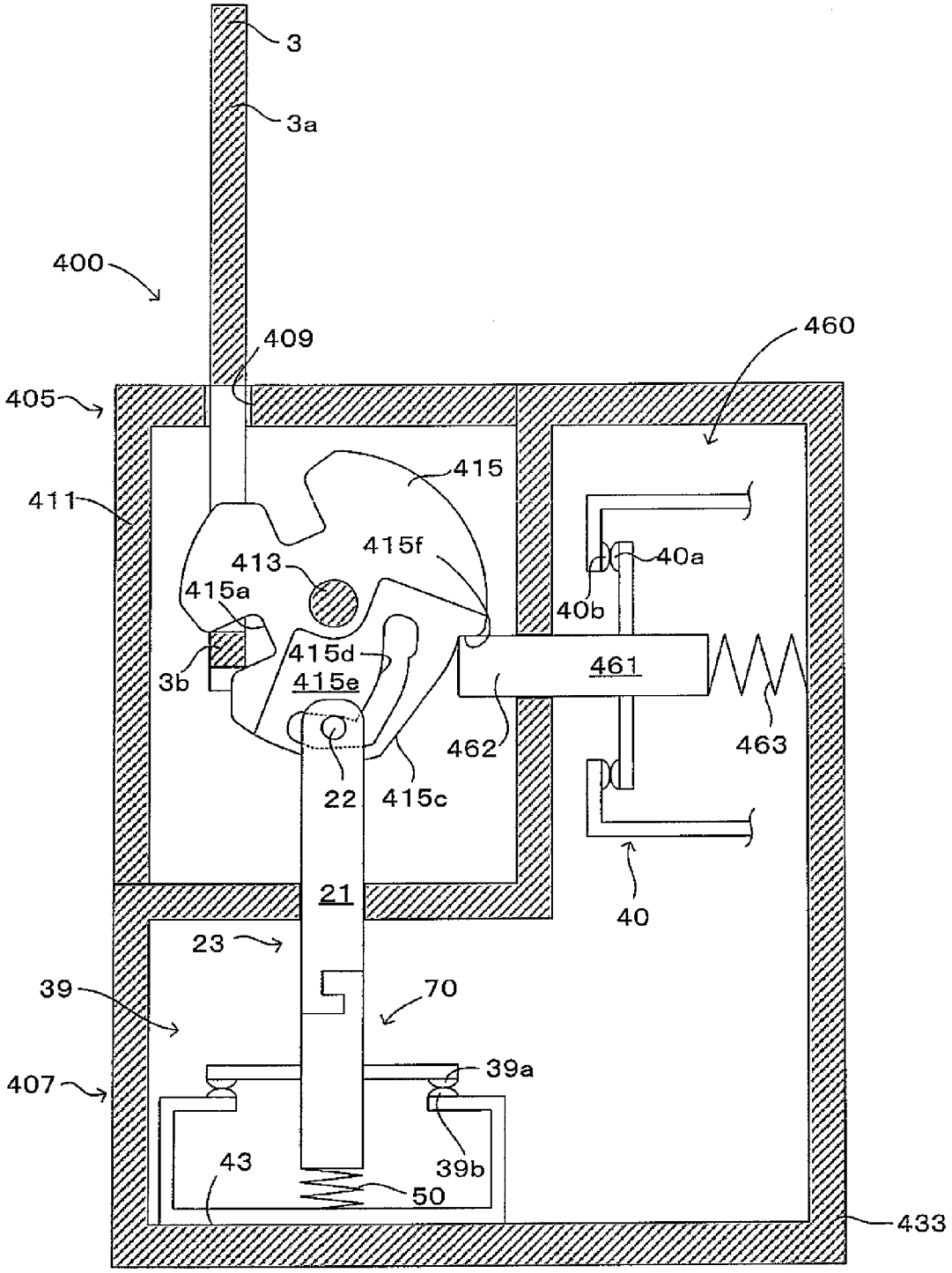
FIG. 16 is a sectional view showing the switch body according to the fourth embodiment of the invention.
Figure 17:
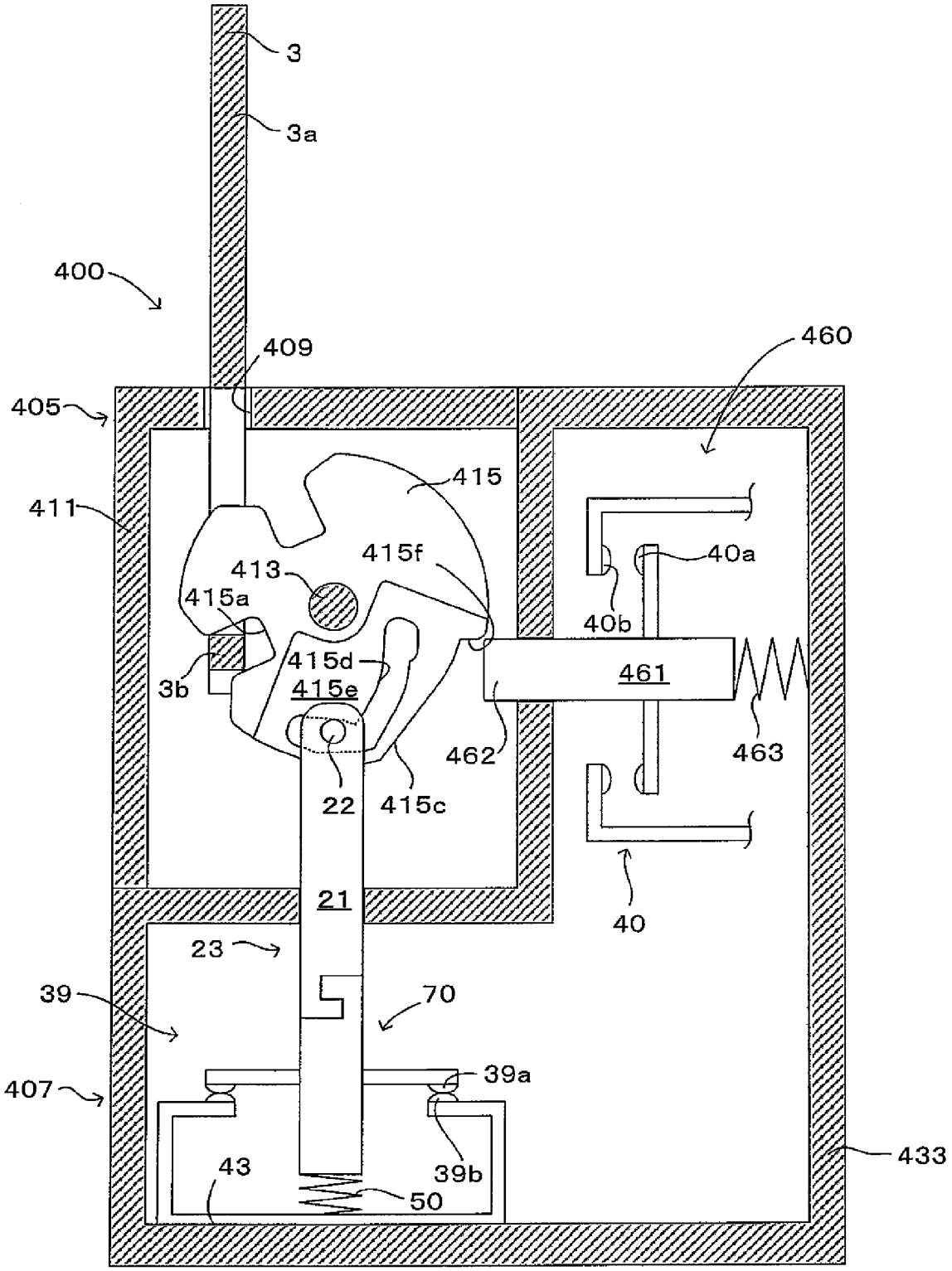
FIG. 17 is a sectional view showing the switch body according to the fourth embodiment of the invention.

As shown in FIG. 15 to FIG. 17, the operation portion 405 disposed at an upper left portion of the switch body 400 includes a case member 411, and the driving cam 415 having a rotary shaft 413 supported on an inside surface of the case member 411 and rotatable in both directions according to the operation of inserting the actuator 3 in the operation portion 405 and the operation of extracting the actuator from the operation portion 405. An upper part of the driving cam 415 is formed with an engaging portion 415*a* in an outer periphery thereof. The engaging portion 415*a* is located at a position accessible from the actuator inlet port 409 such as to permit fitting insertion of the connecting peg 3*b* of the actuator 3.

A lower part of the driving cam 415 is formed with a cam curve portion 415*c* on an outer periphery thereof. The lower part of the driving cam is laterally formed with a guide slot 415*d* (equivalent to the "guide portion" of the invention), that is in the form of a cam curve and includes a large diameter portion and a small diameter portion. The driving cam 415 is formed with a cutaway 415*e* on an area where the guide slot 415*d* is formed, the cutaway extending from the outer periphery of the driving cam 415 toward the rotary shaft 413. The distal end of the working rod 21 (described hereinlater) is inserted in the cutaway 415*e*. It is noted that the driving cam 415 shown in the sectional view of FIG. 15 includes a partial sectional view showing a cross-section of the cutaway 415*e* and all the sectional views of the driving cam 415 that are referred to in the following description similarly include the partial cross-section of the cutaway, the description of which is dispensed with.

Disposed in the switch portion 407 under the operation portion 405 is the working rod 21, a distal end portion of which retractably projects into the operation portion 405. The cam pin 22 is orthogonally fixed to the distal end of the working rod. The cam pin 22 has each of the opposite ends thereof inserted through the guide slot 415*d* of the driving cam 415, so as to bring the working rod 21 into reciprocal movement in conjunction with the rotation of the driving cam 415. The cam pin 22 is moved along the guide slots 415*d* in conjunction with the rotation of the driving cam 415 thereby reciprocally moving the working rod 21 into or out of the operation portion 405 so that the first switch 39 of the built-in switching device 70 in the switch portion 407 is switched the open and closed positions.

The working rod 21 is formed with the connecting engagement portions 23 which are adapted to engageably divide the working rod 21 into the upper part (the operation portion 405) and the lower part (the switch portion 407). Therefore, the switch body 400 can be easily assembled by taking the steps of discretely fabricating the operation portion 405 having the upper part of the divided working rod 21 connected to the driving cam 415 and the switch portion 407 provided with the lower part of the divided working rod 21, and assembling the operation portion 405 with the switch portion 407 by connecting the working rod 21 into one piece by way of engagement between the connecting engagement portions 23 of the working rod 21. If the switch portion 407 suffers a failure requiring the replacement thereof, the switch body 400 can be easily restored by merely replacing only the switch portion 407.

Next, the switch portion 407 is described. As shown in FIG. 15, the case member 433 formed connectable with the case member 411 is combined with the case member 411 to form the whole body of the switch body 400 having a rectangular cuboid shape. The switch portion 407 includes the switching device 70 incorporating the first switch 39 therein, the above-described working rod 21 and the lock mechanism 460. The case member 411 is assembled to the case member 433 by way of, for example, a screw inserted through a through-hole in a peripheral wall of the case member 411 in a direction of insertion of the actuator 3 through the actuator inlet port 409 and threadably engaged with a female screw hole in the case member 433. Alternatively, the case member 411 may be locked to the case member 433 by way of a locking structure consisting of a locking claw and a locked portion.

By the way, the switching device 70 includes the first switch 39 switched between the open and closed positions in conjunction with the reciprocal movement of the working rod 21. The first switch 39 includes the movable contact 39*a* and the stationary contact 39*b*. The movable contact 39*a* is downwardly fixed to the working rod 21 in a manner to be integrally movable with the working rod 21. The stationary contact 39*b* is upwardly fixed to the frame member 43 disposed in the switching device 70. The first switch 39 is for enabling or disabling the power supply to the industrial machine. The electric power is supplied to the industrial machine by setting the first switch 39 to the closed position.

As shown in FIG. 15, the coil spring 50 is installed between the lower end of the working rod 21 and the frame member 43 thereby urging the working rod 21 upward or toward the operation portion 405. By urging the working rod 21 upward, the coil spring 50 urges the movable contact 39*a* of the first switch 39 away from the stationary contact 39*b* (open direction).

The cable (not shown) electrically connected to the industrial machine is attached to the case member 433 so that the cable and the first switch 39 are electrically interconnected in the switching device 70. The power supply to the industrial machine is enabled or disabled by the electric signal induced by switching on and off the first switch 39.

In the state of FIG. 15 where the actuator 3 is not inserted in the operation portion 405, the cam pin 22 has been moved along the guide slot 415*d* from the large diameter portion to the small diameter portion while the working rod 21 is moved to the operation portion 405 by the urging force of the coil spring 50. As the working rod 21 is moved to the operation portion 405, the movable contact 39*a* is also moved away from the stationary contact 39*b*. The movable contact 39*a* and the stationary contact 39*b* of the first switch 39 are spaced apart so that the first switch 39 is set to the open position to disable the power supply to the industrial machine. Thus the industrial machine is deactivated.

Next, the lock mechanism 460 is described. As shown in FIG. 15, the lock mechanism 460 is disposed in the case member 433 and to the right side of the operation portion 405. The lock mechanism includes the above-described locking member 461, a coil spring 463 for moving the locking member 461, a well-known driver (not shown) employing a solenoid or the like, and the second switch 40.

The locking member 461 of the lock mechanism 460 is adapted to move substantially orthogonally to the rotary shaft 413 of the driving cam 415 and between a rotation permission position shown in FIG. 15 and a rotation inhibition position shown in FIG. 16. When the locking member 461 is moved to the rotation inhibition position as shown in FIG. 16, the distal end 462 of the locking member is locked to the lock portion 415*f* formed at the driving cam 415 whereby the lock mechanism 460 inhibits the rotation of the driving cam 415 to establish a rotation inhibition mode. On the other hand, when the locking member 461 is moved to the rotation permission position shown in FIG. 15 and FIG. 17, the distal end 462 thereof is released from the locking relation with the lock portion 415*f* so that a rotation permission mode is established to permit the rotation of the driving cam 415.

The locking member 461 is urged leftward to the rotation inhibition position by the coil spring 463. By energizing the driver employing the solenoid or the like, on the other hand, the locking member 461 is moved rightward to the rotation permission position against the urging force of the coil spring 463.

If the driver is de-energized, the locking member 461 is urged leftward and moved to the rotation inhibition position by the coil spring 463 so as to inhibit the rotation of the driving cam 415, establishing the rotation inhibition mode, as shown in FIG. 16. If the driver is energized, on the other hand, the locking member 461 is moved rightward to the rotation permission position against the urging force of the coil spring 463 so as to permit the rotation of the driving cam 415, establishing the rotation permission mode.

With the actuator 3 inserted in the operation portion 405, the locking member 461 is moved leftward by the urging force of the coil spring 463 and locked to the lock portion 415*f* at the distal end 462 thereof, thereby inhibiting the rotation of the driving cam 415, as shown in FIG. 16. Thus, the operation of extracting the actuator 3 is inhibited. On the other hand, as shown in FIG. 17, with the actuator 3 inserted in the operation portion 405, the driver is energized to move the locking member 461 rightward against the urging force of the coil spring 463, whereby the distal end 462 is released from the locking relation with the lock portion 415*f* so that the rotation of the driving cam 415 is permitted. Thus, the operation of extracting the actuator 3 is permitted.

The second switch 40 includes a movable contact 40*a* and a stationary contact 40*b*. The movable contact 40*a* is leftwardly fixed to the locking member 461 in a manner to be integrally movable with the locking member 461. The stationary contact 40*b* is rightwardly fixed to a frame member (not shown) disposed in the case member 433. Hence, the movable contact 40*a* moves in tandem with the locking member 461 and in the same direction. When the locking member 461 is moved leftward or to the rotation inhibition position, the second switch 40 is set to the closed position When the locking member 461 is moved rightward or to the rotation permission position, the second switch 40 is set to the open position. Further, the operation of the locking member 461 can be detected by monitoring an electric signal from the second switch 40.

Next, an operation of the switch body 400 arranged as described above is described with reference to FIG. 15 to FIG. 17. In a case where the actuator 3 is not inserted in the operation portion 405 of the switch body 400, as shown in FIG. 15, the working rod 21 is moved to the operation portion 405 by the urging force of the coil spring 50. The first switch 39 is in the open position to disable the power supply to the industrial machine so that the industrial machine is deactivated. On the other hand, the locking member 461 has the distal end 462 thereof pushed toward the case member 433 by the periphery of the driving cam 415 so that the locking member is moved to the rotation permission position. Hence, the second switch 40 is in the open position.

Subsequently when the operation of inserting the actuator 3 by closing the protective door is performed to insert the actuator 3 in the operation portion 405 in the initial state shown in FIG. 15 through the actuator inlet port 409, the connecting peg 3*b* of the actuator 3 is engaged with the engaging portion 415*a* of the driving cam 415, as shown in FIG. 16. As the actuator 3 is inserted further, the driving cam 415 is rotated counter-clockwise. In conjunction with the rotation of the driving cam 415, the cam pin 22 is moved downward along the guide slot 415*d* against the urging force of the coil spring 50.

The downward movement of the cam pin 22 pushes down the working rod 21 into the switch portion 407 against the urging force of the coil spring 50. As the working rod 21 is moved further down, the movable contact 39*a* is moved into contact with the stationary contact 39*b*, switching the first switch 39 from the open position to the closed position. Thus, the first switch 39 is set to the closed position so that the electric power is supplied to the industrial machine such as the robot connected in series with the first switch 39. Hence, the industrial machine is actuated.

With the actuator 3 inserted in the operation portion 405, the locking member 461 is moved leftward to the rotation inhibition position by the urging force of the coil spring 463. The distal end 462 of the locking member is locked to the lock portion 415*f* to inhibit the rotation of the driving cam 415 or to establish the rotation inhibition mode wherein the operation of extracting the actuator 3 from the operation portion 405 is inhibited. In conjunction with the leftward movement of the locking member 461, the movable contact 40*a* is moved leftward, brought into contact with the stationary contact 40*b* to switch the second switch 40 from the open position to the closed position.

When, on the other hand, the well-known driver employing the solenoid or the like is energized to move the locking member 461 rightward to the rotation permission position against the urging force of the coil spring 463, as shown in FIG. 17, the driving cam 415 is set to the rotation permission mode. In conjunction with the rightward movement of the locking member 461, the movable contact 40*a* is moved rightward and away from the stationary contact 40*b*, switching the second switch 40 from the closed position to the open position. When the operation of extracting the actuator 3 by opening the protective door or such is performed with the driving cam 415 in the rotation permission mode, the inserted actuator 3 is extracted as shown in FIG. 15, while the driving cam 415 is rotated in the direction of extraction of the actuator 3 till the connecting peg 3*b* of the actuator 3 is disengaged from the engaging portion 415*a* of the driving cam 415. In conjunction with the rotation of the driving cam 415, the cam pin 22 is moved upward along the guide slot 415*d* from the large diameter portion to the small diameter portion. Thus, the working rod 21 is extracted from the switch portion 407.

The urging force of the coil spring 50 is combined with the pull-out force which derives from the rotation of the driving cam 415 and works to extract the working rod 21 from the switch portion 407. The combined force moves the working rod 21 in the opposite direction from the movement during the operation of inserting the actuator 3. Namely, the working rod 21 is extracted from the switch portion 407 and moved to the operation portion 405. Hence, the movable contact 39*a* is moved away from the stationary contact 39*b*, setting the first switch 39 to the open position so that the industrial machine is deactivated.

Similarly to the above-described third embodiment, this embodiment is provided with the permission structure for permitting at least the movement of the working rod 21 in the urging direction of the coil spring 50 when at least the operating force of the operation or the number of operations of extracting the actuator 3 exceeds the breakage tolerance for the switch body 400. As described above, if the working rod 21 is permitted to move in the urging direction of the coil spring 50 and thence is moved to the operation portion 405, the movable contact 39*a* of the first switch 39 is moved away from the stationary contact 39*b*. Accordingly, even if some external load is exerted on the driving cam 415 to thereby cause the breakage of the working rod 21 or some external load is exerted on the operation portion 405 to cause the breakage or dropout thereof, the movable contact 39*a* is assuredly moved away from the stationary contact 39*b* by the urging force of the coil spring 50, setting the first switch 39 to the open position. In addition to the above described examples where some external load causes the breakages or dropout, there is also a case where an external load is exerted on the working rod 21. During the operation of closing the protective door, the lock mechanism 460 operates concurrently with the insertion of the actuator 3 into the operation portion 405, inhibiting the extraction of the actuator 3 from the operation portion 405. At this time, the pull-out force derived from the rebounding force of the protective door closed too quickly is exerted on the actuator 3 and then on the driving cam and working rod. Now referring to FIG. 18 to FIG. 21, description is made on specific permission structures that permit the working rod 21 to move in the urging direction of the coil spring 50.

(9) Ninth Exemplary Operation

Figure 18:
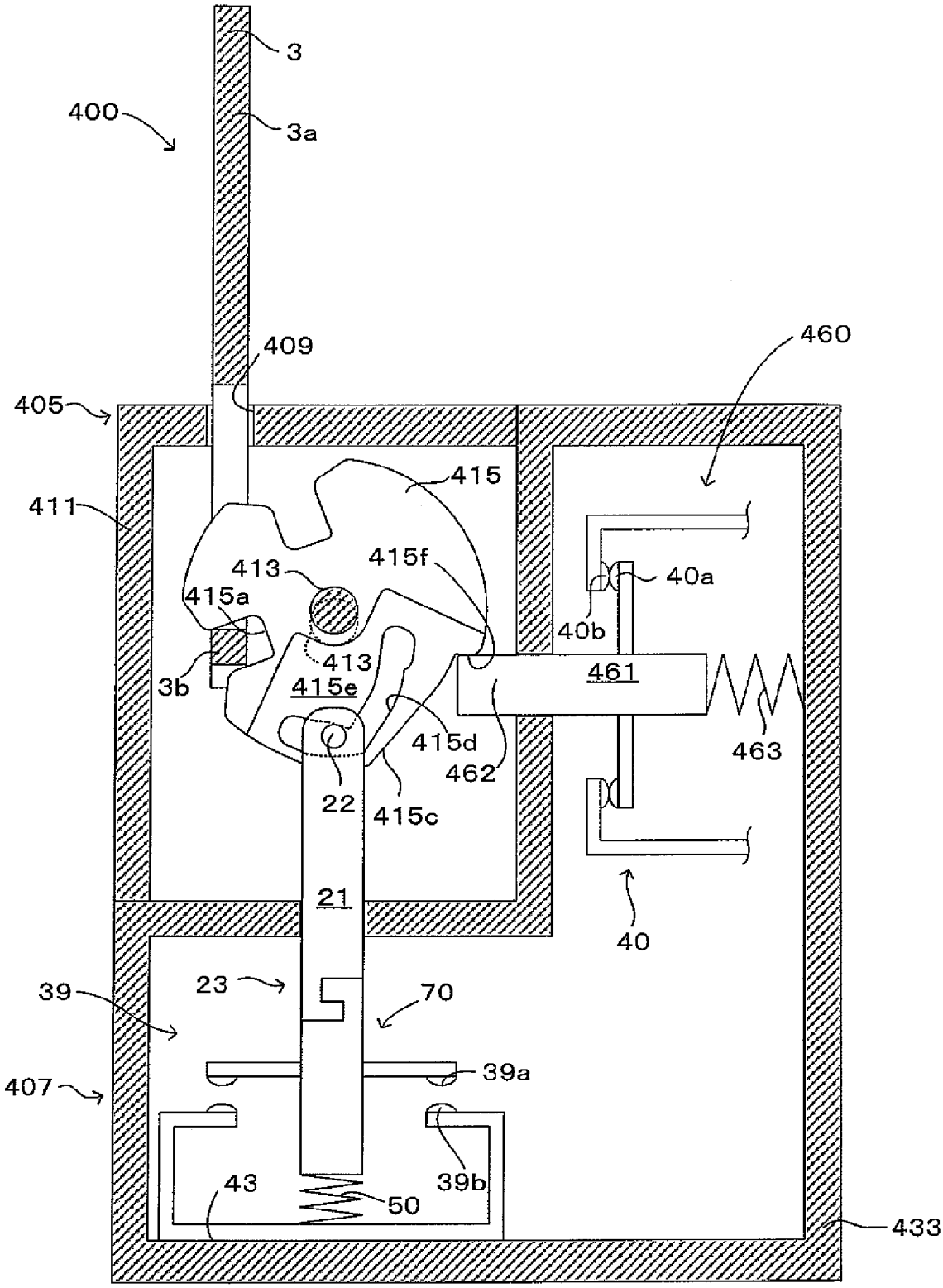
FIG. 18 is a sectional view showing the switch body according to the fourth embodiment of the invention.

FIG. 18 shows an example where the above-described permission structure for permitting the movement of the working rod 21 in the urging direction of the coil spring 50 is implemented in the rotary shaft 413 and the support portion (not shown) for supporting the rotary shaft 413 installed on the inside surface of the case member 411. As shown in FIG. 18, the permission structure is designed such that when the operation of forcibly extracting the actuator 3 from the operation portion 405 is performed with the lock mechanism 460 inhibiting the operation of extracting the actuator 3 so that the operating force of the extraction operation exceeds the breakage tolerance for the switch body 400, the rotary shaft 413 is released from the state supported by the support portion and the driving cam 415 is moved upward in the operation portion 405 whereby the working rod 21 is permitted to move in the urging direction of the coil spring 50. It is preferred that the specific arrangement of the permission structure is the same as that described with reference to the first exemplary operation of the first embodiment. Thus, the working rod 21 is moved to the operation portion 405 by the urging force of the coil spring 50 so that the movable contact 39*a* is assuredly moved away from the stationary contact 39*b*, setting the first switch 39 to the open position. It is noted that the rotary shaft 413 indicated by the dotted line in FIG. 18 represents the normal design position of the rotary shaft 413 normally supported by the support portion.

At this time, the locking member 461 is moved leftward to and maintained at the rotation inhibition position and hence, the second switch 40 stays in the closed position although the first switch 39 is switched from the closed position to the open position.

(10) Tenth Exemplary Operation

Figure 19:
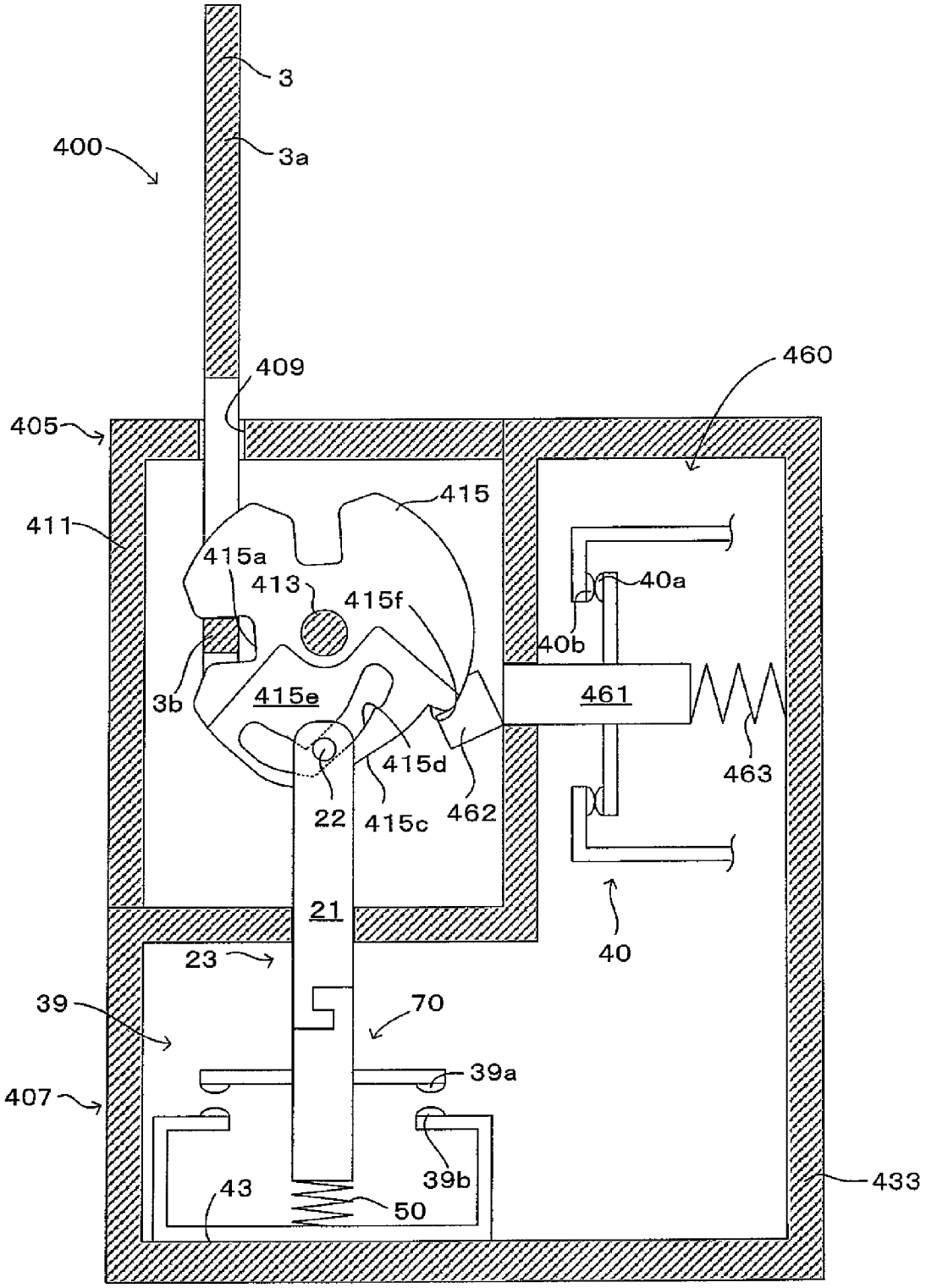
FIG. 19 is a sectional view showing the switch body according to the fourth embodiment of the invention.

FIG. 19 shows an example where the above-described permission structure for permitting the movement of the working rod 21 in the urging direction of the coil spring 50 is implemented in the lock mechanism 460 for inhibiting the rotation of the driving cam 415. As shown in FIG. 19, the permission structure is designed such that when the operating force of the extraction operation exceeds the breakage tolerance for the switch body 400 because the operation of forcibly extracting the actuator 3 from the operation portion 405 is performed while the lock mechanism 460 inhibits the operation of extracting the actuator 3, the distal end 462 of the locking member 461 is broken to release the driving cam 415 from the rotation inhibition by the lock mechanism 460 so that the driving cam 150 is rotated clockwise, permitting the movement of the working rod 21 in the urging direction of the coil spring 50. Specifically, it is preferred that the distal end 462 of the locking member 461 is made prone to breakage by partially forming a notch or such, facilitating the permission of the movement of the working rod 21. Thus, the working rod 21 is moved to the operation portion 405 by the urging force of the coil spring 50 so that the movable contact 39*a* is assuredly moved away from the stationary contact 39*b*, setting the first switch 39 to the open position.

At this time, the locking member 461 is moved leftward to and maintained at the rotation inhibition position and hence, the second switch 40 stays in the closed position although the first switch 39 is switched from the closed position to the open position.

(11) Eleventh Exemplary Operation

Figure 20:
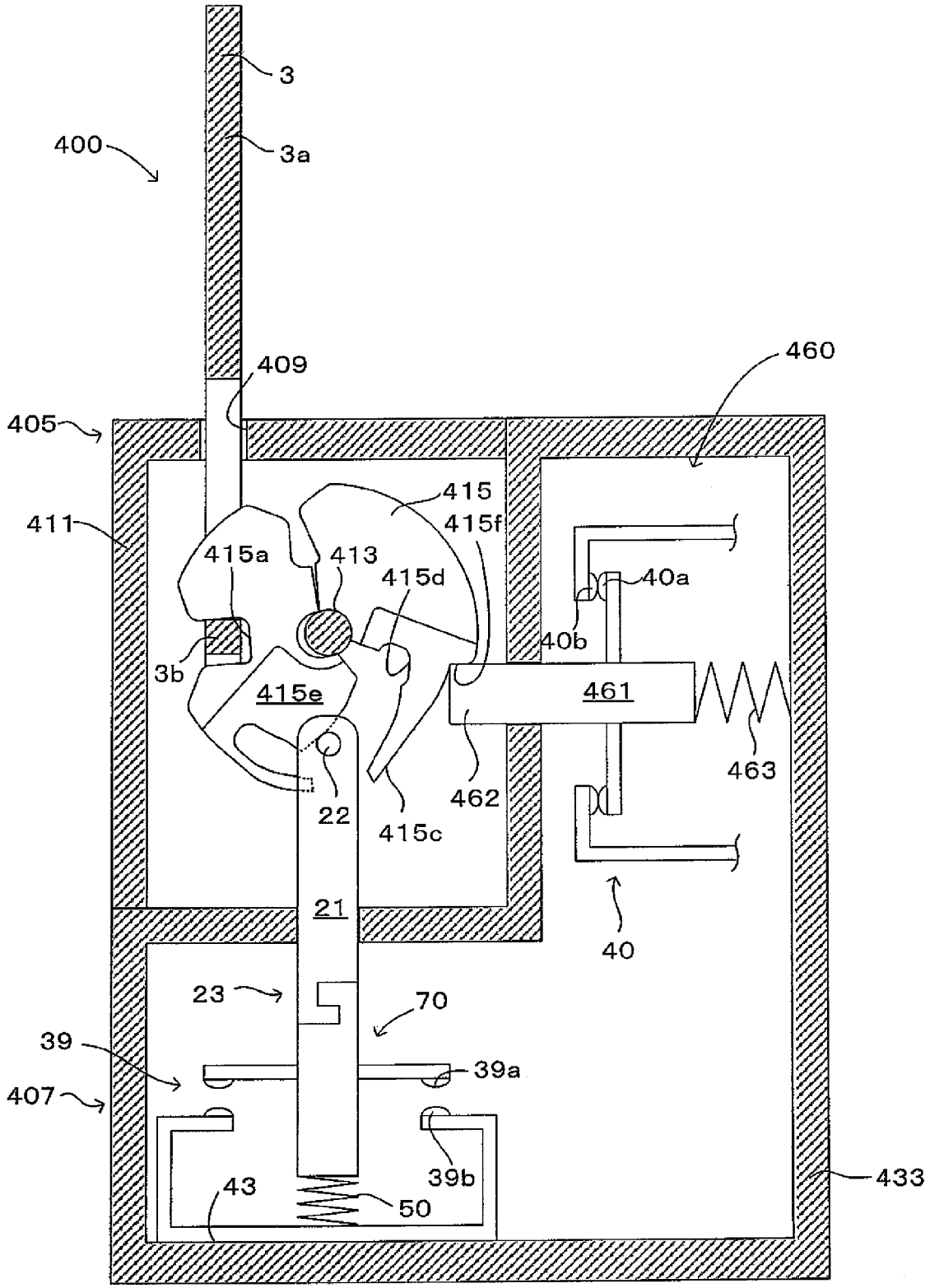
FIG. 20 is a sectional view showing the switch body according to the fourth embodiment of the invention.

FIG. 20 shows an example where the above-described permission structure for permitting the movement of the working rod 21 in the urging direction of the coil spring 50 is implemented in the driving cam 415. As shown in FIG. 20, the permission structure is designed such that when the operation of forcibly extracting the actuator 3 from the operation portion 405 is performed with the lock mechanism 460 inhibiting the operation of extracting the actuator 3 so that the operating force of the extraction operation exceeds the breakage tolerance for the switch body 400, the driving cam 415 is broken to release the working rod 21 from the push toward the switch portion 407 by the driving cam 415. Thus, the working rod 21 is permitted to move in the urging direction of the coil spring 50. Specifically, it is preferred that the driving cam 415 is made prone to breakage by partially forming a notch or such, facilitating the permission of the movement of the working rod 21. Thus, the working rod 21 is moved to the operation portion 405 by the urging force of the coil spring 50 so that the movable contact 39*a* is assuredly moved away from the stationary contact 39*b*, setting the first switch 39 to the open position.

At this time, the locking member 461 is moved leftward to and maintained at the rotation inhibition position and hence, the second switch 40 stays in the closed position although the first switch 39 is switched from the closed position to the open position.

(12) Twelfth Exemplary Operation

Figure 21:
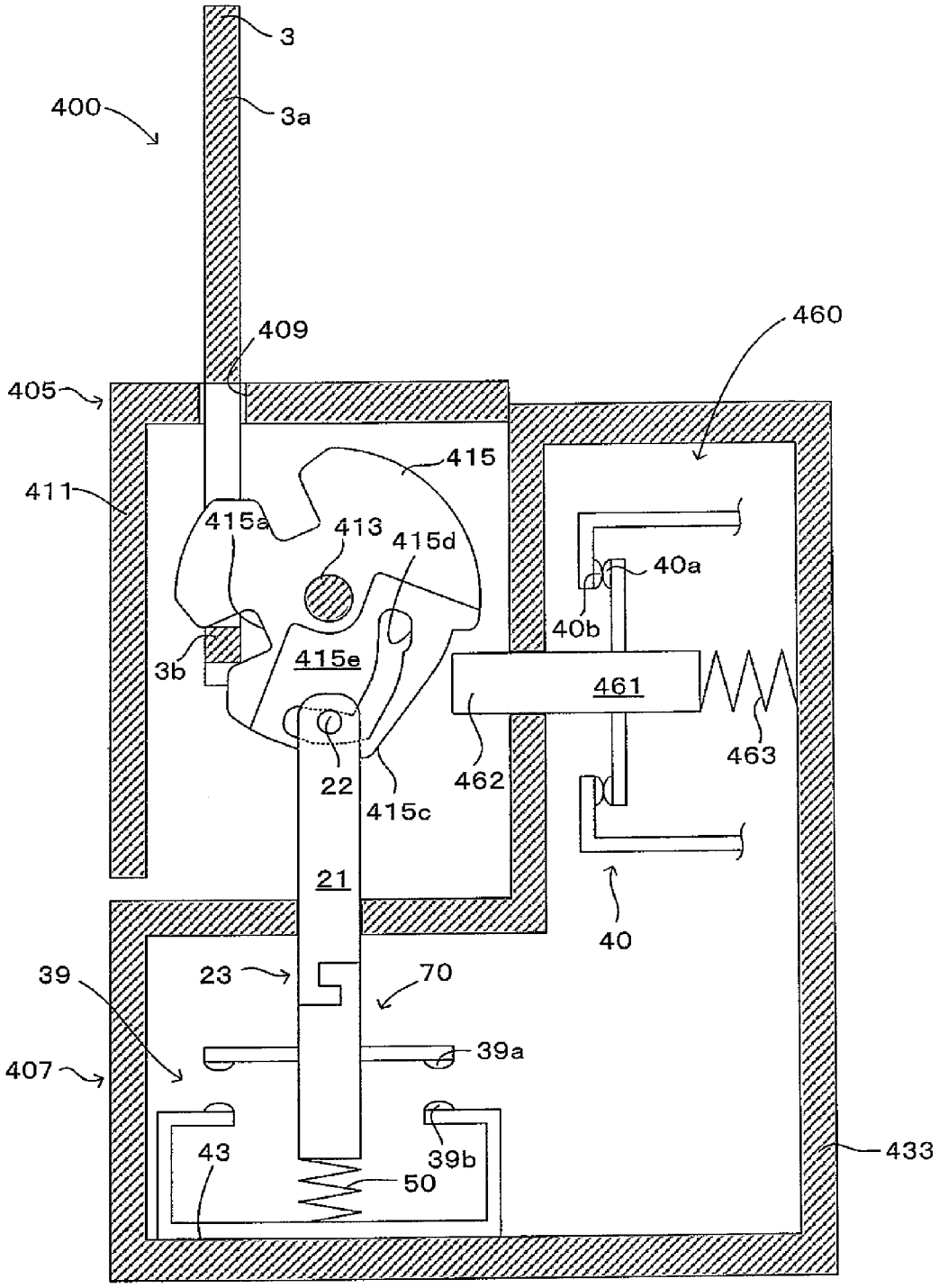
FIG. 21 is a sectional view showing the switch body according to the fourth embodiment of the invention.

FIG. 21 shows an example where the above-described permission structure for permitting the movement of the working rod 21 in the urging direction of the coil spring 50 is implemented in the connecting portion between the operation portion 405 and the switch portion 407. As shown in FIG. 21, the permission structure is designed such that when the operation of forcibly extracting the actuator 3 from the operation portion 405 is performed with the lock mechanism 460 inhibiting the operation of extracting the actuator 3 so that the operating force of the extraction operation exceeds the breakage tolerance for the switch body 400, the operation portion 405 and the switch portion 407 are released from the connecting relation and separated from each other, whereby the working rod 21 is permitted to move in the urging direction of the coil spring 50. It is preferred that the specific arrangement of the permission structure is the same as that described with reference to the second exemplary operation of the first embodiment. Thus, the working rod 21 is moved to the operation portion 405 by the urging force of the coil spring 50 so that the movable contact 39*a* is assuredly moved away from the stationary contact 39*b*, setting the first switch 39 to the open position.

At this time, the locking member 461 is moved leftward to and maintained at the rotation inhibition position and hence, the second switch 40 stays in the closed position although the first switch 39 is switched from the closed position to the open position.

As described above, this embodiment can offer the same effects as those of the above third embodiment. Even if the operation of forcibly extracting the actuator 3 or such is performed when the lock mechanism 460 inhibits the rotation of the driving cam 415, the breakdown of the permission structure for permitting the movement of the working rod 21 in the urging direction of the coil spring 50 provides permission for the working rod 21 to be moved by the urging force of the coil spring 50. Hence, the movable contact 39*a* is moved away from the stationary contact 39*b*, setting the first switch 39 to the open position. However, the open/closed position of the second switch 40 does not change because the driving cam 415 is not released from the rotation inhibition by the lock mechanism 460. Accordingly, some abnormality of the safety switch can be reliably detected by determining that only the first switch 39 is changed in the open/closed position while the second switch 40 stays unchanged in the open/closed position.

Fifth Embodiment

Figure 22A:
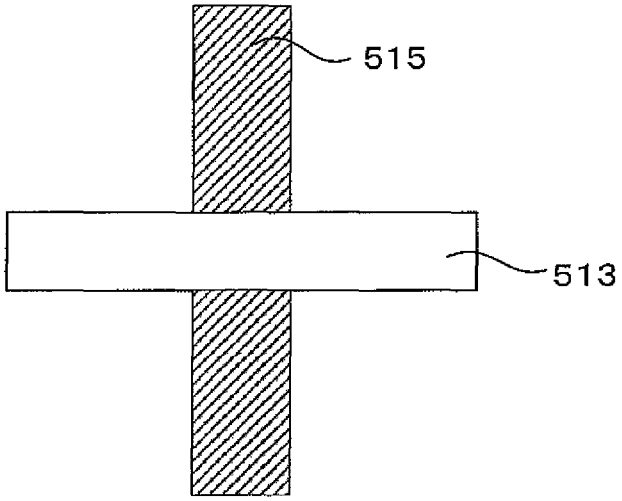
FIGS. 22A and 22B are enlarged views showing a principal part of a switch body according to a fifth embodiment of the invention.

A safety switch according to a fifth embodiment of the invention is described with reference to FIG. 22. FIG. 22 illustrates the fifth embodiment of the invention. FIG. 22A is an enlarged side view showing a principal part of a permission structure before breakage, while FIG. 22B is an enlarged side view showing the principal part of the permission structure after breakage.

According to the fifth embodiment, the permission structure of the invention is implemented in a rotary shaft 513 of a driving cam 515. Since the other components and the operations thereof are the same as in the first embodiment, the following description will principally detail the differences from the first embodiment referring to FIG. 1 and FIG. 2, as well. It is noted that like reference characters refer to the corresponding components of the first embodiment and the description thereof and of the operations thereof is dispensed with. FIG. 22 omits the depiction of a part of the structure of the switch body 1.

Similarly to the foregoing embodiments, the rotary shaft 513 is supported on the inside surface of the case member 11 while the driving cam 515 is installed in the operation portion in a manner to be rotatable in both directions according to the operation of inserting the actuator 3 in the operation portion 5 and the operation of extracting the actuator 3 from the operation portion as shown in FIG. 22A.

Figure 22B:
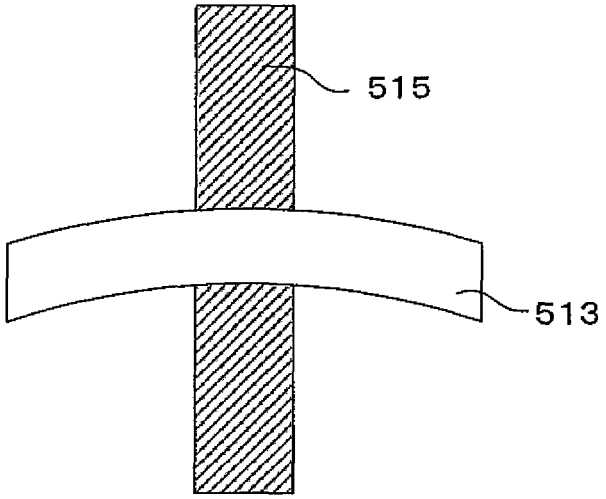

As shown in FIG. 22*b*, when at least the operating force of the operation or the number of operations of extracting the actuator 3 exceeds the breakage tolerance for the switch body 1 (rotary shaft 513), the pull-out force works on the rotary shaft 513 in a direction to extract the actuator 3 from the operation portion 5 so that the rotary shaft 513 is bent upward and broken. Hence, the driving cam 515 is moved upward relative to the switch portion (not shown) so that the working rod 21 is permitted to move in the urging direction of the coil spring 50. Accordingly, the working rod 21 is moved to the operation portion 5 by the urging force of the coil spring 50, moving the movable contact 39*a* away from the stationary contact 39*b*. Thus, the first switch 39 is assuredly set to the open position.

The rotary shaft 513 is made such that once broken by bending, the rotary shaft maintains the bent shape. Therefore, if the rotary shaft 513 is broken, the driving cam 515 is maintained at position displaced upward from a predetermined design position relative to the switch portion. Inserting the actuator 3 in this state does not effect the normal operation of the driving cam 515. Thus, the working rod 21 is inhibited from moving and thence from bringing the movable contact 39*a* into contact with the stationary contact 39*b*.

As just described, the rotary shaft 513 according to the fifth embodiment is designed to function as the "permission structure" and "means for inhibiting contact of movable contact with stationary contact" of the invention.

As described above, the fifth embodiment can offer the same effects as those of the first embodiment. Furthermore, the embodiment also offers the following effect. When the rotary shaft 513 as the permission structure for permitting the movement of the working rod 21 in the urging direction of the coil spring 50 is broken by bending, the rotary shaft 513 is maintained in the bent shape (broken state). Hence, the operation of inserting the actuator 3 is inhibited from operating the driving cam 515 to move the working rod 21 so that the working rod 21 is inhibited from bringing the movable contact 39*a* into contact with the stationary contact 39*b*. Hence, the first switch 39 can be assuredly prevented from being switched to the closed position when the operation of inserting the actuator 3 is performed in spite of the occurrence of some abnormality in the safety switch.

The permission structure of the fifth embodiment may be applied to the foregoing embodiments. Similarly to the permission structure of the fifth embodiment, the permission structures described in the foregoing embodiments are also capable of functioning, when broken, as the means for inhibiting the movable contact 39*a* from being brought into contact with the stationary contact 39*b* by the working rod 21 moved in conjunction with the operation of inserting the actuator 3.

Sixth Embodiment

Figure 23A:
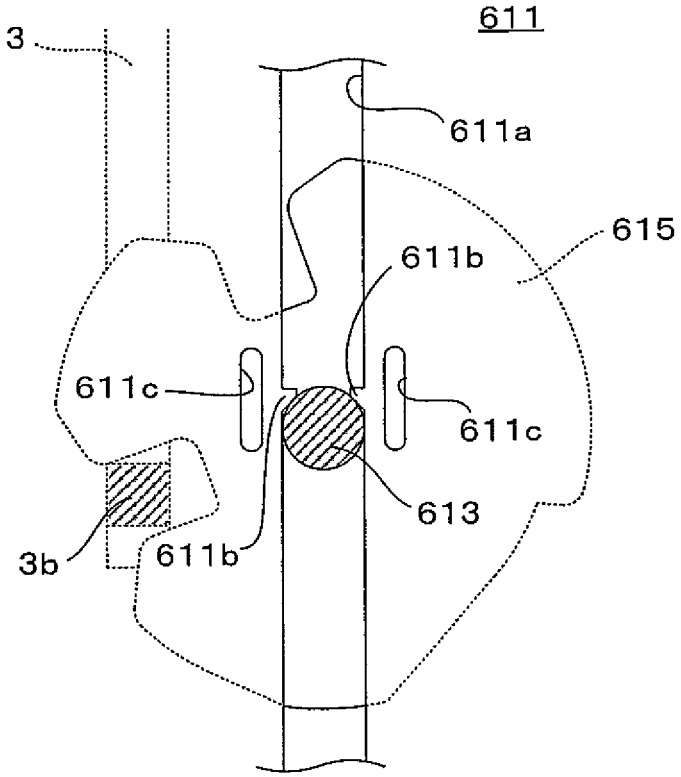
FIGS. 23A and 23B are enlarged views showing a principal part of a switch body according to a sixth embodiment of the invention.

A safety switch according to a sixth embodiment of the invention is described with reference to FIG. 23. FIG. 23 illustrates the sixth embodiment of the invention. FIG. 23A is an enlarged front view showing a principal part of a permission structure before breakage, while FIG. 22B is an enlarged front view showing the principal part of the permission structure after breakage.

According to the sixth embodiment, the permission structure of the invention is implemented in a support portion for supporting a rotary shaft 613 of a driving cam 615. Since the other components and the operations thereof are the same as in the first embodiment, the following description will principally detail the differences from the first embodiment referring to FIG. 1 and FIG. 2, as well. It is noted that like reference characters refer to the corresponding components of the first embodiment and the description thereof and of the operations thereof is dispensed with. FIG. 23 omits the depiction of a part of the structure of the switch body 1.

Similarly to the foregoing embodiments, as shown in FIG. 23A, the rotary shaft 613 is supported on lower sides of support lugs 611*b* formed at two places on a support groove 611*a* formed in an inside surface of a case member 611, while the driving cam 615 is installed in the operation portion 5 in a manner to be rotatable in both directions according to the operation of inserting the actuator 3 in the operation portion 5 and the operation of extracting the actuator 3 from the operation portion 5.

Figure 23B:
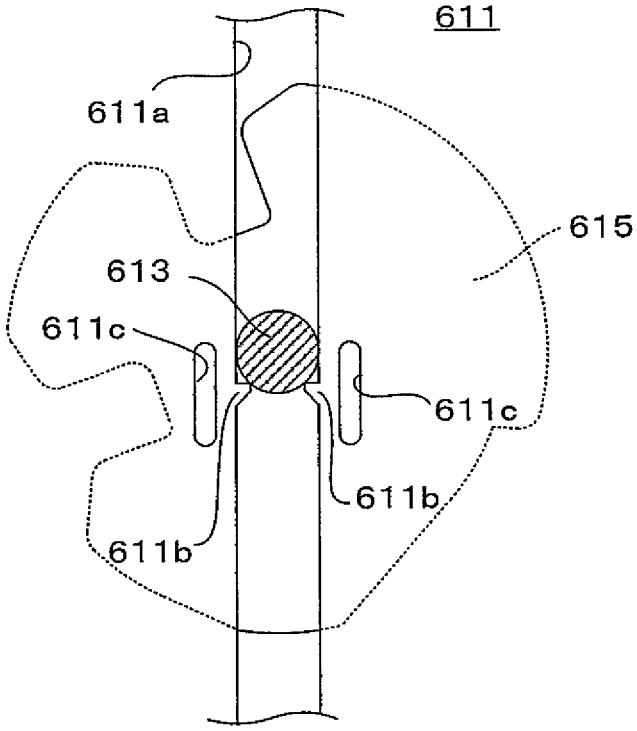

The case member 611 is further formed with elastically deformable slots 611*c* in correspondence to the respective support lugs 611*b* formed at two places on the support groove 611*a*. When at least the operating force of the operation or the number of operations of extracting the actuator 3 exceeds the breakage tolerance for the switch body 1 (support lugs 611*b*), the slots 611*c* formed in the case member 611 are elastically or plastically deformed so that the individual support lugs 611*b* are moved outward and broken, as shown in FIG. 23B. Hence, the rotary shaft 613 is released from the state supported by the support lugs 611*b*. At this time, the pull-out force works in the direction to extract the actuator 3 from the operation portion 5 so that the driving cam 615 is moved upward relative to the switch portion 7, permitting the movement of the working rod 21 in the urging direction of the coil spring 50. Thus, the working rod 21 is moved to the operation portion 5 by the urging force of the coil spring 50, moving the movable contact 39*a* away from the stationary contact 39*b*. Hence, the first switch 39 can be assuredly set to the open position.

After the driving cam 615 is moved up, the support lugs 611*b* return to the original positions thereof so that the rotary shaft 613 is supported from below by the support lugs 611*b* returned to the original positions. Once the rotary shaft 613 is moved up, the driving cam 615 is maintained at the position displaced upward from the predetermined design position relative to the switch portion. Therefore, inserting the actuator 3 in this state does not effect the normal operation of the driving cam 615. That is, the driving cam is inhibited from moving the working rod 21 and thence, the working rod is inhibited from bringing the movable contact 39*a* into contact with the stationary contact 39*b*.

As just described, the support groove 611*a*, support lugs 611*b* and slots 611*c* of the sixth embodiment are designed to function as the "permission structure" and the "means for inhibiting contact of movable contact with stationary contact" of the invention.

As described above, the sixth embodiment can offer the same effects as those of the first embodiment. Furthermore, the embodiment also offers the following effect. In the event of a deforming failure of the support lugs 611*b* as the permission structure for permitting the movement of the working rod 21 in the urging direction of the coil spring 50, the broken support lugs 611*b* are returned to the original positions by the elastic force derived from the deformation of the slots 611*c* so that the rotary shaft 613 is supported from below to maintain the driving cam 615 at the position displaced upward. This inhibits the operation of insertion of the actuator 3 from driving the driving cam 615 to move the working rod 21, thus disabling the working rod 21 to bring the movable contact 39*a* into contact with the stationary contact 39*b*. Hence, the first switch 39 can be assuredly prevented from being switched to the closed position when the operation of inserting the actuator 3 is performed in spite of the occurrence of some abnormality in the safety switch.

The permission structure of the sixth embodiment may be applied to the foregoing embodiments.

Seventh Embodiment

Figure 24A:
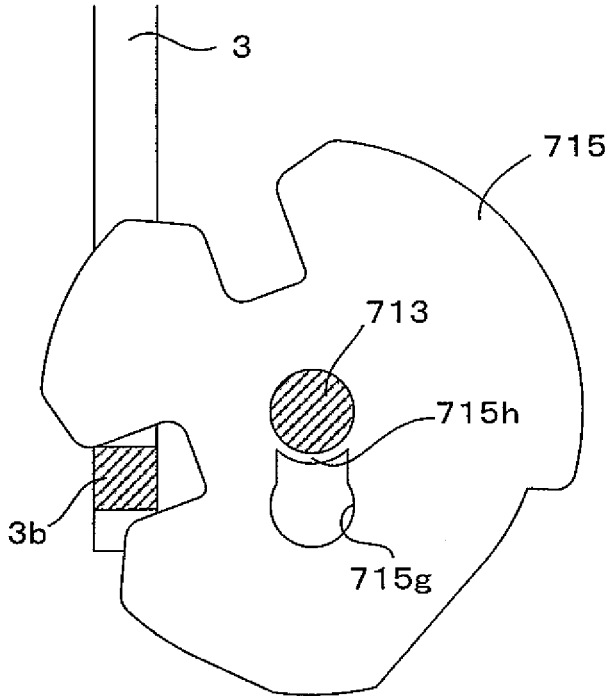
FIGS. 24A and 24B are enlarged views showing a principal part of a switch body according to a seventh embodiment of the invention.

A safety switch according to a seventh embodiment of the invention is described with reference to FIG. 24. FIG. 24 illustrates the seventh embodiment of the invention. FIG. 24A is an enlarged front view showing a principal part of a permission structure before breakage, while FIG. 23B is an enlarged front view showing the principal part of the permission structure after breakage.

According to the seventh embodiment, the permission structure of the invention is implemented in a support portion for supporting a rotary shaft 713 of a driving cam 715. Since the other components and the operations thereof are the same as in the first embodiment, the following description will principally detail the differences from the first embodiment referring to FIG. 1 and FIG. 2, as well. It is noted that like reference characters refer to the corresponding components of the first embodiment and the description thereof and of the operations thereof is dispensed with. FIG. 24 omits the depiction of a part of the structure of the switch body 1.

Similarly to the foregoing embodiments, the rotary shaft 713 is supported by the support portion provided on the inside surface of the case member 11, as shown in FIG. 24A, while the driving cam 715 is installed in the operation portion in a manner to be rotatable in both directions according to the operation of inserting the actuator 3 in the operation portion 5 and the operation of extracting the actuator 3 from the operation portion 5.

According to the embodiment, the driving cam 715 is formed with a support slot 715*g* defined by vertically arranged two holes having a suitable size to permit the insertion of the rotary shaft 713 and communicated with each other. Further, the driving cam 715 is integrally formed with a bridge strip 715*h* at a boundary between the upper and lower holes of the support slot 715*g*. That is, the rotary shaft 713 is supported in the upper hole.

Figure 24B:
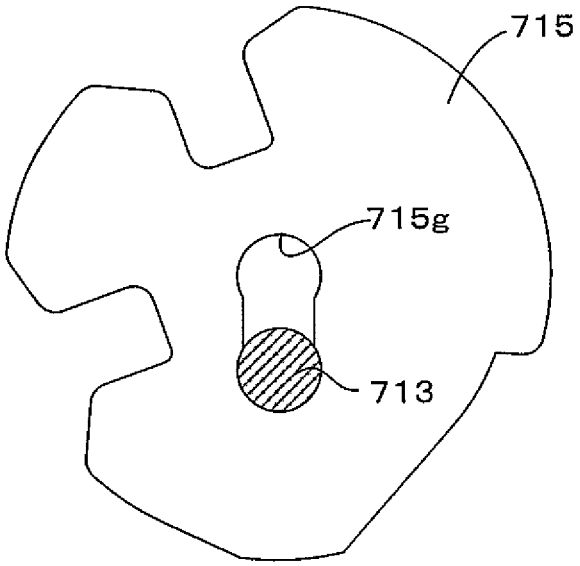

When at least the operating force of the operation or the number of operations of extracting the actuator 3 exceeds the breakage tolerance for the switch body 1 (bridge strip 715*h*), the pull-out force works in the direction of extracting the actuator 3 from the operation portion 5 so as to rupture the bridge strip 715*h* formed in the support slot 715*g* of the driving cam 715, as shown in FIG. 24B. Hence, the driving cam 715 is moved upward relative to the switch body 7 so that the working rod 21 is permitted to move in the urging direction of the coil spring 50. Thus, the working rod 21 is moved to the operation portion 5 by the urging force of the coil spring 50, moving the movable contact 39*a* away from the stationary contact 39*b*. The first switch 39 can be assuredly set to the open position.

The size of the support slot 715*g* is defined such that after the driving cam 715 is moved up relative to the switch portion 7, the rotary shaft 713 is supported in the lower hole of the support slot 715*g* and maintained in this support position. Once the driving cam 715 is moved up, therefore, the driving cam 715 is maintained at the position displaced upward from the predetermined design position relative to the switch portion 7. Inserting the actuator 3 in this state does not effect the normal operation of the driving cam 715. That is, the driving cam is inhibited from moving the working rod 21 and thence, the working rod is inhibited from bringing the movable contact 39*a* into contact with the stationary contact 39*b*.

As just described, the support slot 715*g* and bridge strip 715*h* of the seventh embodiment are designed to function as the "permission structure" and the "means for inhibiting contact of movable contact with stationary contact" of the invention.

As described above, the seventh embodiment can offer the following effect. In the event of a rupture failure of the bridge strip 715*h* as the permission structure for permitting the movement of the working rod 21 in the urging direction of the coil spring 50, the driving cam 715 is moved upward relative to the switch portion 7 and maintained at the position displaced upward because the rotary shaft 713 is supported in the lower hole of the support slot 715*g*. This inhibits the operation of insertion of the actuator 3 from driving the driving cam 615 to move the working rod 21, thus disabling the working rod 21 to bring the movable contact 39*a* into contact with the stationary contact 39*b*. Hence, the first switch 39 can be assuredly prevented from being switched to the closed position when the operation of inserting the actuator 3 is performed in spite of the occurrence of some abnormality in the safety switch.

The permission structure of the seventh embodiment may be applied to the foregoing embodiments.

Eighth Embodiment

Figure 25A:
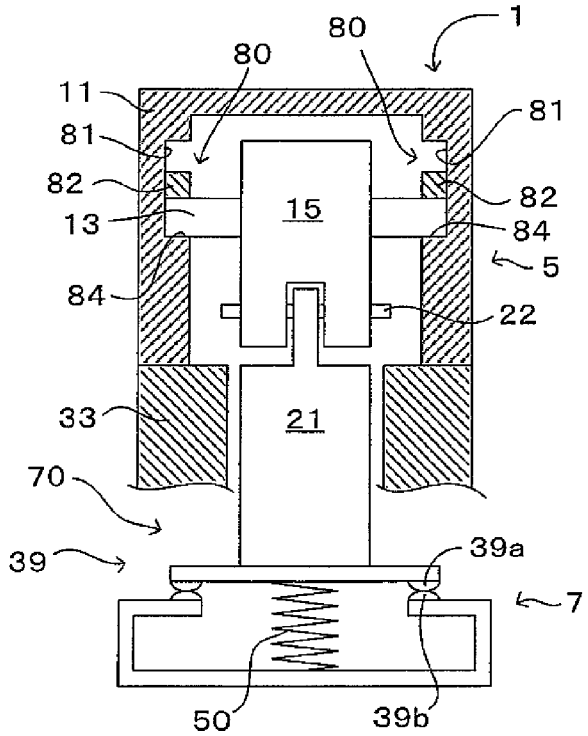
FIGS. 25A and 25B are enlarged views showing a principal part of a switch body according to an eighth embodiment of the invention.
Figure 25B:
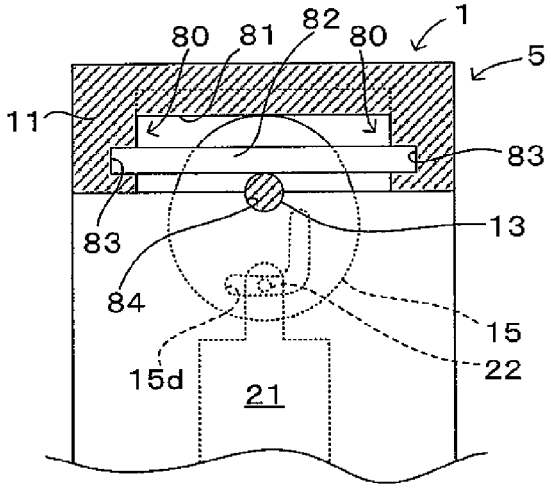
Figure 26A:
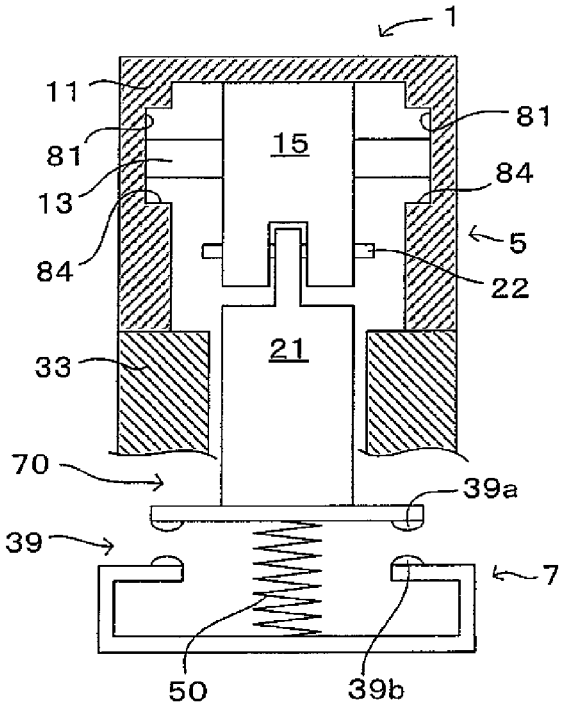
FIGS. 26A and 26B are enlarged views showing the principal part of the switch body according to the eighth embodiment of the invention.
Figure 26B:
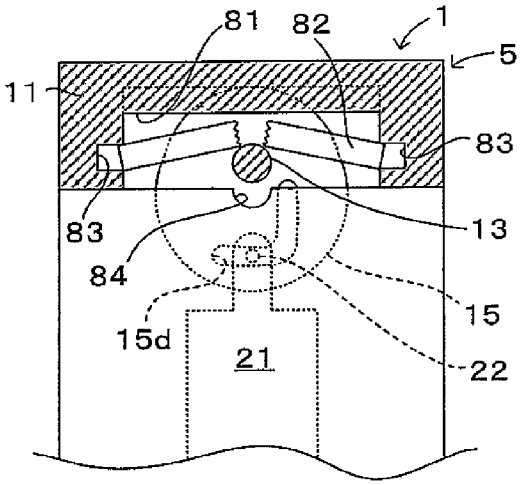

A safety switch according to an eighth embodiment of the invention is described with reference to FIG. 25 and FIG. 26. FIG. 25 and FIG. 26 illustrate the eighth embodiment of the invention. FIG. 25A and FIG. 26A are enlarged side views of a principal part as seen from the left side, while FIG. 25B and FIG. 26B are enlarged views of the principal part as seen from the front. FIG. 25A and FIG. 26A each show the switch body in a different state.

According to the eighth embodiment, the permission structure of the invention is implemented in a support portion 80 for rotatably supporting the driving cam 15 on the inside surface of the case member 11. Since the other components and the operations thereof are the same as in the first embodiment, the following description will principally detail the differences from the first embodiment referring to FIG. 1 and FIG. 2, as well. It is noted that like reference characters refer to the corresponding components of the first embodiment and the description thereof and of the operations thereof is dispensed with. FIG. 25 and FIG. 26 omit the depiction of a part of the structure of the switch body 1.

As shown in FIG. 25A and FIG. 25B, the support portion 80 includes rectangular cuboid cavities 81 formed in respective inside surfaces of front and rear sides of the case member 11, and support rods 82 disposed in the respective cavities 81. A pair of fit portions 83 for supporting the opposite ends of the support rod 82 is formed in lateral inside surfaces of each of the cavities 81 formed on the front side and the rear side. The support rod 82 has the opposite ends fitted in the pair of fit portions 83 whereby the support rod 82 is supported in each of the cavities 81 on the front side and rear side.

Semicircular recesses 84 for supporting the opposite ends of the rotary shaft 13 of the driving cam 15 are formed in respective inside surfaces of lower sides of the cavities 81 formed on the front side and rear side. In the cavities 81 formed on the front side and rear side of the case member 11, the opposite ends of the rotary shaft 13 are vertically clamped between the support rods 82 and the recesses 84, respectively, whereby the driving cam 15 is rotatably supported by the support portion 80 on the inside surface of the case member 11.

According to the safety switch having this structure, when the actuator 3 is not inserted in the operation portion 5 of the switch body 1, the working rod 21 is moved to the operation portion 5 by the urging force of the coil spring 50 while the first switch 39 of the switching device 70 is in the open position to disable the power supply to the industrial machine. Hence, the industrial machine is deactivated.

Subsequently when the operation of inserting the actuator 3 by closing the protective door or such is performed to insert the actuator 3 in the operation portion 5 through the actuator inlet port 9*a*, for example, the connecting peg 3*b* of the actuator 3 is engaged with the engaging portion 15*a* of the driving cam 15. As the actuator 3 is inserted further, the driving cam 15 is rotated counter-clockwise. In conjunction with the rotation of the driving cam 15, the cam pin 22 is moved downward along the guide slot 15*d* against the urging force of the coil spring 50.

The downward movement of the cam pin 22 pushes down the working rod 21 into the switch portion 7 against the urging force of the coil spring 50. As the working rod 21 is moved further down, the movable contact 39*a* is moved into contact with the stationary contact 39*b*, switching the first switch 39 from the open position to the closed position. Accordingly, the first switch 39 of the switching device 70 is set to the closed position, as shown in FIG. 25A, so that the electric power is supplied to the industrial machine such as the robot connected in series with the first switch 39. Hence, the industrial machine is actuated.

When, on the other hand, the inserted actuator 3 is extracted by the operation of extracting the actuator 3 by opening the protective door, for example, the driving cam 15 is rotated in the direction of extraction of the actuator 3 till the connecting peg 3*b* of the actuator 3 is disengaged from the engaging portion 15*a* of the driving cam 15. In conjunction with the rotation of the driving cam 15, the cam pin 22 is moved upward from the large diameter portion to the small diameter portion along the guide slot 15*d*. The upward movement of the cam pin 22 moves the working rod 21 in the direction to extract the working rod from the switch portion 7.

The urging force of the coil spring 50 is combined with the pull-out force which derives from the rotation of the driving cam 15 driven by the operation of extracting the actuator 3 and works to extract the working rod 21 from the switch portion 7. The combined force moves the working rod 21 in the opposite direction from the movement thereof during the operation of inserting the actuator 3. Namely, the working rod 21 is extracted from the switch portion 7 and moved to the operation portion 5. Hence, the movable contact 39*a* is moved away from the stationary contact 39*b*, setting the first switch 39 to the open position so that the industrial machine is deactivated.

According to the embodiment, when at least the operating force of the operation or the number of operations of extracting the actuator 3 exceeds the breakage tolerance for the support rod 82 of the support portion 80, the support rod 82 breaks down to permit the movement of the working rod 21 in the urging direction of the coil spring 50. If the working rod 21 is permitted to move in the urging direction of the coil spring 50 and is moved to the operation portion 5, as described above, the movable contact 39*a* of the first switch 39 is moved away from the stationary contact 39*b*.

Namely, the support portion 80 (support rod 82) for supporting the rotary shaft 13 of the driving cam 15 on the inside surface of the case member 11 is provided as the permission structure which breaks down to permit the movement of the working rod 21 in the urging direction of the coil spring 50. When the operating force of the operation or the number of operations of extracting the actuator 3 exceeds the breakage tolerance for the support rod 82, the support rod 82 is broken to release the rotary shaft 13 from the state supported by the support portion 80, as shown in FIG. 26B. Furthermore, the force of extracting the actuator 3 from the operation portion 5 works to move up the driving cam 15 in the operation portion 5. Thus, the working rod 21 is permitted to move in the urging direction of the coil spring 50.

When the movement of the working rod 21 in the urging direction of the coil spring 50 is permitted by the breakage of the support portion 80 (permission structure), the following pull-out forces are added to the urging force of the coil spring 50. The pull-out forces include a force which works to extract the working rod 21 from the switch portion 7 and which derives from the cam pin 22 moved upward along the guide slot 15 from the large diameter portion to the small diameter portion in conjunction with the operation of extracting the actuator 3 performed till the breakage of the support portion 80, and a force which works to extract, from the switch portion 7, the driving cam 15 and the working rod 21 connected thereto with the cam pin 22 and which derives from the driving cam 15 moved upward in the operation portion 5 after the breakage of the support portion 80. The combined force assuredly moves the working rod 21 to the operation portion 5 so that the movable contact 39*a* is assuredly moved away from the stationary contact 39*b*, setting the first switch to the open position.

As described above, this embodiment can offer the same effects as those of the first embodiment.

Ninth Embodiment

Figure 27A:
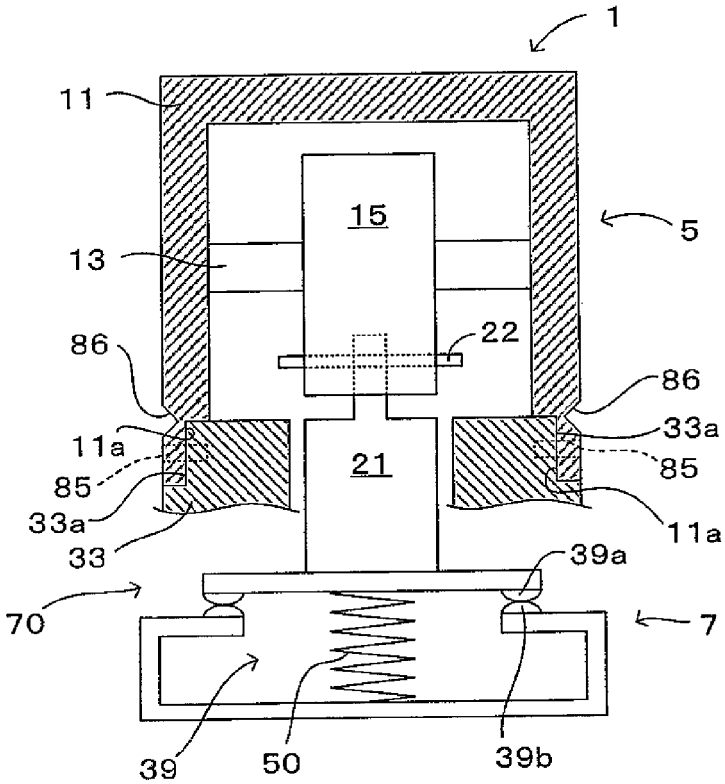
FIGS. 27A and 27B are enlarged views showing a principal part of a switch body according to a ninth embodiment of the invention.
Figure 27B:
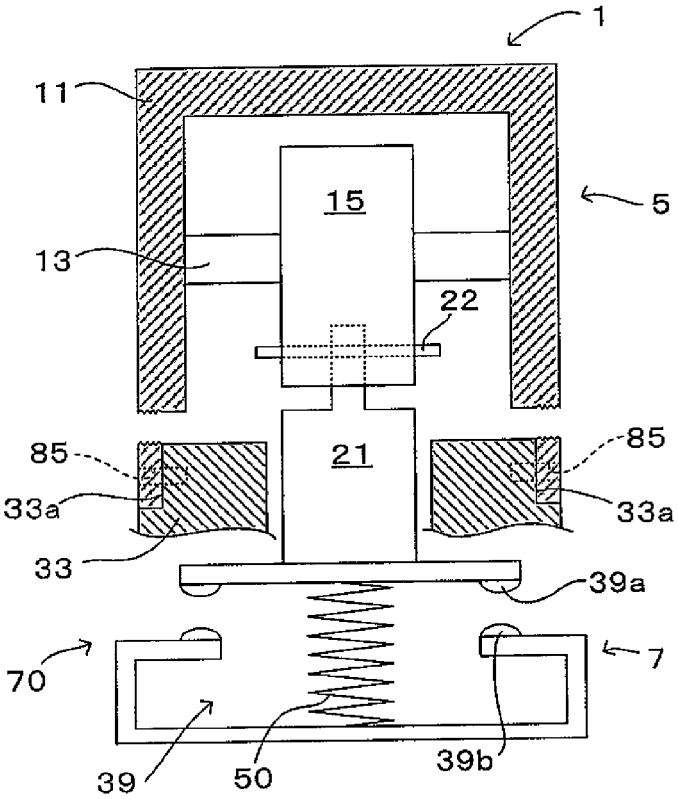

A safety switch according to a ninth embodiment of the invention is described with reference to FIG. 27. FIG. 27 illustrates the ninth embodiment of the invention. FIG. 27A and FIG. 27B are enlarged side views of a principal part as seen from the left side. FIG. 27A and FIG. 27B each show the switch body in a different state.

According to the ninth embodiment, the case member 33 defining the switch portion 7 is formed connectable with the case member 11 defining the operation portion 5, while the permission structure of the invention is implemented in the connecting portion between the operation portion 5 and the switch portion 7. Since the other components and the operations thereof are the same as in the first embodiment, the following description will principally detail the differences from the first embodiment referring to FIG. 1 and FIG. 2, as well. It is noted that like reference characters refer to the corresponding components of the first embodiment and the description thereof and of the operations thereof is dispensed with. FIG. 27 omits the depiction of apart of the structure of the switch body 1.

As shown in FIG. 27A, an engaging portion 11*a* is defined by forming a step along an inside surface of an opening end of the case member 11 connected with the case member 33. An engaged portion 33*a* is defined by forming a step along an outside surface of an upper end of the case member 33 connected with the case member 11. The engaging portion 11*a* and the engaged portion 33*a* are brought into engagement by inserting the upper end of the case member 33 into the opening of case member 11. The case member 11 (operation portion 5) and the case member 33 (switch portion 7) are connected together by fixing the engaging portion 11*a* and the engaged portion 33*a* in engagement with screws 85. The case member 11 is formed with a breaking notch 86 in an outer periphery thereof and in the vicinity of a connecting portion between the operation portion 5 and the switch portion 7. The breaking notch 86 extends along the entire circumference of the case member 11.

According to the safety switch having this structure, when the actuator 3 is not inserted in the operation portion 5 of the switch body 1, the working rod 21 is moved to the operation portion 5 by the urging force of the coil spring 50 while the first switch 39 of the switching device 70 is in the open position to disable the power supply to the industrial machine. Hence, the industrial machine is deactivated.

Subsequently when the operation of inserting the actuator 3 by closing the protective door or such is performed to insert the actuator 3 in the operation portion 5 through the actuator inlet port 9*a*, for example, the connecting peg 3*b* of the actuator 3 is engaged with the engaging portion 15*a* of the driving cam 15. As the actuator 3 is inserted further, the driving cam 15 is rotated counter-clockwise. In conjunction with the rotation of the driving cam 15, the cam pin 22 is moved downward along the guide slot 15*d* against the urging force of the coil spring 50.

The downward movement of the cam pin 22 pushes down the working rod 21 into the switch portion 7 against the urging force of the coil spring 50. As the working rod 21 is moved further down, the movable contact 39*a* is moved into contact with the stationary contact 39*b*, switching the first switch 39 from the open position to the closed position. As shown in FIG. 27A, the first switch 39 of the switching device 70 is set to the closed position so that the electric power is supplied to the industrial machine such as the robot connected in series with the first switch 39. Hence, the industrial machine is actuated.

When, on the other hand, the inserted actuator 3 is extracted by the operation of extracting the actuator 3 by opening the protective door, for example, the driving cam 15 is rotated in the direction of extraction of the actuator 3 till the connecting peg 3*b* of the actuator 3 is disengaged from the engaging portion 15*a* of the driving cam 15. In conjunction with the rotation of the driving cam 15, the cam pin 22 is moved upward along the guide slot 15*d* from the large diameter portion to the small diameter portion. The upward movement of the cam pin 22 moves the working rod 21 in the direction to extract the working rod from the switch portion 7.

The urging force of the coil spring 50 is combined with the pull-out force which derives from the rotation of the driving cam 15 and works to extract the working rod 21 from the switch portion 7. The combined force moves the working rod 21 in the opposite direction from the movement thereof during the operation of inserting the actuator 3. Namely, the working rod 21 is extracted from the switch portion 7 and moved to the operation portion 5. Hence, the movable contact 39*a* is moved away from the stationary contact 39*b*, setting the first switch 39 to the open position so that the industrial machine is deactivated.

According to the embodiment, when the operating force of the operation of extracting the actuator 3 exceeds the breakage tolerance for the breaking notch 86 (permission structure) of the case member 11, or when the magnitude of some impact on the operation portion 5 exceeds the breakage tolerance for the braking notch 86, the breaking notch 86 breaks down (fractures) to permit the movement of the working rod 21 in the urging direction of the coil spring 50. If the working rod 21 is permitted to move in the urging direction of the coil spring 50 and is moved to the operation portion 5, as described above, the movable contact 39*a* of the first switch 39 is moved away from the stationary contact 39*b*.

Namely, as the permission structure that breaks down to permit the movement of the working rod 21 in the urging direction of the coil spring 50, the breaking notch 86 is provided on the outer periphery of the case member 11 in the vicinity of the connecting portion between the operation portion 5 and the switch portion 7. When the operating force of the operation of extracting the actuator 3 or the magnitude of some external load on the switch body 1 exceeds the breakage tolerance for the breaking notch 86, the breaking notch 86 is broken to release the operation portion 5 from the engagement with the switch portion 7, as shown in FIG. 27B. Thus, the operation portion 5 and the switch portion 7 are separated from each other whereby the movement of the working rod 21 in the urging direction of the coil spring 50 is permitted. The external load may be exemplified by an impact of the actuator 3 on the switch body 1 (case member 11) when the insertion operation fails to insert the actuator 3 properly in the actuator inlet port 9*a*, 9*b* or by an impact of some packing box striking on the switch body 1 when the box is carried into the area inside the protective door.

Besides the urging force by the coil spring 50, therefore, a pull-out force of extracting, from the switch portion 7, the driving cam 15 and the working rod 21 connected thereto with the cam pin 22 occurs as a result of the separation of the operating portion 5 from the switch portion 7. Accordingly, the working rod 21 is assuredly moved to the operation portion so that the movable contact 39*a* is reliably moved away from the stationary contact 39*b*, setting the first switch 39 to the open position.

As described above, this embodiment can offer the same effects as those of the first embodiment.

Tenth Embodiment

Figure 28A:
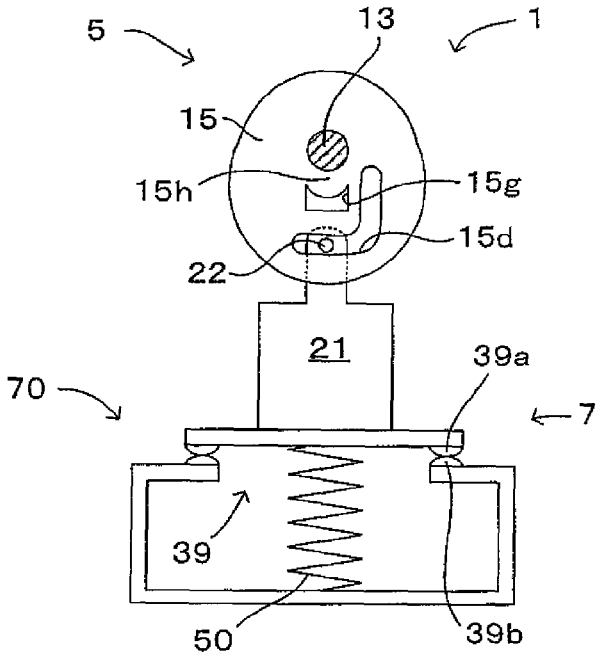
FIGS. 28A and 28B are enlarged views showing a principal part of a switch body according to a tenth embodiment of the invention.
Figure 28B:
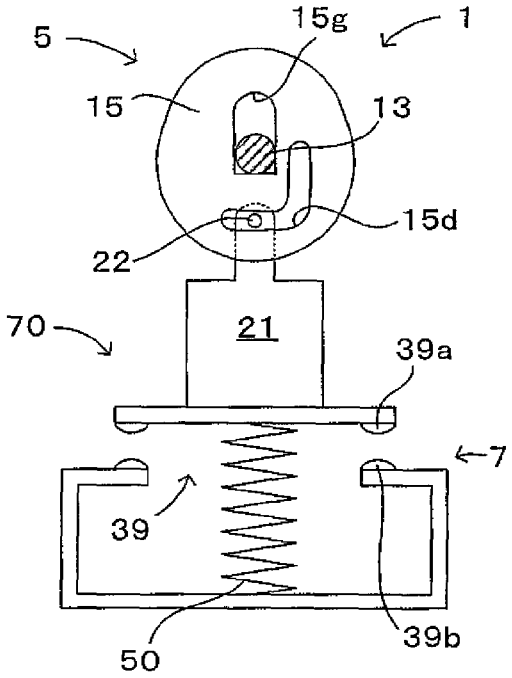

A safety switch according to a tenth embodiment of the invention is described with reference to FIG. 28. FIG. 28 illustrates the tenth embodiment of the invention. FIG. 28A and FIG. 28B are enlarged views of a principal part as seen from the front. FIG. 28A and FIG. 28B each show the switch body in a different state.

According to the tenth embodiment, the permission structure of the invention is implemented in the driving cam 15. Since the other components and the operations thereof are the same as in the first embodiment, the following description will principally detail the differences from the first embodiment referring to FIG. 1 and FIG. 2, as well. It is noted that like reference characters refer to the corresponding components of the first embodiment and the description thereof and of the operations thereof is dispensed with. FIG. 28 omits the depiction of a part of the structure of the switch body 1.

As shown in FIG. 28A, the driving cam 15 is formed with a support slot 15*g* having a suitable size to permit the insertion of the rotary shaft 13. Further, the driving cam 15 is integrally formed with a bridge strip 15*h* at a boundary between an upper hole and a lower hole of the support slot 15*g*. The rotary shaft 13 is supported by the upper hole of the support slot 15 and has the opposite ends supported on the inside surface of the case member 11 of the operation portion 5. The driving cam 15 is installed in the operation portion 5 in manner to be rotatable in both directions according to the operation of inserting the actuator 3 in the operation portion 5 and the operation of extracting the actuator 3 from the operation portion 5.

According to the safety switch having this structure, when the actuator 3 is not inserted in the operation portion 5 of the switch body 1, the working rod 21 is moved to the operation portion 5 by the urging force of the coil spring 50 while the first switch 39 of the switching device 70 is in the open position to disable the power supply to the industrial machine. Hence, the industrial machine is deactivated.

Subsequently when the operation of inserting the actuator 3 by closing the protective door or such is performed to insert the actuator 3 in the operation portion 5 through the actuator inlet port 9*a*, for example, the connecting peg 3*b* of the actuator 3 is engaged with the engaging portion 15*a* of the driving cam 15. As the actuator 3 is inserted further, the driving cam 15 is rotated counter-clockwise. In conjunction with the rotation of the driving cam 15, the cam pin 22 is moved downward along the guide slot 15*d* against the urging force of the coil spring 50.

The downward movement of the cam pin 22 pushes down the working rod 21 into the switch portion 7 against the urging force of the coil spring 50. As the working rod 21 is moved further down, the movable contact 39*a* is moved into contact with the stationary contact 39*b*, switching the first switch 39 from the open position to the closed position. As shown in FIG. 28A, the first switch 39 of the switching device 70 is set to the closed position so that the electric power is supplied to the industrial machine such as the robot connected in series with the first switch 39. Hence, the industrial machine is actuated.

When, on the other hand, the inserted actuator 3 is extracted by the operation of extracting the actuator 3 by opening the protective door, for example, the driving cam 15 is rotated in the direction of extraction of the actuator 3 till the connecting peg 3*b* of the actuator 3 is disengaged from the engaging portion 15*a* of the driving cam 15. In conjunction with the rotation of the driving cam 15, the cam pin 22 is moved upward along the guide slot 15*d* from the large diameter portion to the small diameter portion. The upward movement of the cam pin 22 moves the working rod 21 in the direction to extract the working rod from the switch portion 7.

The urging force of the coil spring 50 is combined with the pull-out force which derives from the rotation of the driving cam 15 and works to extract the working rod 21 from the switch portion 7. The combined force moves the working rod 21 in the opposite direction from the movement thereof during the operation of inserting the actuator 3. Namely, the working rod 21 is extracted from the switch portion 7 and moved to the operation portion 5. Hence, the movable contact 39*a* is moved away from the stationary contact 39*b*, setting the first switch 39 to the open position so that the industrial machine is deactivated.

According to the embodiment, when at least the operating force of the operation or the number of operations of extracting the actuator 3 exceeds the breakage tolerance for the bridge strip 15*h* (permission structure) formed at the driving cam 15, the bridge strip 15*h* is broken thereby permitting the movement of the working rod 21 in the urging direction of the coil spring 50. If the working rod 21 is permitted to move in the urging direction of the coil spring 50 and moved to the operation portion 5, as described above, the movable contact 39*a* of the first switch 39 is moved away from the stationary contact 39*b*.

Namely, as the permission structure that breaks down to permit the movement of the working rod 21 in the urging direction of the coil spring 50, the bridge strip 15*h* is provided in the support slot 15*g* of the driving cam 15. When the operating force of the operation or the number of operations of extracting the actuator 3 exceeds the breakage tolerance for the bridge strip 15*h*, the bridge strip 15*h* is broken to release the rotary shaft 13 from the state supported by the support slot 15*g*, as shown in FIG. 28B. Furthermore, the force of extracting the actuator 3 from the operation portion 5 works to move up the driving cam 15 in the operation portion 5, so that the working rod 21 is permitted to move in the urging direction of the coil spring 50.

The following pull-out forces are added to the urging force of the coil spring 50 when the movement of the working rod 21 in the urging direction of the coil spring 50 is permitted by the breakage of the bridge strip 15*h* (permission structure). The pull-out forces include a force which works to extract the working rod 21 from the switch portion 7 and which derives from the cam pin 22 moved upward along the guide slot 15 from the large diameter portion to the small diameter portion in conjunction with the operation of extracting the actuator 3 performed till the breakage of the bridge strip 15*h*, and a force which works to extract, from the switch portion 7, the driving cam 15 and the working rod 21 connected thereto with the cam pin 22 and which derives from the driving cam 15 moved upward in the operation portion 5 after the breakage of the bridge strip 15*h*. The combined force assuredly moves the working rod 21 to the operation portion 5 so that the movable contact 39*a* is reliably moved away from the stationary contact 39*b*, setting the first switch 39 to the open position.

As described above, this embodiment can offer the same effects as those of the first embodiment.

Eleventh Embodiment

Figure 29A:
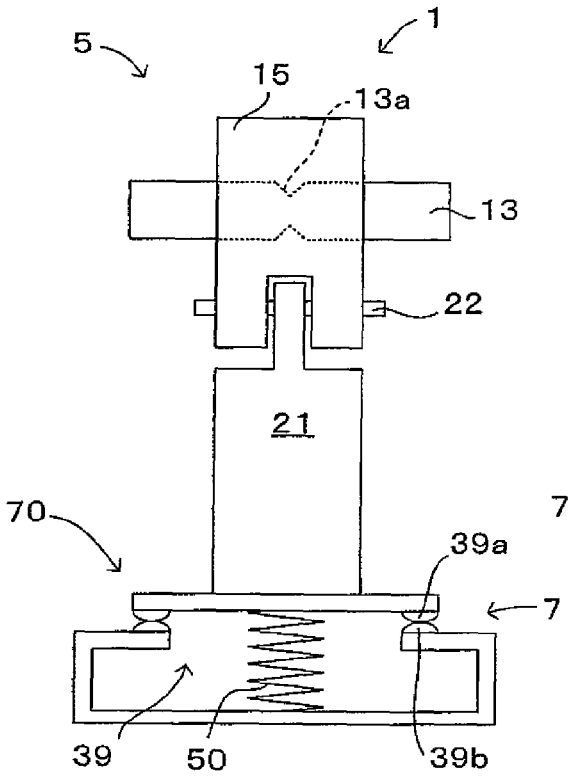
FIGS. 29A and 29B are enlarged views showing a principal part of a switch body according to an eleventh embodiment of the invention.
Figure 29B:
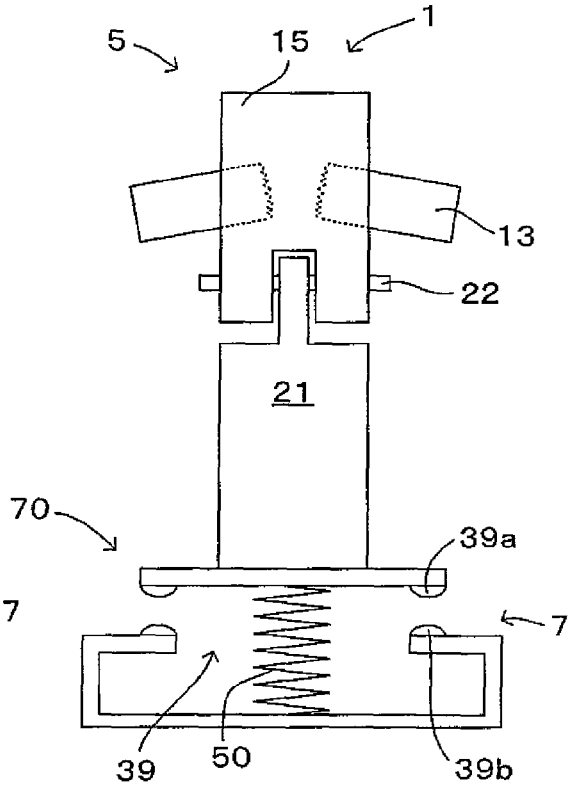

A safety switch according to an eleventh embodiment of the invention is described with reference to FIG. 29. FIG. 29 illustrates the eleventh embodiment of the invention. FIG. 29A and FIG. 29B are enlarged side views of a principal part as seen from the left side. FIG. 29A and FIG. 29B each show the switch body in a different state.

According to the eleventh embodiment, the permission structure of the invention is implemented in the rotary shaft 13 of the driving cam 15. Since the other components and the operations thereof are the same as in the first embodiment, the following description will principally detail the differences from the first embodiment referring to FIG. 1 and FIG. 2, as well. It is noted that like reference characters refer to the corresponding components of the first embodiment and the description thereof and of the operations thereof is dispensed with. FIG. 29 omits the depiction of apart of the structure of the switch body 1.

As shown in FIG. 29A, the rotary shaft 13 is inserted through a through-hole formed in the driving cam 15 and has the opposite ends supported on the inside surface of the case member 11 of the operation portion 5. The driving cam 15 is installed in the operation portion 5 in a manner to be rotatable in both directions according to the operation of inserting the actuator 3 in the operation portion 5 and the operation of extracting the actuator 3 therefrom. The rotary shaft 13 is substantially centrally formed with a notch 13*a* extending on a periphery thereof.

According to the safety switch having this structure, when the actuator 3 is not inserted in the operation portion 5 of the switch body 1, the working rod 21 is moved to the operation portion 5 by the urging force of the coil spring 50 while the first switch 39 of the switching device 70 is in the open position to disable the power supply to the industrial machine. Hence, the industrial machine is deactivated.

Subsequently when the operation of inserting the actuator 3 by closing the protective door or such is performed to insert the actuator 3 in the operation portion 5 through the actuator inlet port 9*a*, for example, the connecting peg 3*b* of the actuator 3 is engaged with the engaging portion 15*a* of the driving cam 15. As the actuator 3 is inserted further, the driving cam 15 is rotated counter-clockwise. In conjunction with the rotation of the driving cam 15, the cam pin 22 is moved downward along the guide slot 15*d* against the urging force of the coil spring 50.

The downward movement of the cam pin 22 pushes down the working rod 21 into the switch portion 7 against the urging force of the coil spring 50. As the working rod 21 is moved further down, the movable contact 39*a* is moved into contact with the stationary contact 39*b*, switching the first switch 39 from the open position to the closed position. As shown in FIG. 29A, the first switch 39 of the switching device 70 is set to the on position so that the electric power is supplied to the industrial machine such as the robot connected in series with the first switch 39. Hence, the industrial machine is actuated.

When, on the other hand, the inserted actuator 3 is extracted by the operation of extracting the actuator 3 by opening the protective door, for example, the driving cam 15 is rotated in the direction of extraction of the actuator 3 till the connecting peg 3*b* of the actuator 3 is disengaged from the engaging portion 15*a* of the driving cam 15. In conjunction with the rotation of the driving cam 15, the cam pin 22 is moved up along the guide slot 15*d* from the large diameter portion to the small diameter portion. The upward movement of the cam pin 22 moves the working rod 21 in the direction to extract the working rod 21 from the switch portion 7.

The urging force of the coil spring 50 is combined with the pull-out force which derives from the rotation of the driving cam 15 and works to extract the working rod 21 from the switch portion 7. The combined force moves the working rod 21 in the opposite direction from the movement thereof during the operation of inserting the actuator 3. Namely, the working rod 21 is extracted from the switch portion 7 and moved to the operation portion 5. Hence, the movable contact 39*a* is moved away from the stationary contact 39*b*, setting the first switch 39 to the open position so that the industrial machine is deactivated.

According to the embodiment, when at least the operating force of the operation or the number of operations of extracting the actuator 3 exceeds the breakage tolerance for the notch 13*a* (permission structure) formed on the rotary shaft 13 of the driving cam 15, the notch 13*a* is broken to induce the break off failure of the rotary shaft 13 thereby permitting the movement of the working rod 21 in the urging direction of the coil spring 50. If the working rod 21 is permitted to move in the urging direction of the coil spring 50 and moved to the operation portion 5, as described above, the movable contact 39*a* of the first switch 39 is moved away from the stationary contact 39*b*.

Namely, as the permission structure which breaks down to permit the movement of the working rod 21 in the urging direction of the coil spring 50, the notch 13*a* is formed on the rotary shaft 13 inserted through the through-hole of the driving cam 15. When the operating force of the operation or the number of operations of extracting the actuator 3 exceeds the breakage tolerance for the notch 13*a*, the notch 13*a* is broken to induce the break off failure of the rotary shaft 13 so that the rotary shaft 13 breaks up to release the driving cam 15 from the state supported by the support portion of the case member 11, as shown in FIG. 29B. Furthermore, the force of extracting the actuator 3 from the operation portion 5 works to move up the driving cam 15 in the operation portion 5, so that the working rod 21 is permitted to move in the urging direction of the coil spring 50.

The following pull-out forces are added to the urging force of the coil spring 50 when the movement of the working rod 21 in the urging direction of the coil spring 50 is permitted by the breakage of the notch 13*a* (permission structure). The pull-out forces include a force which works to extract the working rod 21 from the switch portion 7 and which derives from the cam pin 22 moved upward along the guide slot 15 from the large diameter portion to the small diameter portion in conjunction with the operation of extracting the actuator 3 performed till the breakage of the notch 13*a*, and a force which works to extract, from the switch portion 7, the driving cam 15 and the working rod 21 connected thereto with the cam pin 22 and which derives from the driving cam 15 moved upward in the operation portion 5 after the breakage of the notch 13*a*. The combined force assuredly moves the working rod 21 to the operation portion 5 so that the movable contact 39*a* is reliably moved away from the stationary contact 39*b*, setting the first switch 39 to the open position.

As described above, this embodiment can offer the same effects as those of the first embodiment.

Twelfth Embodiment

Figure 30A:
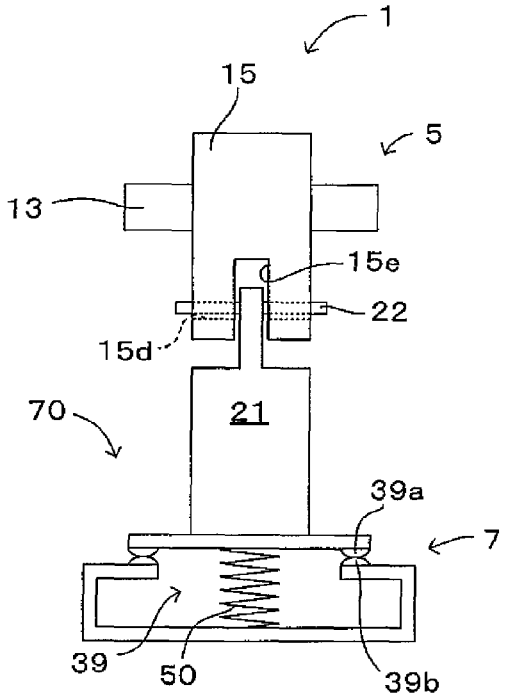
FIGS. 30A and 30B are enlarged views showing a principal part of a switch body according to a twelfth embodiment of the invention.
Figure 30B:
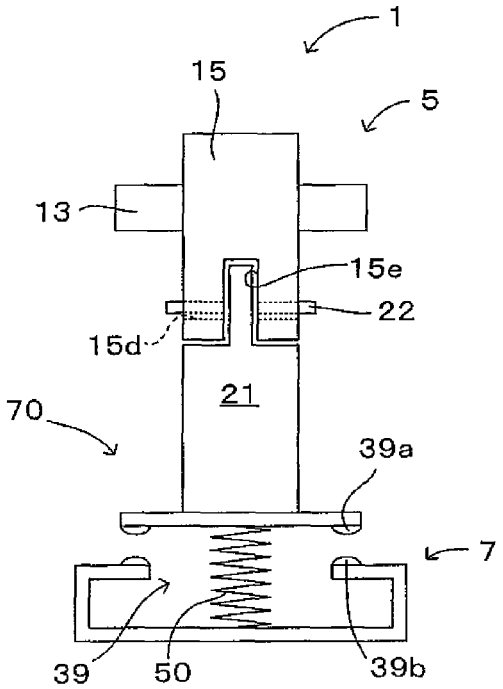

A safety switch according to a twelfth embodiment of the invention is described with reference to FIG. 30. FIG. 30 illustrates the twelfth embodiment of the invention. FIG. 30A and FIG. 30B are enlarged side views of a principal part as seen from the left side. FIG. 30A and FIG. 30B each show the switch body in a different state.

According to the twelfth embodiment, the permission structure of the invention is implemented in the cam pin 22 as the connecting means for connecting the driving cam 15 with the working rod 21. Since the other components and the operations thereof are the same as in the first embodiment, the following description will principally detail the differences from the first embodiment referring to FIG. 1 and FIG. 2, as well. It is noted that like reference characters refer to the corresponding components of the first embodiment and the description thereof and of the operations thereof is dispensed with. FIG. 30A and FIG. 30B omit the depiction of a part of the structure of the switch body 1.

As shown in FIG. 30A, the driving cam 15 is formed with the cutaway 15*e* on the area where the guide slot 15*d* is formed, the cutaway extending from the outer periphery of the driving cam 15 toward the rotary shaft 13. The cam pin 22 is secured to the distal end of the working rod 21. In order for the working rod 21 to be reciprocated in conjunction with the rotation of the driving cam 15 in both directions, the working rod 21 has the distal end thereof inserted in the cutaway 15*e* of the driving cam 15 while the cam pin 22 has each of the opposite ends thereof inserted through the guide slot 15*d* of the driving cam 15.

According to the safety switch having this structure, when the actuator 3 is not inserted in the operation portion 5 of the switch body 1, the working rod 21 is moved to the operation portion 5 by the urging force of the coil spring 50 while the first switch 39 of the switching device 70 is in the open position to disable the power supply to the industrial machine. Hence, the industrial machine is deactivated.

Subsequently when the operation of inserting the actuator 3 by closing the protective door or such is performed to insert the actuator 3 in the operation portion 5 through the actuator inlet port 9*a*, for example, the connecting peg 3*b* of the actuator 3 is engaged with the engaging portion 15*a* of the driving cam 15. As the actuator 3 is inserted further, the driving cam 15 is rotated counter-clockwise. In conjunction with the rotation of the driving cam 15, the cam pin 22 is moved downward along the guide slot 15*d* against the urging force of the coil spring 50.

The downward movement of the cam pin 22 pushes down the working rod 21 into the switch portion 7 against the urging force of the coil spring 50. As the working rod 21 is moved further down, the movable contact 39*a* is moved into contact with the stationary contact 39*b*, switching the first switch 39 from the open position to the closed position. As shown in FIG. 30A, the first switch 39 of the switching device 70 is set to the closed position so that the electric power is supplied to the industrial machine such as the robot connected in series with the first switch 39. Hence, the industrial machine is actuated.

When, on the other hand, the inserted actuator 3 is extracted by the operation of extracting the actuator 3 by opening the protective door, for example, the driving cam 15 is rotated in the direction to extract the actuator 3 till the connecting peg 3*b* of the actuator 3 is disengaged from the engaging portion 15*a* of the driving cam 15. In conjunction with the rotation of the driving cam 15, the cam pin 22 is moved upward along the guide slot 15*d* from the large diameter portion to the small diameter portion. The upward movement of the cam pin 22 moves the working rod 21 in the direction to extract the working rod from the switch portion 7.

The urging force of the coil spring 50 is combined with the pull-out force which derives from the rotation of the driving cam 15 and works to extract the working rod 21 from the switch portion 7. The combined force moves the working rod 21 in the opposite direction from the movement thereof during the operation of inserting the actuator 3. Namely, the working rod 21 is extracted from the switch portion 7 and moved to the operation portion 5. Hence, the movable contact 39*a* is moved away from the stationary contact 39*b*, setting the first switch 39 to the open position so that the industrial machine is deactivated.

According to the embodiment, the cam pin 22 has strength set to a predetermined breaking strength while the cutaway 15*e* extends further from the guide slot 15*d* toward the rotary shaft 13. Therefore, when at least the operating force of the operation or the number of operations of extracting the actuator 3 exceeds the breakage tolerance for the cam pin 22 (permission structure) fixed to the working rod 21, the cam pin 22 is broken thereby permitting the movement of the working rod 21 in the urging direction of the coil spring 50. If the working rod 21 is permitted to move in the urging direction of the coil spring 50 and moved to the operation portion 5, as described above, the movable contact 39*a* of the first switch 39 is moved away from the stationary contact 39*b*.

Namely, as the permission structure which breaks down to permit the movement of the working rod 21 in the urging direction of the coil spring 50, the cam pin 22 is mounted to the distal end of the working rod 21. When the operating force of the operation or the number of operations of extracting the actuator 3 exceeds the breakage tolerance for the cam pin 22, the cam pin 22 is broken to be released from the state guided by the guide slot 15*d*, as shown in FIG. 30B. Thus, the working rod 21 is permitted to move in the urging direction of the coil spring 50.

When the cam pin 22 mounted to the distal end of the working rod 21 breaks down, the working rod 21 is assuredly moved to the operation portion 5 by the urging force of the coil spring 50. This ensures that the movable contact 39*a* is reliably moved away from the stationary contact 39*b*, setting the first switch 39 to the open position.

As described above, this embodiment can offer the same effects as those of the first embodiment.

The cam pin 22 may also be mounted to the distal end of the working rod 21 by an arrangement wherein a through-hole for insertion of the cam pin 22 is formed at the distal end of the working rod 21 and the cam pin 22 is inserted through the through-hole. In this case, the distal end of the working rod 21 formed with the through-hole has the strength previously set to the predetermined breaking strength. When the operating force of the operation or the number of operations of extracting the actuator 2 exceeds the breakage tolerance for the distal end (permission structure) of the working rod 21, the distal end of the working rod 21 is broken to permit the movement of the working rod 21 in the urging direction of the coil spring 50. This arrangement can also offer the same effects as those of this embodiment.

Thirteenth Embodiment

Figure 31A:
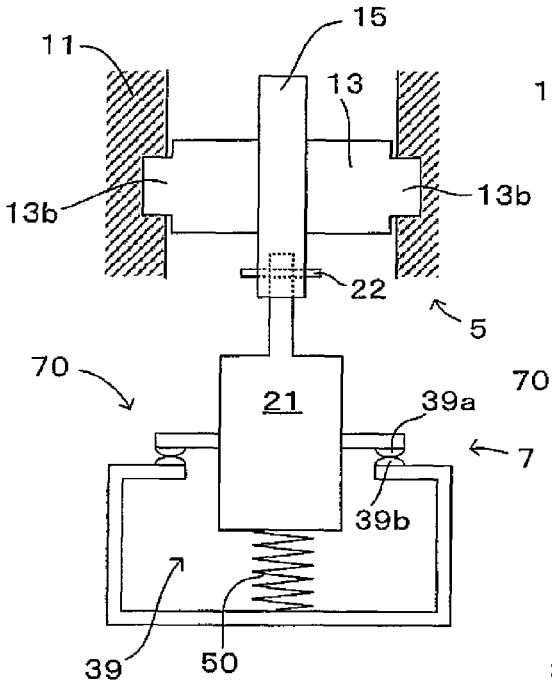
FIGS. 31A and 31B enlarged views showing a principal part of a switch body according to a thirteenth embodiment of the invention.
Figure 31B:
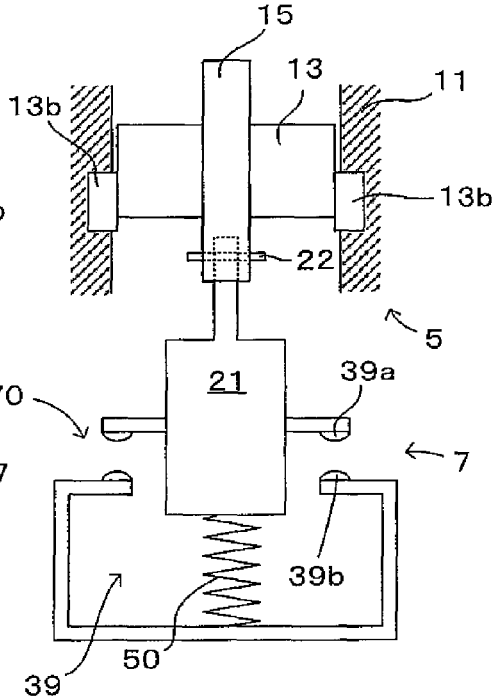

A safety switch according to a thirteenth embodiment of the invention is described with reference to FIG. 31. FIG. 31 illustrates the thirteenth embodiment of the invention. FIG. 31A and FIG. 31B are enlarged side views of a principal part as seen from the left side. FIG. 31A and FIG. 31B each show the switch body in a different state.

According to the thirteenth embodiment, the permission structure of the invention is implemented in the rotary shaft 13 of the driving cam 15. Since the other components and the operations thereof are the same as in the first embodiment, the following description will principally detail the differences from the first embodiment referring to FIG. 1 and FIG. 2, as well. It is noted that like reference characters refer to the corresponding components of the first embodiment and the description thereof and of the operations thereof is dispensed with. FIG. 31 omits the depiction of a part of the structure of the switch body 1.

As shown in FIG. 31A, the rotary shaft 13 is inserted through the through-hole formed in the driving cam 15. The rotary shaft 13 is configured such that opposite ends 13*b* thereof have a smaller diameter and thence, have lower breaking strength than a central part thereof. The rotary shaft has the opposite ends 13*b* thereof supported on the inside surface of the case member 11 of the operation portion 5, while the driving cam 15 is installed in the operation portion 5 in a manner to be rotatable in both directions according to the operation of inserting the actuator 3 in the operation portion and the operation of extracting the actuator 3 therefrom.

According to the safety switch having this structure, when the actuator 3 is not inserted in the operation portion 5 of the switch body 1, the working rod 21 is moved to the operation portion 5 by the urging force of the coil spring 50 while the first switch 39 of the switching device 70 is in the open position to disable the power supply to the industrial machine. Hence, the industrial machine is deactivated.

Subsequently when the operation of inserting the actuator 3 by closing the protective door or such is performed to insert the actuator 3 in the operation portion 5 through the actuator inlet port 9*a*, for example, the connecting peg 3*b* of the actuator 3 is engaged with the engaging portion 15*a* of the driving cam 15. As the actuator 3 is inserted further, the driving cam 15 is rotated counter-clockwise. In conjunction with the rotation of the driving cam 15, the cam pin 22 is moved downward along the guide slot 15*d* against the urging force of the coil spring 50.

The downward movement of the cam pin 22 pushes down the working rod 21 into the switch portion 7 against the urging force of the coil spring 50. As the working rod 21 is moved further down, the movable contact 39*a* is moved into contact with the stationary contact 39*b*, switching the first switch 39 from the open position to the closed position. As shown in FIG. 31A, the first switch 39 of the switching device 70 is set to the closed position so that the electric power is supplied to the industrial machine such as the robot connected in series with the first switch 39. Hence, the industrial machine is actuated.

When, on the other hand, the inserted actuator 3 is extracted by the operation of extracting the actuator 3 by opening the protective door, for example, the driving cam 15 is rotated in the direction of extraction of the actuator 3 till the connecting peg 3*b* of the actuator 3 is disengaged from the engaging portion 15*a* of the driving cam 15. In conjunction with the rotation of the driving cam 15, the cam pin 22 is moved upward along the guide slot 15*d* from the large diameter portion to the small diameter portion. The upward movement of the cam pin 22 moves the working rod 21 in the direction to extract the working rod from the switch portion 7.

The urging force of the coil spring 50 is combined with the pull-out force which derives from the rotation of the driving cam 15 and works to extract the working rod 21 from the switch portion 7. The combined force moves the working rod 21 in the opposite direction from the movement thereof during the operation of inserting the actuator 3. Namely, the working rod 21 is extracted from the switch portion 7 and moved to the operation portion 5. Hence, the movable contact 39*a* is moved away from the stationary contact 39*b*, setting the first switch 39 to the open position so that the industrial machine is deactivated.

According to the embodiment, when at least the operating force of the operation or the number of operations of extracting the actuator 3 exceeds the breakage tolerance for the opposite ends 13*b* of the rotary shaft 13 of the driving cam 15, the opposite ends 13*b* are broken thereby permitting the movement of the working rod 21 in the urging direction of the coil spring 50. If the working rod 21 is permitted to move in the urging direction of the coil spring 50 and moved to the operation portion 5, as described above, the movable contact 39*a* of the first switch 39 is moved away from the stationary contact 39*b*.

Namely, the rotary shaft 13 of the driving cam 15 is provided with the opposite ends 13*b* having the smaller diameter, as the permission structure which breaks down to permit the movement of the working rod 21 in the urging direction of the coil spring 50. When the operating force of the operation or the number of operations of extracting the actuator 3 exceeds the breakage tolerance for the opposite ends 13*b*, the opposite ends 13*b* are broken thereby releasing the driving cam 15 (rotary shaft 13) from the state supported by the support portion of the case member 11, as shown in FIG. 31B. Furthermore, the force of extracting the actuator 3 from the operation portion 5 works to move up the driving cam 15 in the operation portion 5. Thus, the working rod 21 is permitted to move in the urging direction of the coil spring 50.

The following pull-out forces are added to the urging force of the coil spring 50 when the movement of the working rod 21 in the urging direction of the coil spring 50 is permitted by the breakage of the opposite ends 13*b* (permission structure) of the rotary shaft 13. The pull-out forces include a force which works to extract the working rod 21 from the switch portion 7 and which derives from the cam pin 22 moved upward along the guide slot 15 from the large diameter portion to the small diameter portion in conjunction with the operation of extracting the actuator 3 performed till the breakage of the opposite ends 13*b*, and a force which works to extract, from the switch portion 7, the driving cam 15 and the working rod 21 connected thereto with the cam pin 22 and which derives from the driving cam 15 moved upward in the operation portion 5 after the breakage of the opposite ends 13*b*. The combined force assuredly moves the working rod 21 to the operation portion 5 so that the movable contact 39*a* is reliably moved away from the stationary contact 39*b*, setting the first switch 39 to the open position.

As described above, this embodiment can offer the same effects as those of the first embodiment.

Fourteenth Embodiment

Figure 32A:
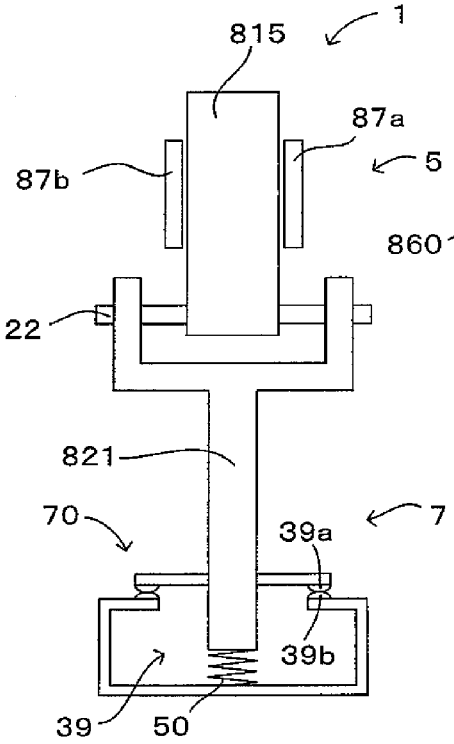
FIGS. 32A and 32B are enlarged views showing a principal part of a switch body according to a fourteenth embodiment of the invention.
Figure 32B:
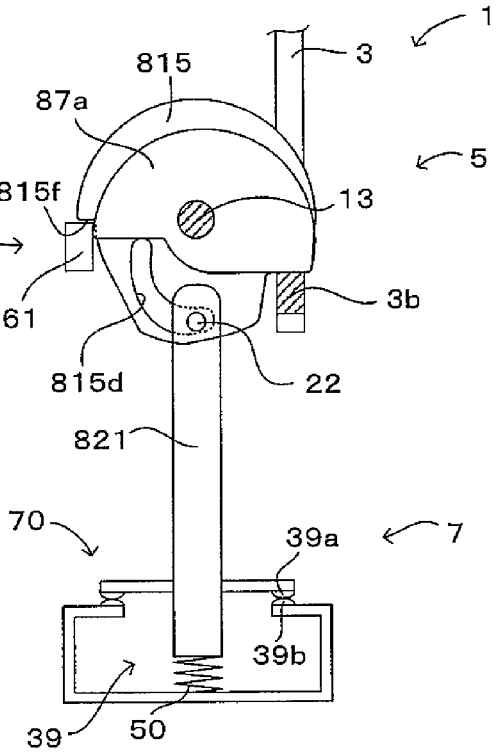
Figure 33A:
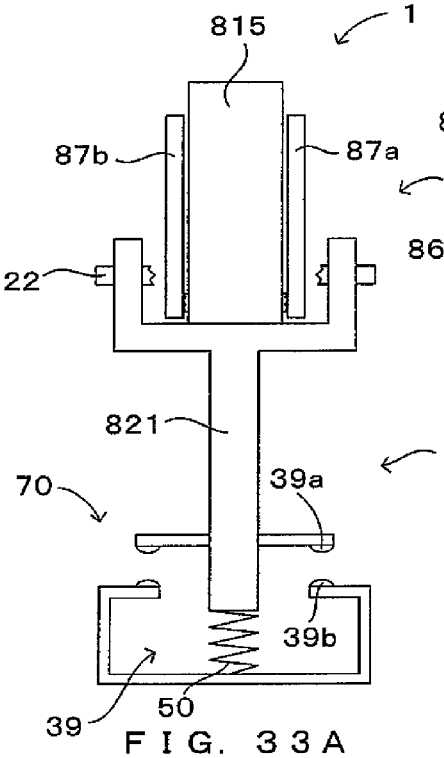
FIGS. 33A and 33B are enlarged views showing the principal part of the switch body according to the fourteenth embodiment of the invention.
Figure 33B:
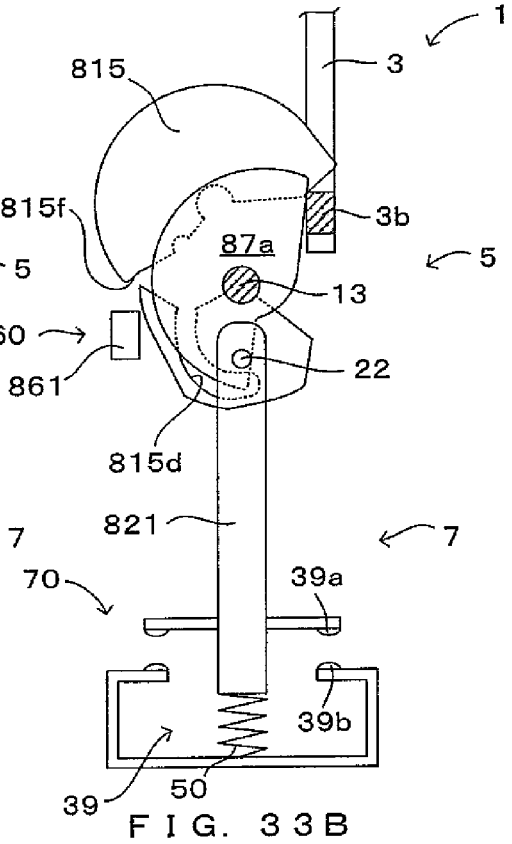

A safety switch according to a fourteenth embodiment of the invention is described with reference to FIG. 32 and FIG. 33. FIG. 32 and FIG. 33 illustrate the fourteenth embodiment of the invention. FIG. 32A and FIG. 33A are enlarged side views of a principal part as seen from the left side while FIG. 32B and FIG. 33B are enlarged views of the principal part as seen from the front. FIG. 32 and FIG. 33 each show the switch body in a different state.

According to the fourteenth embodiment, the permission structure of the invention is implemented in a driving cam 815 and the cam pin 22 as the connecting means of the invention for connecting the driving cam 815 with a working rod 821. Further, the driving cam 815 is provided with a pair of auxiliary cams 87*a*, 87*b* on the opposite sides thereof. The auxiliary cams rotate together with the driving cam 815 about the rotary shaft 13 and in both directions according to the operation of inserting the actuator 3 in the operation portion 5 and the operation of extracting the actuator 3 therefrom.

Furthermore, the operation portion 5 is provided with a lock mechanism 860 (equivalent to the "lock means" of the invention) which includes a locking member 861 adapted to be locked to a lock portion 815*f* formed in an outer periphery of the driving cam 815 for inhibiting the rotation thereof. When the actuator 3 is inserted in the operation portion 5, the lock mechanism inhibits the rotation of the driving cam 815 by locking the locking member 861 to the lock portion 815*f* of the driving cam 815, thereby inhibiting the operation of extracting the actuator 3 from the operation portion 5.

Since the other components and the operations thereof are the same as in the third embodiment, the following description will principally detail the differences from the third embodiment referring to FIG. 9 and FIG. 10, as well. It is noted that like reference characters refer to the corresponding components of the third embodiment and the description thereof and of the operations thereof is dispensed with. FIG. 32 omits the depiction of a part of the structure of the switch body 1.

As shown in FIG. 32A, an upper end of the working rod 821 is substantially formed in a Y-shape. The driving cam 815, a lower side of which is inserted in the Y-shape portion of the working rod 821, is connected to the working rod 821 with the cam pin 22 inserted through a guide slot 815*d* formed in the driving cam 815. The Y-shape portion formed at the upper end of the working rod 821 has a greater length than a radial thickness of the driving cam 815 between the guide slot 815*d* and the outer periphery. In the state where the driving cam 815 and the working rod 821 are connected together by the cam pin 22, a bottom of the Y-shape portion of the working rod 821 is a predetermined distance spaced apart from the outer periphery of the driving cam 815.

The lock mechanism 860 includes a driver (not shown) for moving the locking member 861 between the rotation inhibition position where the locking member is locked to the lock portion 815*f* thereby inhibiting the rotation of the driving cam 815 and the rotation permission position where the locking member is released from the lock to the lock portion 815*f* thereby permitting the rotation of the driving cam 815. The driver includes a spring for urgingly moving the locking member 861, a solenoid for moving the locking member 861 against the urging force of the spring urging the locking member 861, and the like. However, the driver may be any combination of well-known components selected suitably according to the configuration and arrangement of the locking member 861. Therefore, a detailed description of the driver is dispensed with. It is noted that the rotation of the auxiliary cams 87*a*, 87*b* is permitted even when the actuator 3 is inserted in the operation portion 5 and the rotation of the driving cam is inhibited by the locking member 861 locked to the lock portion 815*f* of the driving cam 815.

According to the safety switch having this structure, when the actuator 3 is not inserted in the operation portion 5 of the switch body 1, the working rod 821 is moved to the operation portion 5 by the urging force of the coil spring 50 while the first switch 39 of the switching device 70 is in the open position to disable the power supply to the industrial machine. Hence, the industrial machine is deactivated. The locking member 861 is moved outwardly so that the locking member 861 and the lock portion 815*f* are out of the locking engagement.

Subsequently when the operation of inserting the actuator 3 by closing the protective door or such is performed to insert the actuator 3 in the operation portion 5 through the actuator inlet port 9*a*, for example, the connecting peg 3*b* of the actuator 3 is engaged with the engaging portion of the driving cam 815. As the actuator 3 is inserted further, the driving cam 815 and the auxiliary cams 87*a*, 87*b* are rotated counterclockwise. In conjunction with the rotation of the driving cam 815, the cam pin 22 is moved downward along the guide slot 815*d* against the urging force of the coil spring 50.

The downward movement of the cam pin 22 pushes down the working rod 821 into the switch portion 7 against the urging force of the coil spring 50. As the working rod 821 is moved further down, the movable contact 39*a* is moved into contact with the stationary contact 39*b*, switching the first switch 39 from the open position to the closed position. As shown in FIG. 32A and FIG. 32B, the first switch 39 of the switching device 70 is set to the closed position so that the electric power is supplied to the industrial machine such as the robot connected in series with the first switch 39. Hence, the industrial machine is actuated. With the actuator 3 inserted in the operation portion 5, the locking member 861 is moved to the driving cam 815 by the urging force of the spring or the like so that the locking member 861 is locked to the lock portion 815*f* to inhibit the rotation of the driving cam 815. Hence, the operation of extracting the actuator 3 from the operation portion 5 is inhibited.

On the other hand, the well-known driver employing the solenoid or the like operates to move the locking member 861 outward so as to release the locking member 861 from the lock to the lock portion 815*f*. When, in this state, the inserted actuator 3 is extracted by the operation of extracting the actuator 3 by opening the protective door, the driving cam 815 and the auxiliary cams 87*a*, 87*b* are rotated in the direction of extraction of the actuator 3 till the connecting peg 3*b* of the actuator 3 is disengaged from the engaging portion of the driving cam 815. In conjunction with the rotation of the driving cam 815, the cam pin 22 is moved upward along the guide slot 815*d* from the large diameter portion to the small diameter portion. The upward movement of the cam pin 22 moves the working rod 821 in the direction to extract the working rod from the switch portion 7.

The urging force of the coil spring 50 is combined with the pull-out force which derives from the rotation of the driving cam 815 and works to extract the working rod 21 from the switch portion 7. The combined force moves the working rod 821 in the opposite direction from the movement thereof during the operation of inserting the actuator 3. Namely, the working rod 821 is extracted from the switch portion 7 and moved to the operation portion 5. Hence, the movable contact 39*a* is moved away from the stationary contact 39*b*, setting the first switch 39 to the open position so that the industrial machine is deactivated.

According to the embodiment, the driving cam 815 is broken when the operating force of the extracting operation exceeds the breakage tolerance for the driving cam 815 because the operation of forcibly extracting the actuator 3 is performed while the lock mechanism 860 inhibits the operation of extracting the actuator 3 from the operation portion 5. Then, an operation of unduly extracting the actuator 3 is performed although the rotation of the driving cam 815 is inhibited by the lock mechanism 860 in conjunction with the breakdown of the driving cam 815 caused by the operation of extracting the actuator 3.

If the undue operation of extracting the actuator 3 is performed, however, the switch body is under the abnormal state where the driving cam 815 is broken due to the operation of extracting the actuator 3 and does not rotate. As shown in FIG. 33A and FIG. 33B, the auxiliary cams 87*a*, 87*b* are rotated in conjunction with the operation of extracting the actuator 3 and pressed against the cam pin 22. Thus, the auxiliary cams 87*a*, 87*b* destroy the cam pin 22 as driven by the rotative force applied by the operation of extracting the actuator 3. This permits the movement of the working rod 821 in the urging direction of the coil spring 50. If the working rod 821 is permitted to move in the urging direction of the coil spring 50 and is moved to the operation portion 5, as described above, the movable contact 39*a* of the first switch 39 is moved away from the stationary contact 39*b*.

Namely, as the permission structure which breaks down to permit the movement of the working rod 821 in the urging direction of the coil spring 50, the driving cam 815 is designed to have the predetermined breaking strength and is provided with the cam pin 22 for connecting the driving cam 815 to the working rod 821. When the operating force of the operation or the number of operations of extracting the actuator 3 exceeds the breakage tolerance for the driving cam 815, the driving cam 815 is broken, as shown in FIG. 33A and FIG. 33B. In the meantime, the auxiliary cams 87*a*, 87*b* are rotated counter-clockwise in conjunction with the operation of extracting the actuator 3 to be pressed against the cam pin 22, thus destroying the cam pin 22 as driven by the rotative force applied by the operation of extracting the actuator 3. Hence, the driving cam 815 and the working rod 821 are released from the connected relation so that the working rod 821 is permitted to move in the urging direction of the coil spring 50.

Accordingly, the working rod 821 is assuredly moved to the operation portion 5 by the urging force of the coil spring 50 so that the movable contact 39*a* is reliably moved away from the stationary contact 39*b*. Thus, the first switch is set to the open position.

As described above, this embodiment can offer the same effects as those of the third embodiment.

According to this structure, if the driving cam 815 breaks down when the operating force of the operation of extracting the actuator 3 from the operation portion 5 exceeds the breakage tolerance for the driving cam 815, the auxiliary cams 87*a*, 87*b* are rotated in conjunction with the extracting operation and pressed against the cam pin 22 so as to destroy the cam pin 22 as driven by the rotative force applied by the extracting operation. Hence, the connection between the driving cam 815 and the working rod 821 is eliminated to release these components from each other so that the working rod 821 is permitted to move in the urging direction of the coil spring 50. The working rod 821 is assuredly moved by the coil spring 50 so that the movable contact 39*a* is moved away from the stationary contact 39*b*. Hence, the first switch 39 can be assuredly set to the open position.

In the event of a trouble where the driving cam 815 does not rotate due to the damage caused during the operation of extracting the actuator 3, the auxiliary cams 87*a*, 87*b* rotate in conjunction with the operation of extracting the actuator 3. A hook body engageable with the cam pin 22 may be formed on the auxiliary cam 87*a*, 87*b* at place where the auxiliary cam 87*a*, 87*b* abuts against the cam pin 22, as rotated in conjunction with the extraction operation.

According to this arrangement, if the driving cam 815 is broken when the operating force of the operation of extracting the actuator 3 exceeds the breakage tolerance for the driving cam 815, the hook body formed on the auxiliary cam 87*a*, 87*b* rotated counter-clockwise in conjunction with the operation of extracting the actuator 3 is engaged with the cam pin 22. This permits the working rod 821 to be extracted from the switch portion 7 by pulling up the cam pin 22 with the rotative force applied by the operation of extracting the actuator 3. Therefore, the working rod 821 is assuredly moved to the operation portion 5 by the urging force of the coil spring 50 combined with a force of the auxiliary cams 87*a*, 87*b* working to pull up the cam pin 22 as rotated in conjunction with the operation of extracting the actuator 3. This ensures that the movable contact 39*a* is reliably moved away from the stationary contact 39*b*, setting the first switch 39 to the open position.

Fifteenth Embodiment

Figure 34A:
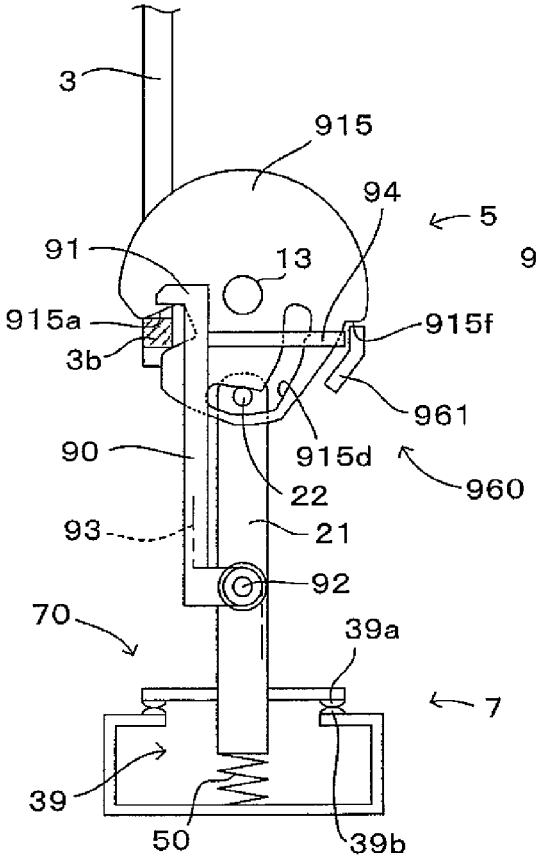
FIGS. 34A and 34B are enlarged views showing a principal part of a switch body according to a fifteenth embodiment of the invention.
Figure 34B:
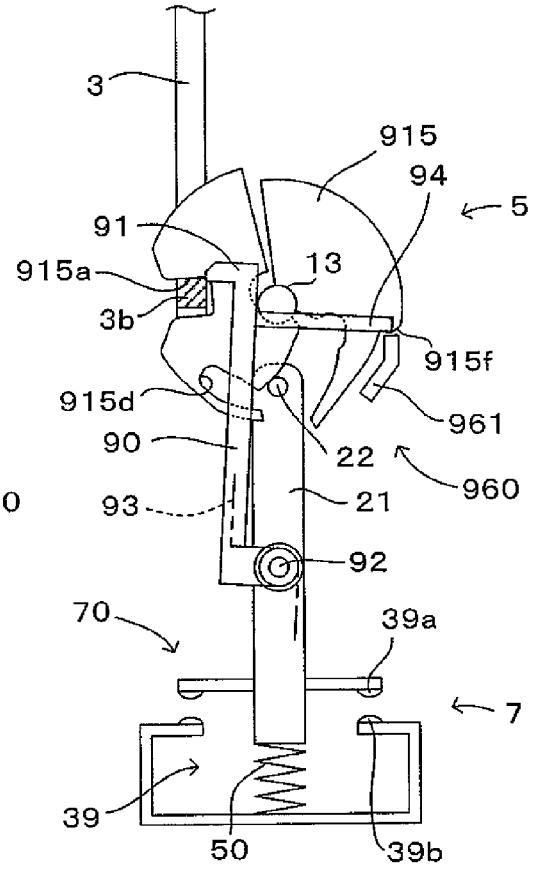

A safety switch according to a fifteenth embodiment of the invention is described with reference to FIG. 34. FIG. 34 illustrates the fifteenth embodiment of the invention. FIG. 34A and FIG. 34B are enlarged views of a principal part as seen from the front, each showing the switch body in a different state.

According to the fifteenth embodiment, the permission structure of the invention is implemented in a driving cam 915. Furthermore, the operation portion 5 is provided with an auxiliary rod 90, one end of which is rotatably connected to the working rod 21 and the other end of which is formed with a hook body 91.

The operation portion 5 is further provided with a lock mechanism 960 (equivalent to the "lock means" of the invention) which includes a locking member 961 adapted to be locked to a lock portion 915*f* formed in an outer periphery of the driving cam 915 for inhibiting the rotation thereof and which, with the actuator 3 inserted in the operation portion 5, inhibits the rotation of the driving cam 915 by locking the locking member 861 to the lock portion 915*f* of the driving cam 915, thereby inhibiting the operation of extracting the actuator 3 from the operation portion 5.

Since the other components and the operations thereof are the same as in the third embodiment, the following description will principally detail the differences from the third embodiment referring to FIG. 9 and FIG. 10, as well. It is noted that like reference characters refer to the corresponding components of the third embodiment and the description thereof and of the operations thereof is dispensed with. FIG. 34 omits the depiction of a part of the structure of the switch body 1.

As shown in FIG. 34A, the lock mechanism 960 includes a driver (not shown) for moving the locking member 961 between the rotation inhibition position where the locking member is locked to the lock portion 915*f* thereby inhibiting the rotation of the driving cam 915 and the rotation permission position where the locking member 961 is released from the lock to the lock portion 915*f* thereby permitting the rotation of the driving cam 915. The driver further includes a spring for urgingly moving the locking member 961, a solenoid for moving the locking member 961 against the urging force of the spring urging the locking member 961, and the like. However, the driver may be any combination of well-known components selected suitably according to the configuration and arrangement of the locking member 961 and hence, a detailed description thereof is dispensed with.

The auxiliary rod 90 is formed with a crank-shaped connecting portion at one end thereof and with the hook body 91 (equivalent to an "engageable portion" of the invention) at the other end thereof. The connecting portion at the one end of the auxiliary rod 90 is rotatably connected to the working rod 21 by means of a bolt 92 or the like installed in a connection hole (not shown) formed in the working rod 21. The auxiliary rod 90 oscillates about the connecting portion, as the pivotal point, which is disposed at the one end connected to the working rod 21, thereby moving the hook body 91 between an engagement position (see FIG. 34A) where the hook body 91 engages with the connecting peg 3*b* of the actuator 3 and a non-engagement position (see FIG. 34B) where the hook body 91 is closer to the rotary shaft 13 and out of engagement with the connecting peg 3*b* of the actuator 3.

The bolt 92 interconnecting the connecting portion at the one end of the auxiliary rod 90 and the working rod 21 is provided with a torsion coil spring 93, a coil portion of which is mounted on the bolt 92. The auxiliary rod 90 is urged by the torsion coil spring 93 to move the hook body 91 at the other end thereof toward the non-engagement position closer to the rotary shaft 13. A push rod 94 extends from the other end of the auxiliary rod 90 in a manner that a distal end thereof reaches the lock portion 915*f* of the driving cam 915. As shown in FIG. 34A, the push rod 94 is pushed by the locking member 961 moved to the rotation inhibition position when the lock mechanism 960 inhibits the rotation of the driving cam 915. Thus, the auxiliary rod 90 is driven to oscillate against the urging force of the torsion coil spring 93, moving the hook body 91 to the engagement position for engagement with the connecting peg 3*b* of the actuator 3.

When the rotation of the driving cam 915 is permitted by the lock mechanism 860, the hook body 91 of the auxiliary rod 90 is out of engagement with the actuator 3 as moved to the non-engagement position by the urging force of the torsion coil spring 93. When the rotation of the driving cam 915 is inhibited by the lock mechanism 860, the push rod 94 is pushed by the locking member 961 against the urging force of the torsion coil spring 93, thereby moving the hook body 91 to the engagement position for engagement with the actuator 3.

According to the embodiment, the pressing force that the locking member 961 applies to the push rod 94 when moved to the rotation inhibition position by an urging member such as the spring or the solenoid of the lock mechanism 960 is defined to be greater than the urging force that the torsion coil spring 93 applies to the auxiliary rod 90 to move the auxiliary rod to the non-engagement position.

According to the safety switch having this structure, when the actuator 3 is not inserted in the operation portion 5 of the switch body 1, the working rod 21 is moved to the operation portion 5 by the urging force of the coil spring 50 while the first switch 39 of the switching device 70 is in the open position to disable the power supply to the industrial machine. Hence, the industrial machine is deactivated. On the other hand, the locking member 961 is moved outwardly so that the locking member 961 and the lock portion 915*f* are out of engagement.

Subsequently when the operation of inserting the actuator 3 by closing the protective door or such is performed to insert the actuator 3 in the operation portion 5 through the actuator inlet port 9*a*, for example, the connecting peg 3*b* of the actuator 3 is engaged with an engaging portion 915*a* of the driving cam 915. As the actuator 3 is inserted further, the driving cam 915 is rotated counter-clockwise. In conjunction with the rotation of the driving cam 915, the cam pin 22 is moved downward along a guide slot 915*d* against the urging force of the coil spring 50.

The downward movement of the cam pin 22 pushes down the working rod 21 into the switch portion 7 against the urging force of the coil spring 50. As the working rod 21 is moved further down, the movable contact 39*a* is moved into contact with the stationary contact 39*b*, switching the first switch 39 from the open position to the closed position. As shown in FIG. 34A, the first switch 39 of the switching device 70 is set to the closed position so that the electric power is supplied to the industrial machine such as the robot connected in series with the first switch 39. Hence, the industrial machine is actuated. With the actuator 3 inserted in the operation portion 5, the locking member 961 is moved to the driving cam 915 by the urging force of the spring or the like so that the locking member 961 is locked to the lock portion 915*f* to inhibit the rotation of the driving cam 915. Hence, the operation of extracting the actuator 3 from the operation portion 5 is inhibited.

On the other hand, the well-known driver employing the solenoid or the like operates to move the locking member 961 outward so as to release the locking member 961 from the lock to the lock portion 915*f*. When, in this state, the inserted actuator 3 is extracted by the operation of extracting the actuator 3 by opening the protective door, for example, the driving cam 915 is rotated in the direction of extraction of the actuator 3 till the connecting peg 3*b* of the actuator 3 is disengaged from the engaging portion 915*a* of the driving cam 915. In conjunction with the rotation of the driving cam 915, the cam pin 22 is moved upward along the guide slot 915*d* from the large diameter portion to the small diameter portion. The upward movement of the cam pin 22 moves the working rod 21 in the direction to extract the working rod from the switch portion 7.

The urging force of the coil spring 50 is combined with the pull-out force which derives from the rotation of the driving cam 815 and works to extract the working rod 21 from the switch portion 7. The combined force moves the working rod 21 in the opposite direction from the movement thereof during the operation of inserting the actuator 3. Namely, the working rod 21 is extracted from the switch portion 7 and moved to the operation portion 5. Hence, the movable contact 39*a* is moved away from the stationary contact 39*b*, setting the first switch 39 to the open position so that the industrial machine is deactivated.

According to the embodiment, the driving cam 915 breaks down when the operating force of the extracting operation exceeds the breakage tolerance for the driving cam 915 because the operation of forcibly extracting the actuator 3 is performed while the operation of extracting the actuator 3 from the operation portion 5 is inhibited by the lock mechanism 960. Then, an operation of unduly extracting the actuator 3 is performed although the rotation of the driving cam 915 is inhibited by the lock mechanism 960 in conjunction with the breakdown of the driving cam 915 caused by the operation of extracting the actuator 3.

However, the hook body 91 of the auxiliary rod 90 connected to the working rod 21 is engaged with the connecting peg 3*b* of the actuator 3 because the rotation of the driving cam 915 is inhibited by the lock mechanism 960. In conjunction with the undue operation of extracting the actuator 3, the auxiliary rod 90 with the hook body 91 engaged with connecting peg 3*b* of the actuator 3 is moved in the direction of extraction from the switch portion 7. As the auxiliary rod 90 is moved in the direction of extraction from the switch portion 7, therefore, the working rod 21 connected to the auxiliary rod 90 is also moved in the direction of extraction from the switch portion 7.

Namely, the driving cam 915 is provided as the permission structure which breaks down to permit the movement of the working rod 21 in the urging direction of the coil spring 50. As shown in FIG. 34B, when the operating force of the operation of extracting the actuator 3 exceeds the breakage tolerance for the driving cam 915, the driving cam 915 breaks down to be released from the connected relation with the working rod 21. This permits the working rod 21 to be moved in the urging direction of the coil spring 50. Furthermore, the undue operation of extracting the actuator 3 moves the auxiliary rod 91 in the direction to extract the auxiliary rod from the switch portion 7. Therefore, the working rod 21 connected with the auxiliary rod 91 is assuredly moved to the operation portion 5 by the urging force of the coil spring 50 combined with the operating force of the actuator 3 working to extract the auxiliary rod 91 from the switch portion 7. Hence, the movable contact 39*a* is reliably moved away from the stationary contact 39*b*, setting the first switch 39 to the open position.

As described above, this embodiment can offer the same effects as those of the third embodiment.

According to this structure, the movement of the working rod 21 in the urging direction of the coil spring 50 is permitted when the operation of forcibly extracting the actuator 3 is performed with the rotation of the driving cam 915 inhibited by the lock mechanism 960 and hence, the operating force of the operation of extracting the actuator 3 from the operation portion 5 exceeds the breakage tolerance to cause the breakage of the driving cam 915 or the breakage or dropout of the operation portion 5. If, at this time, the rotation of the driving cam 915 is inhibited by the lock mechanism 960, the force of extracting the actuator 3 is transmitted to the working rod 21 via the auxiliary rod 90 because the hook body 91 at the other end of the auxiliary rod 90 connected with the working rod 21 at the one end thereof is located at the engagement position to be engaged with the actuator 3. Even if the both contacts are fused, the working rod 21 is assuredly moved by the urging force of the coil spring 50 combined with the force of extracting the actuator 3. Hence, the movable contact 39*a* is reliably moved away from the stationary contact 39*b*, setting the first switch 39 to the open position.

Sixteenth Embodiment

Figure 35A:
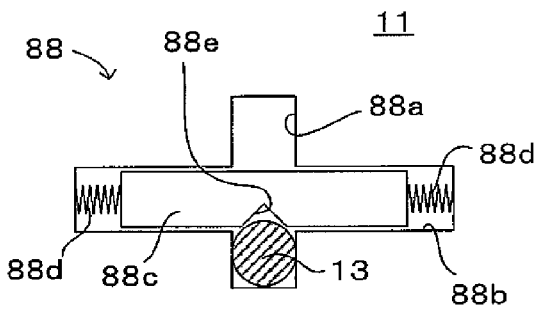
FIGS. 35A and 35B are enlarged views showing a principal part of a switch body according to a sixteenth embodiment of the invention.
Figure 35B:
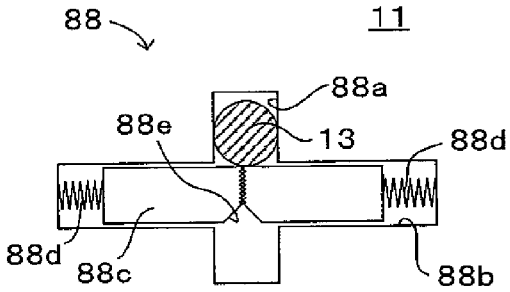

A safety switch according to a sixteenth embodiment of the invention is described with reference to FIG. 35. FIG. 35 illustrates the sixteenth embodiment of the invention. FIG. 35A and FIG. 35B are enlarged views of a principal part as seen from the front, each showing the switch body in a different state.

According to the sixteenth embodiment, the permission structure of the invention is implemented in a support portion 88 for rotatably supporting the driving cam 15 on the inside surface of the case member 11. Since the other components and the operations thereof are the same as in the first embodiment, the following description will principally detail the differences from the first embodiment referring to FIG. 1 and FIG. 2, as well. It is noted that like reference characters refer to the corresponding components of the first embodiment and the description thereof and of the operations thereof is dispensed with. FIG. 35 omits the depiction of a part of the structure of the switch body 1.

As shown in FIG. 35, the support portion 88 includes: support grooves 88*a* formed in the inside surfaces of the front side and rear side of the case member 11; installation grooves 88*b* formed perpendicular to the support grooves 88*a*; and support rods 88*c* installed in the installation grooves 88*b*. Coil springs 88*d* are disposed on opposite sides of the installation groove 88*b*. The support rod 88*c* is installed in the installation groove 88*b* as supported on the opposite sides thereof by the coil springs 88*c*. The support rod 88*c* is formed with a notch 88*e* as the permission structure of the invention. The rotary shaft 13 of the driving cam 15 has the opposite ends located under the support rods 88*c* in the support grooves 88*a* formed on the front side and rear side. In this state, the driving cam 15 is rotatably supported by the support rods 88*c*. It is noted that FIG. 35 omits the depiction of the support portion 88 on the back side.

According to the safety switch having this structure, when at least the operating force of the operation or the number of operations of extracting the actuator 3 exceeds the breakage tolerance for the notch 88*e* of the support rod 88*c* of the support portion 88, the support rod 88*c* fractures and breaks down thereby permitting the movement of the working rod 21 in the urging direction of the coil spring 50. If the working rod 21 is permitted to move in the urging direction of the coil spring 50 and moved to the operation portion 5, as described above, the movable contact 39*a* of the first switch 39 is moved away from the stationary contact 39*b*.

Namely, the support portion 88 (support rod 88*c*) for supporting the rotary shaft 13 of the driving cam 15 on the inside surface of the case member 11 is provided as the permission structure which breaks down to permit the movement of the working rod 21 in the urging direction of the coil spring 50. As shown in FIG. 35B, when the operating force of the operation or the number of operations of extracting the actuator 3 exceeds the breakage tolerance for the support rod 88*c*, the support rod 88*c* fractures and breaks down. At this time, the force of extracting the actuator 3 works so that segments of the split support rod 88*c* are moved in the installation groove 88*b* to the opposite sides thereof or moved away from each other against the urging forces of the coil springs 88*d*. Thus, the rotary shaft 13 is released from the state supported by the support portion 88 so that the driving cam 15 is moved upward in the operation portion 5. Hence, the working rod 21 is permitted to move in the urging direction of the coil spring 50.

The following pull-out forces are added to the urging force of the coil spring 50 when the movement of the working rod 21 in the urging direction of the coil spring 50 is permitted by the breakage of the opposite portion 88 (permission structure). The pull-out forces include a force which works to extract the working rod 21 from the switch portion 7 and which derives from the cam pin 22 moved upward along the guide slot 15 from the large diameter portion to the small diameter portion in conjunction with the operation of extracting the actuator 3 performed till the breakage of the support portion 88, and a force which works to extract, from the switch portion 7, the driving cam 15 and the working rod 21 connected thereto with the cam pin 22 and which derives from the driving cam 15 moved upward in the operation portion 5 after the breakage of the support portion 88. The combined force assuredly moves the working rod 21 to the operation portion 5 so that the movable contact 39*a* is reliably moved away from the stationary contact 39*b*, setting the first switch 39 to the open position.

When the support portion 88 as the permission structure for permitting the movement of the working rod 21 in the urging direction of the coil spring 50 breaks down, the driving cam 15 is released from the state supported by the support portion 88 and moved up. Thereafter, the coil springs 88*d* urge the respective segments of the split support rod 88*c* toward each other to thereby return the segments of the support rod 88*c* split by the notch 88*e* to the original positions where the support rod segments abut on each other on the fractured sides thereof. Accordingly, the driving cam 13 is supported from below by the segments of the split support rod 88*c* which abut on each other. That is, once the driving cam 15 is moved up, the driving cam 15 is maintained at the position displaced upward from the predetermined design position relative to the switch portion 7. In this state, therefore, inserting the actuator 3 does not effect the normal operation of the driving cam 15. That is, the driving cam 15 is not operated by the operation of inserting the actuator 3 or disabled to move the working rod 21. This inhibits the working rod 21 from bringing the movable contact 39*a* into contact with the stationary contact 39*b*. Hence, the first switch 39 can be assuredly prevented from being switched to the closed position when the operation of inserting the actuator 3 is performed in spite of the occurrence of some abnormality in the safety switch.

As just described, the support portion 88 of this embodiment is designed to function as the "permission structure" and the "means for inhibiting contact of the movable contact with the stationary contact" of the invention.

As described above, this embodiment can offer the same effects as those of the first embodiment.

Seventeenth Embodiment

Figure 36A:
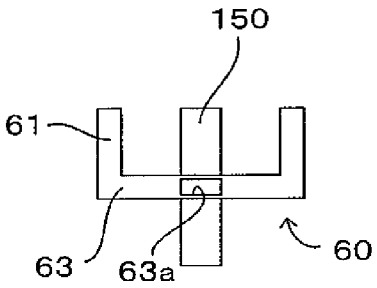
FIGS. 36A to 36C are enlarged views showing a principal part of a switch body according to a seventeenth embodiment of the invention.
Figure 36B:
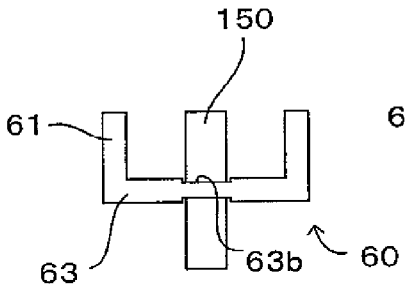
Figure 36C:
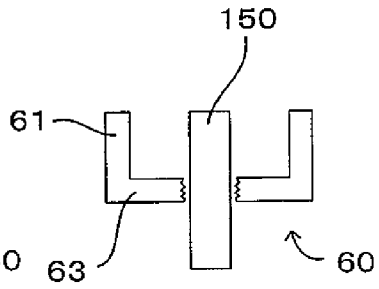

A safety switch according to a seventeenth embodiment of the invention is described with reference to FIG. 36. FIG. 36 illustrates the seventeenth embodiment of the invention. FIG. 36A and FIG. 36B are enlarged side views of a principal part as seen from the left side, each showing an exemplary modification of the locking member. FIG. 36C shows an example of broken locking member.

According to the seventeenth embodiment, the permission structure of the invention is implemented in the locking member 61 of the lock mechanism 60. Since the other components and the operations thereof are the same as in the third embodiment, the following description will principally detail the differences from the third embodiment referring to FIG. 9 and FIG. 10, as well. It is noted that like reference characters refer to the corresponding components of the third embodiment and the description thereof and of the operations thereof is dispensed with. FIG. 36 omits the depiction of apart of the structure of the switch body 1.

According to the embodiment, the locking peg 63 of the locking member 61 is formed with a break slot 63*a* shown in FIG. 36A or a break strip 63*b* shown in FIG. 36B as the permission structure of the invention. In this manner, the locking member 61 is adjusted to a predetermined breaking strength by forming the break slot 63*a* or the break strip 63*b* in the locking peg 63.

According to the safety switch having this structure, the locking member 61 (locking peg 63) is broken when the operating force of the operation of extracting the actuator 3 exceeds the breakage tolerance for the break slot 63*a* or break strip 63*b* of the locking member 60 because the operation of forcibly extracting the actuator 3 is performed with the rotation of the driving cam 150 inhibited by the lock mechanism 60, or with the locking peg 63 of the locking member 61 locked to the lock portion 15*f* of the driving cam 150. Then, the rotation of the driving cam 150 is permitted whereby the movement of the working rod 21 in the urging direction of the coil spring 50 is permitted. If the working rod 21 is permitted to move in the urging direction of the coil spring 50 and moved to the operation portion 5, as described above, the movable contact 39*a* of the first switch 39 is moved away from the stationary contact 39*b*.

Namely, the locking peg 63 of the locking member 61 is provided with the break slot 63*a* or break strip 63*b* as the permission structure which breaks down to permit the movement of the working rod 21 in the urging direction of the coil spring 50. As shown in FIG. 36C, when the operating force of the operation of extracting the actuator 3 exceeds the breakage tolerance for the locking peg 63 of the locking member 61, the locking member 61 is broken and hence, the driving cam 150 is released from the rotation inhibition by the lock mechanism 60. The driving cam 150 is rotated in conjunction with the operation of extracting the actuator 3 whereby the working rod 21 is permitted to move in the urging direction of the coil spring 50.

The urging force of the coil spring 50 is combined with the pull-out force which derives from the cam pin 22 moved upward from the large diameter portion to the small diameter portion along the guide slot 15*d* in conjunction with the operation of extracting the actuator 3 and which works to extract the working rod 21 from the switch portion 7. The combined force assuredly moves the working rod 21 toward the operation portion 5, so that the movable contact 39*a* is reliably moved away from the stationary contact 39*b* to set the first switch 39 to the open position.

As described above, this embodiment can offer the same effects as those of the third embodiment.

<Other Features>

It is to be noted that the invention is not limited to the foregoing embodiments and various changes or modifications may be made thereto unless otherwise such changes or modifications depart from the scope of the present invention. The permission structure for permitting the working rod to be moved by the urging means in the urging direction is not limited to the above-described examples. For example, a component such as the working rod may be partially formed with a notch or otherwise, the material, size, thickness, diameter or the like of some of the components of the switch body may be changed. By doing so, the breaking strength of the working rod, driving cam, connecting means (cam pin) for interconnecting the working rod and the driving cam or other components may be defined properly such that these structures may be used as the permission structure for permitting the working rod to be moved by the urging means in the urging direction.

In the foregoing embodiments, the coil springs 50, 500 function as the "urging means" of the invention. However, the structure of the urging means is not limited to the above-described structures. In short, the urging means may have any structure that can assuredly urge the movable contact 39*a* away from the stationary contact 39*b*. For example, a magnet and the like may be employed as the "urging means" of the invention.

While the foregoing embodiments are described by way of example of the safety switch equipped with one first switch 39, the number of switches is not limited to one. The safety switch may be equipped with two or more switches. The foregoing embodiments are described by way of example of the safety switch equipped with the first switch 39 including the urging means for urging the movable contact 39*a* away from the stationary contact 39*b*. However, the safety switch may also have a structure which includes, in addition to the first switch 39, urging means for urging the movable contact into contact with the stationary contact and a switch performing the opposite open/close switching operations to those of the first switch 39. In this case, the first switch 39 may be used for electrical control of the external apparatus while the additional switch may be used for generation of the electric signal for detecting the insertion of the actuator.

According to such a structure, the first switch 39 is set to the closed position in conjunction with the operation of inserting the actuator 3 in the operation portion 5, switching the external apparatus from an inoperabled state to an operable state. On the other hand, the additional switch is set to the open position in conjunction with the insertion operation of the actuator 3. That is, not only the insertion operation and extraction operation of the actuator 3, but also the state of the external apparatus can be determined from outside by monitoring the open/closed positions of the switch performing the opposite open/close switching operations to those of the first switch 39.

The foregoing embodiments are arranged such that the working rod is reciprocated by moving the cam pin secured to the working rod along the guide slot 15 of the driving cam. However, an alternative arrangement may be made where in the connecting means is omitted and wherein the distal end of the working rod is in sliding contact with the cam curve portion of the driving cam so as to be reciprocally moved by the driving cam. Further, the structure of the connecting means is not limited to the above-described examples. The connecting means may have any structure that permits the working rod to be reciprocated against the urging force of the urging means such as the coil spring.

The foregoing embodiments may also be arranged to permit the operation portion and the switch portion to be removably combined together. According to this arrangement, the operation portion can be attached to or removed from the switch portion as needed, facilitating maintenance work for the switch body. In a case where the operation portion is accidentally removed from the switch portion, the first switch 39 can be assuredly switched off because the urging means such as the coil spring urges the movable contact away from the stationary contact. As a matter of course, the operation portion and the switch portion may be disposed in a case formed in one-piece structure. In a case where the operation portion and the switch portion are disposed in the case formed in one-piece structure, the permission structure for permitting the movement of the working rod in the urging direction may be implemented by forming a notch or the like in the case at a boundary between the operation portion and the switch portion.

Further, the foregoing embodiments may have a structure which is not provided with the coil spring. According to such a structure, the working rod is permitted to move in the direction of the movement thereof during the extraction operation of the actuator or to be extracted from the switch portion even when the working rod breaks down or the operation portion breaks down or drops out because the operating force of the operation or the number of operations of extracting the actuator from the operation portion exceeds the breakage tolerance for the switch body. Therefore, the driving cam and the working rod connected thereto with the cam pin are assuredly moved to the operation portion by the force of extracting the actuator from the operation portion. Thus, the movable contact can be moved away from the stationary contact, reliably setting the first switch 39 to the open position. The switch can achieve the safety improvement.

According to the above third, fourth, fourteenth, fifteenth and seventeenth embodiments, the lock means of the invention implemented in the lock mechanism that inhibits the rotation of the driving cam by locking the locking member to the driving cam, thereby inhibiting the operation of extracting the actuator. However, the lock means is not limited to this structure. For example, the lock means may be arranged such that the rotation of the driving cam is inhibited by locking the locking member to the working rod to thereby inhibit the operation of extracting the actuator.

While the above fourth embodiment is described by way of example of the safety switch further including one second switch 40, the number of the switches is not limited to this. The safety switch may include two or more second switches. The fourth embodiment is described by way of example of the safety switch equipped with the second switch 40 including the coil spring 463 urging the movable contact 40*a* into contact with the stationary contact 40*b*. However, an alternative arrangement may be adopted wherein such a second switch 40 is replaced by a switch which includes urging means for urging the movable contact away from the stationary contact and which performs the opposite open/close switching operations to those of the second switch 40.

While the above fourth embodiment has the arrangement wherein the locking member 461 is moved to the rotation inhibition position by the coil spring 463 and moved to the rotation permission position by the driver including the solenoid or the like, an alternative arrangement may be adopted wherein the locking member 461 is moved to the rotation inhibition position by the driver and moved to the rotation permission position by the urging means such as the coil spring.

Any of those components illustrated by the foregoing embodiments may be combined in any ways so long as such combinations do depart from the scope of the present invention.

The present invention is not limited to the foregoing embodiments but various changes or modifications may be made thereto unless otherwise such changes or modifications depart from the scope of the present invention. The invention can be used widely for the purpose of ensuring the safety of workers by deactivating the machine when the protective door is not closed completely.

The invention claimed is:

1. A safety switch comprising:

an operation portion provided with a driving cam as an operable member which operates as rotating in either direction in response to an external operation of inserting or extracting an actuator;

a switch portion provided with a first switch including a movable contact and a stationary contact;

urging means for urging the movable contact in a direction away from the stationary contact; and a working rod interlocked with the rotation of the driving cam, the working rod moving against an urging force of the urging means to move the movable contact into contact with the stationary contact when the driving cam is rotated by the insertion operation, or the working rod moving under the urging force of the urging means to move the movable contact in the opposite direction of the movement during the insertion operation and separating the movable contact from the stationary contact when the driving cam is rotated by the extraction operation, the safety switch further comprising a permission structure which, when broken, permits at least the movement of the working rod in an urging direction of the urging means, wherein the permission structure is formed in a support portion for supporting a rotary shaft of the driving cam, and wherein a breaking strength of the support portion is set by the permission structure in a manner that a breakage of the support portion is induced when an operation force of the extraction operation or the number of extraction operations exceeds allowable values below which no damage occurs on the safety switch, while, at the breakage of the support portion, the permission structure permits at least the movement of the working rod in the urging direction of the urging means by releasing the support of the rotary shaft by the support portion, thus separating the movable contact from the stationary contact.

2. The safety switch according to claim 1, further comprising a case member in which the driving cam is disposed, wherein the permission structure has a structure where, on an inside surface of a peripheral wall of the case member, a part which locks the support portion for supporting the rotary shaft of the driving cam is formed thinner on a side in the urging direction of the urging means.

3. The safety switch according to claim 1, wherein the support portion includes support rods supporting the rotary shaft as locked to the rotary shaft of the driving cam, and wherein the permission structure is formed in the support rods and the breaking strength of the support rod is set in a manner that the breakage of the support rod is induced when the operation force of the extraction operation or the number of extraction operations exceeds the allowable values below which no damage occurs on the safety switch.

4. The safety switch according to claim 3, wherein the support rod is formed with a notch.

5. A safety switch comprising:

an operation portion provided with a driving cam as an operable member which operates as rotating in either direction in response to an external operation of inserting or extracting an actuator;

a switch portion provided with a first switch including a movable contact and a stationary contact;

urging means for urging the movable contact in a direction away from the stationary contact; and a working rod interlocked with the rotation of the driving cam, the working rod moving against an urging force of the urging means to move the movable contact into contact with the stationary contact when the driving cam is rotated by the insertion operation, or the working rod moving under the urging force of the urging means to move the movable contact in the opposite direction of the movement during the insertion operation and separating the movable contact from the stationary contact when the driving cam is rotated by the extraction operation, the safety switch further comprising a permission structure which, when broken, permits at least the movement of the working rod in an urging direction of the urging means, wherein the permission structure is formed in a rotary shaft of the driving cam, and wherein a breaking strength of the rotary shaft is set by the permission structure in a manner that a breakage of the rotary shaft is induced when an operation force of the extraction operation or the number of extraction operations exceeds allowable values below which no damage occurs on the safety switch, while, at the breakage of the rotary shaft, the driving cam moves in the urging direction of the urging means and hence, the permission structure permits at least the movement of the working rod in the urging direction of the urging means, thus separating the movable contact from the stationary contact.

6. The safety switch according to claim 5, wherein the permission structure includes a notch formed in the rotary shaft.

7. The safety switch according to claim 5, wherein the permission structure has a structure where a part of the rotary shaft is formed thin.

8. The safety switch according to claim 5, wherein the permission structure permits bending of the rotary shaft when the operation force of the extraction operation or the number of extraction operations exceeds the allowable values below which no damage occurs on the safety switch.

9. A safety switch comprising:

an operation portion provided with an operable member which operates in response to an external operation of inserting or extracting an actuator;

a switch portion provided with a first switch including a movable contact and a stationary contact;

urging means for urging the movable contact in a direction away from the stationary contact; and a working rod interlocked with the operation of the operable member, the working rod moving against an urging force of the urging means to move the movable contact into contact with the stationary contact when the operable member is operated by the insertion operation, or the working rod moving under the urging force of the urging means to move the movable contact in the opposite direction of the movement during the insertion operation and separating the movable contact from the stationary contact when the operable member is operated by the extraction operation, the safety switch further comprising a permission structure which, when broken, permits at least the movement of the working rod in an urging direction of the urging means, wherein the switch portion is formed connectable with the operation portion and the permission structure is formed at a connecting portion between the operation portion and the switch portion, and wherein a breaking strength of the connecting portion is set by the permission structure in a manner that a breakage of the connecting portion is induced when an operation force of the extraction operation or the number of extraction operations exceeds allowable values below which no damage occurs on the safety switch, while, at the breakage of the connecting portion, the permission structure permits at least the movement of the working rod in the urging direction of the urging means by releasing the connection between the operation portion and the switch portion and separating the operation portion and the switch portion from each other, thus separating the movable contact from the stationary contact.

10. The safety switch according to claim 9, wherein the permission structure includes a locking structure which includes a locking claw and a locked portion formed at the connecting portion and connects the operation portion and the switch portion together, and wherein configurations and strengths of the locking claw and the locked portion are set in a manner that the breakage of the locking structure is induced when the operation force of the extraction operation or the number of extraction operations exceeds the allowable values below which no damage occurs on the safety switch.

11. The safety switch according to claim 9, wherein the permission structure includes a breaking notch formed on an outside surface of the case member at the connecting portion.

12. A safety switch comprising:

an operation portion provided with a driving cam as an operable member which operates as rotating in either direction in response to an external operation of inserting or extracting an actuator;

a switch portion provided with a first switch including a movable contact and a stationary contact;

urging means for urging the movable contact in a direction away from the stationary contact; and a working rod interlocked with the rotation of the driving cam, the working rod moving against an urging force of the urging means to move the movable contact into contact with the stationary contact when the driving cam is rotated by the insertion operation, or the working rod moving under the urging force of the urging means to move the movable contact in the opposite direction of the movement during the insertion operation and separating the movable contact from the stationary contact when the driving cam is rotated by the extraction operation, the safety switch further comprising a permission structure which, when broken, permits at least the movement of the working rod in an urging direction of the urging means, wherein the operation portion is further provided with lock means which includes a locking member for inhibiting the rotation of the driving cam as locked to the driving cam and which, with the actuator inserted in the operation portion, inhibits the extraction operation by inhibiting the rotation of the driving cam via the locking member, wherein the permission structure is formed in the driving cam, and wherein a breaking strength of the driving cam is set in a manner that a breakage of the driving cam is induced when an operation force of the extraction operation or the number of extraction operations exceeds allowable values below which no damage occurs on the safety switch, while, at the breakage of the driving cam, the permission structure permits at least the movement of the working rod in the urging direction of the urging means, thus separating the movable contact from the stationary contact.

13. The safety switch according to claim 12, wherein the permission structure includes a notch formed in a part of the driving cam.

14. The safety switch according to claim 12, wherein a support slot for supporting a rotary shaft is formed through the driving cam, the support slot is divided into two holes by a bridge strip belonging to the permission structure, and the rotary shaft is supported by being inserted through one of the holes of the support slot, and wherein the breaking strength of the bridge strip is set in a manner that the breakage of the bridge strip is induced when the operation force of the extraction operation or the number of extraction operations exceeds the allowable values below which no damage occurs on the safety switch, and at the breakage of the bridge strip, the driving cam is moved away from the switch portion by the operation force of the extraction operation so as to transfer the rotary shaft to the other hole and hence, the permission structure permits at least the movement of the working rod in the urging direction of the urging means, thus separating the movable contact from the stationary contact.

15. A safety switch comprising:

an operation portion provided with a driving cam as an operable member which operates as rotating in either direction in response to an external operation of inserting or extracting an actuator;

a switch portion provided with a first switch including a movable contact and a stationary contact;

urging means for urging the movable contact in a direction away from the stationary contact; and a working rod interlocked with the rotation of the driving cam, the working rod moving against an urging force of the urging means to move the movable contact into contact with the stationary contact when the driving cam is rotated by the insertion operation, or the working rod moving under the urging force of the urging means to move the movable contact in the opposite direction of the movement during the insertion operation and separating the movable contact from the stationary contact when the driving cam is rotated by the extraction operation, the safety switch further comprising a permission structure which, when broken, permits at least the movement of the working rod in an urging direction of the urging means, wherein the operation portion is further provided with lock means which includes a locking member for inhibiting the rotation of the driving cam as locked to the driving cam and which, with the actuator inserted in the operation portion, inhibits the extraction operation by inhibiting the rotation of the driving cam via the locking member, wherein the permission structure is formed in the locking member, and wherein a breaking strength of the locking member is set by the permission structure in a manner that a breakage of the locking member is induced when an operation force of the extraction operation or the number of extraction operations exceeds allowable values below which no damage occurs on the safety switch, while, at the breakage of the locking member, the permission structure permits at least the movement of the working rod in the urging direction of the urging means by releasing the driving cam from rotation lock by the lock means, thus separating the movable contact from the stationary contact.

16. The safety switch according to claim 15, wherein the permission structure includes a notch formed in a part of the locking member.

17. The safety switch according to claim 15, wherein the permission structure includes a break slot formed in the locking member.

18. The safety switch according to claim 15, wherein the permission structure has a structure where a part of the locking member is formed thin.

19. A safety switch comprising:

an operation portion provided with a driving cam as an operable member which operates as rotating in either direction in response to an external operation of inserting or extracting an actuator;

a switch portion provided with a first switch including a movable contact and a stationary contact;

urging means for urging the movable contact in a direction away from the stationary contact; and a working rod interlocked with the rotation of the driving cam, the working rod moving against an urging force of the urging means to move the movable contact into contact with the stationary contact when the driving cam is rotated by the insertion operation, or the working rod moving under the urging force of the urging means to move the movable contact in the opposite direction of the movement during the insertion operation and separating the movable contact from the stationary contact when the driving cam is rotated by the extraction operation, the safety switch further comprising a permission structure which, when broken, permits at least the movement of the working rod in an urging direction of the urging means, wherein the operation portion is further provided with:

lock means which includes a locking member for inhibiting the rotation of the driving cam and which, with the actuator inserted in the operation portion, inhibits the extraction operation by inhibiting the rotation of the driving cam via the locking member; and an auxiliary rod including an engageable portion and connected to the working rod, and wherein the auxiliary rod allows the engageable portion to engage with the actuator when the driving cam is in the rotation lock by the lock means.

20. A safety switch comprising:

an operation portion provided with a driving cam as an operable member which operates as rotating in either direction in response to an external operation of inserting or extracting an actuator;

a switch portion provided with a first switch including a movable contact and a stationary contact;

urging means for urging the movable contact in a direction away from the stationary contact; and a working rod interlocked with the rotation of the driving cam, the working rod moving against an urging force of the urging means to move the movable contact into contact with the stationary contact when the driving cam is rotated by the insertion operation, or the working rod moving under the urging force of the urging means to move the movable contact in the opposite direction of the movement during the insertion operation and separating the movable contact from the stationary contact when the driving cam is rotated by the extraction operation, the safety switch further comprising: a permission structure which, when broken, permits at least the movement of the working rod in an urging direction of the urging means; and connecting means for connecting the working rod to the driving cam in a manner to interlock the working rod with the rotation of the driving cam, wherein the driving cam is formed with a guide portion having a cam curve shape and including a large diameter portion and a small diameter portion, wherein during the rotation of the driving cam caused by the extraction operation, the connecting means is moved along the guide portion from the large diameter portion to the small diameter portion, thus working along with the urging force of the urging means to move the working rod for switching the first switch to an open position, wherein a permission structure is formed in the connecting means, and wherein the breaking strength of the connecting means is set by the permission structure in a manner that a breakage of the connecting means is induced when an operation force of the extraction operation or the number of extraction operations exceeds allowable values below which no damage occurs on the safety switch, while, at the breakage of the connecting means, the permission structure permits at least the movement of the working rod in the urging direction of the urging means by releasing the connection between the working rod and the driving cam, thus separating the movable contact from the stationary contact.

21. A safety switch comprising:

an operation portion provided with a driving cam as an operable member which operates as rotating in either direction in response to an external operation of inserting or extracting an actuator;

a switch portion provided with a first switch including a movable contact and a stationary contact;

urging means for urging the movable contact in a direction away from the stationary contact; and a working rod interlocked with the rotation of the driving cam, the working rod moving against an urging force of the urging means to move the movable contact into contact with the stationary contact when the driving cam is rotated by the insertion operation, or the working rod moving under the urging force of the urging means to move the movable contact in the opposite direction of the movement during the insertion operation and separating the movable contact from the stationary contact when the driving cam is rotated by the extraction operation, the safety switch further comprising: a permission structure which, when broken, permits at least the movement of the working rod in an urging direction of the urging means;

connecting means for connecting the working rod to the driving cam in a manner to interlock the working rod with the rotation of the driving cam; and an auxiliary cam rotatable in both directions in response to the insertion operation and the extraction operation, wherein the driving cam is formed with a guide portion having a cam curve shape and including a large diameter portion and a small diameter portion;

wherein during the rotation of the driving cam caused by the extraction operation, the connecting means is moved along the guide portion from the large diameter portion to the small diameter portion, thus working along with the urging force of the urging means to move the working rod for switching the first switch to an open position, and wherein in the event of an abnormality where the driving cam is not rotated by the extraction operation, the auxiliary cam rotates in conjunction with the extraction operation and destroys the connecting means based on a torque derived from the extraction operation.

22. A safety switch comprising:

an operation portion provided with a driving cam as an operable member which operates as rotating in either direction in response to an external operation of inserting or extracting an actuator;

a switch portion provided with a first switch including a movable contact and a stationary contact;

urging means for urging the movable contact in a direction away from the stationary contact; and a working rod interlocked with the rotation of the driving cam, the working rod moving against an urging force of the urging means to move the movable contact into contact with the stationary contact when the driving cam is rotated by the insertion operation, or the working rod moving under the urging force of the urging means to move the movable contact in the opposite direction of the movement during the insertion operation and separating the movable contact from the stationary contact when the driving cam is rotated by the extraction operation, the safety switch further comprising a permission structure which, when broken, permits at least the movement of the working rod in an urging direction of the urging means, wherein the permission structure is formed in a rotary shaft of the driving cam, and wherein at the breakage of the rotary shaft, the permission structure permits the driving cam to move from a predetermined design position and maintains the driving cam in the moved position, thus inhibiting the movable contact from making contact with the stationary contact in conjunction with the movement of the working rod interlocked with the rotation of the driving cam caused by the insertion operation.

23. A safety switch comprising:

an operation portion provided with a driving cam which rotates in either direction in response to an external operation of inserting or extracting an actuator and is formed with a guide portion having a cam curve shape and including a large diameter portion and a small diameter portion;

a switch portion provided with a first switch including a movable contact and a stationary contact;

a working rod reciprocally moved between the operation portion and the switch portion in conjunction with the rotation of the driving cam; and connecting means for connecting the working rod to the driving cam in a manner to interlock the working rod with the rotation of the driving cam;

wherein the working rod moves the movable contact into contact with the stationary contact in conjunction with the movement of the connecting means along the guide portion from the small diameter portion to the large diameter portion when the driving cam is rotated by the insertion operation, while in conjunction with the movement of the connecting means along the guide portion from the large diameter portion to the small diameter portion when the driving cam is rotated by the extraction operation, the working rod separates the movable contact from the stationary contact by moving the movable contact in an opposite direction of the movement during the insertion operation;

the safety switch further comprising a permission structure which, when broken, permits at least the movement of the working rod in a moving direction during the extraction operation;

wherein the permission structure is formed in a support portion for supporting a rotary shaft of the driving cam; and wherein a breaking strength of the support portion is set by the permission structure in a manner that a breakage of the support portion is induced when an operation force of the extraction operation or the number of extraction operations exceeds allowable values below which no damage occurs on the safety switch, while, at the breakage of the support portion, the permission structure permits at least the movement of the working rod in the direction of the movement during the extraction operation by releasing the support of the rotary shaft by the support portion, thus separating the movable contact from the stationary contact.

24. A safety switch comprising:

an operation portion provided with a driving cam as an operable member which operates as rotating in either direction in response to an external operation of inserting or extracting an actuator;

a switch portion provided with a first switch including a movable contact and a stationary contact;

urging means for urging the movable contact in a direction away from the stationary contact; and a working rod interlocked with the rotation of the driving cam, the working rod moving against an urging force of the urging means to move the movable contact into contact with the stationary contact when the driving cam is rotated by the insertion operation, or the working rod moving under the urging force of the urging means to move the movable contact in the opposite direction of the movement during the insertion operation and separating the movable contact from the stationary contact when the driving cam is rotated by the extraction operation, the safety switch further comprising a permission structure which, when broken, permits at least the movement of the working rod in an urging direction of the urging means, wherein the permission structure is formed in a support portion for supporting a rotary shaft of the driving cam, and wherein at the breakage of the support portion, the permission structure permits the driving cam to move from a predetermined design position and maintains the driving cam in the moved position, thus inhibiting the movable contact from making contact with the stationary contact in conjunction with the movement of the working rod interlocked with the rotation of the driving cam caused by the insertion operation.

25. A safety switch comprising:

an operation portion provided with a driving cam as an operable member which operates as rotating in either direction in response to an external operation of inserting or extracting an actuator;

a switch portion provided with a first switch including a movable contact and a stationary contact;

urging means for urging the movable contact in a direction away from the stationary contact; and a working rod interlocked with the rotation of the driving cam, the working rod moving against an urging force of the urging means to move the movable contact into contact with the stationary contact when the driving cam is rotated by the insertion operation, or the working rod moving under the urging force of the urging means to move the movable contact in the opposite direction of the movement during the insertion operation and separating the movable contact from the stationary contact when the driving cam is rotated by the extraction operation, the safety switch further comprising a permission structure which, when broken, permits at least the movement of the working rod in an urging direction of the urging means, wherein a support slot for supporting a rotary shaft is formed through the driving cam, the support slot is divided into two holes by a bridge strip belonging to the permission structure, and the rotary shaft is supported by being inserted through one of the holes of the support slot, and wherein at the breakage of the bridge strip, the permission structure permits the driving cam to move from a predetermined design position by transferring the rotary shaft to the other hole and maintains the driving cam in the moved position, thus inhibiting the movable contact from making contact with the stationary contact in conjunction with the movement of the working rod interlocked with the rotation of the driving cam caused by the insertion operation.

26. A safety switch comprising:

an operation portion provided with a driving cam which rotates in either direction in response to an external operation of inserting or extracting an actuator and is formed with a guide portion having a cam curve shape and including a large diameter portion and a small diameter portion;

a switch portion provided with a first switch including a movable contact and a stationary contact;

a working rod reciprocally moved between the operation portion and the switch portion in conjunction with the rotation of the driving cam; and connecting means for connecting the working rod to the driving cam in a manner to interlock the working rod with the rotation of the driving cam, wherein the working rod moves the movable contact into contact with the stationary contact in conjunction with the movement of the connecting means along the guide portion from the small diameter portion to the large diameter portion when the driving cam is rotated by the insertion operation, while in conjunction with the movement of the connecting means along the guide portion from the large diameter portion to the small diameter portion when the driving cam is rotated by the extraction operation, the working rod separates the movable contact from the stationary contact by moving the movable contact in an opposite direction of the movement during the insertion operation, the safety switch further comprising a permission structure which, when broken, permits at least the movement of the working rod in a moving direction during the extraction operation, wherein the permission structure is formed in a rotary shaft of the driving cam, and wherein a breaking strength of the rotary shaft is set by the permission structure in a manner that a breakage of the rotary shaft is induced when an operation force of the extraction operation or the number of extraction operations exceeds allowable values below which no damage occurs on the safety switch, while, at the breakage of the rotary shaft, the permission structure permits at least the movement of the working rod in the direction of the movement during the extraction operation in conjunction with a movement of the driving cam caused by the extraction operation, thus separating the movable contact from the stationary contact.

27. A safety switch comprising:

an operation portion provided with a driving cam which rotates in either direction in response to an external operation of inserting or extracting an actuator and is formed with a guide portion having a cam curve shape and including a large diameter portion and a small diameter portion;

a switch portion provided with a first switch including a movable contact and a stationary contact;

a working rod reciprocally moved between the operation portion and the switch portion in conjunction with the rotation of the driving cam; and connecting means for connecting the working rod to the driving cam in a manner to interlock the working rod with the rotation of the driving cam, wherein the working rod moves the movable contact into contact with the stationary contact in conjunction with the movement of the connecting means along the guide portion from the small diameter portion to the large diameter portion when the driving cam is rotated by the insertion operation, while in conjunction with the movement of the connecting means along the guide portion from the large diameter portion to the small diameter portion when the driving cam is rotated by the extraction operation, the working rod separates the movable contact from the stationary contact by moving the movable contact in an opposite direction of the movement during the insertion operation, the safety switch further comprising a permission structure which, when broken, permits at least the movement of the working rod in a moving direction during the extraction operation, wherein the operation portion is further provided with lock means which includes a locking member for inhibiting the rotation of the driving cam as locked to the driving cam and which, with the actuator inserted in the operation portion, inhibits the extraction operation by inhibiting the rotation of the driving cam via the locking member, wherein a support slot for supporting a rotary shaft is formed through the driving cam, the support slot is divided into two holes by a bridge strip belonging to the permission structure, and the rotary shaft is supported by being inserted through one of the holes of the support slot, and wherein a breaking strength of the bridge strip is set in a manner that a breakage of the bridge strip is induced when an operation force of the extraction operation or the number of extraction operations exceeds allowable values below which no damage occurs on the safety switch, and at the breakage of the bridge strip, the driving cam is moved away from the switch portion by the operation force of the extraction operation so as to transfer the rotary shaft to the other hole and hence, the permission structure permits at least the movement of the working rod in the direction of the movement during the extraction operation, thus separating the movable contact from the stationary contact.

* * * * *